US012344943B2

(12) United States Patent
Park et al.

(10) Patent No.: US 12,344,943 B2
(45) Date of Patent: Jul. 1, 2025

(54) CATALYST FOR ELECTROCHEMICAL SYNTHESIS OF AMMONIA, METHOD FOR PREPARING SAME, AND METHOD FOR REGENERATING SAME

(71) Applicant: KOREA INSTITUTE OF SCIENCE AND TECHNOLOGY, Seoul (KR)

(72) Inventors: Hyun S. Park, Seoul (KR); Sung Jong Yoo, Seoul (KR); Jong Hyun Jang, Seoul (KR); Hee-Young Park, Seoul (KR); Bora Seo, Seoul (KR); Jin Young Kim, Seoul (KR); Hyoung-Juhn Kim, Seoul (KR); So Young Lee, Seoul (KR); Jihyun Choi, Seoul (KR); Jimin Kong, Seoul (KR); Hee Soo Kim, Seoul (KR); Gyu Seong Yi, Seoul (KR)

(73) Assignee: KOREA INSTITUTE OF SCIENCE AND TECHNOLOGY, Seoul (KR)

( * ) Notice: Subject to any disclaimer, the term of this patent is extended or adjusted under 35 U.S.C. 154(b) by 937 days.

(21) Appl. No.: 17/342,545

(22) Filed: Jun. 9, 2021

(65) Prior Publication Data

US 2022/0042185 A1 Feb. 10, 2022

(30) Foreign Application Priority Data

Aug. 6, 2020 (KR) ..... 10-2020-0098505

(51) Int. Cl.

| | |
|---|---|
| ***C25B 11/054*** | (2021.01) |
| ***C25B 1/27*** | (2021.01) |
| ***C25B 11/055*** | (2021.01) |
| ***C25B 11/075*** | (2021.01) |

(52) U.S. Cl.

CPC ..... *C25B 11/054* (2021.01); *C25B 1/27* (2021.01); *C25B 11/055* (2021.01); *C25B 11/075* (2021.01)

(58) Field of Classification Search

CPC .. B01J 27/30; B01J 37/20; B01J 27/04–0515; C25B 1/27

See application file for complete search history.

(56) References Cited

U.S. PATENT DOCUMENTS

| | | | | |
|---|---|---|---|---|
| 6,100,210 | A * | 8/2000 | Ollivier | B01J 38/64 502/25 |
| 2020/0002180 | A1 | 1/2020 | Kim et al. | |
| 2021/0115576 | A1* | 4/2021 | Hernández Alonso et al. | C25B 9/65 |

FOREIGN PATENT DOCUMENTS

| | | | |
|---|---|---|---|
| KR | 10-2018-0115542 | A | 10/2018 |
| KR | 10-1924490 | B1 | 12/2018 |
| KR | 10-2020-0002278 | A | 1/2020 |

(Continued)

OTHER PUBLICATIONS

Furuya et al, "Electroreduction of nitrogen to ammonia on gas-diffusion electrodes loaded with inorganic catalyst", 1990, Journal of Electroanalytical Chemistry, 291, 269-272. (Year: 1990).*

(Continued)

*Primary Examiner* — Luan V Van
*Assistant Examiner* — Andrew Koltonow
(74) *Attorney, Agent, or Firm* — CANTOR COLBURN LLP

(57) ABSTRACT

The present disclosure relates to a catalyst for electrochemical synthesis of ammonia, which includes a metal sulfide, a method for preparing the same and a method for regenerating the same.

6 Claims, 59 Drawing Sheets

(56) References Cited

FOREIGN PATENT DOCUMENTS

KR 10-2020-0031914 A 3/2020
WO 2012/078836 A1 6/2012

OTHER PUBLICATIONS

H. Wang et al, "Ambient Electrosynthesis of Ammonia: Electrode Porosity and Composition Engineering", Jun. 20, 2018, Angewandte Chemie International Edition, 57, 12360-12364. (Year: 2018).*
Y. Wang et al, "Controllable synthesis of various kinds of copper sulfides (CuS, Cu7S4, Cu9S5) for high-performance supercapacitors", Apr. 29, 2015, Dalton Transactions, 44, 10431-10437. (Year: 2015).*
Bosch et al, Electrochemistry in Light Water Reactors: Reference Electrodes, Measurement, Corrosion and Tribocorrosion Issues, 2007, CRC Press, p. 10-13). (Year: 2007).*
H. Wang et al "Ambient Electrosynthesis of Ammonia: Electrode Porosity and Composition Engineering", Jun. 20, 2018, Angewandte Chemie International Edition, 57, 12360-12364 and associated electronic Supporting Information (Year: 2018).*
Chakraborty et al, "A Low-Temperature Molecular Precursor Approach to Copper-Based Nano-Sized Digenite Mineral for Efficient Electrocatalytic Oxygen Evolution Reaction", Feb. 3, 2020, Chemistry—an Asian Journal, 15, 852-859. (Year: 2020).*
Saranya et al, "A template-free facile approach for the synthesis of CuS-rGO nanocomposites towards enhanced photocatalytic reduction of organic contaminants and textile effluents", Jan. 29, 2015, RSC Advances, 5, 15831. (Year: 2015).*
Wang et al, "Highly ordered Nb2O5 nanochannel film with rich oxygen vacancies for electrocatalytic N2 reduction: Inactivation and regeneration of electrode", Jan. 15, 2021, Chinese Chemical Letters, 32, 9, 2833-2836. (Year: 2021).*
Mengfan Wang et al., "Over 56.55% Faradaic efficiency of ambient ammonia synthesis enabled by positively shifting the reaction potential," Nature Communications, 2019, 8 pages, vol. 10.
Ke Chu et al., "Electronically Coupled SnO2 Quantum Dots and Graphene for Efficient Nitrogen Reduction Reaction," ACS Applied Materials & Interfaces, 2019, pp. 31806-31815, vol. 11, American Chemical Society.
Hui Cheng et al., "Molybdenum carbide nanodots enable efficient electrocatalytic nitrogen fixation under ambient conditions," Advanced Materials, 2018, 7 pages, vol. 30, No. 1803694.
Jimin Kong et al., "Electrochemical synthesis of NH3 at low temperature and atmospheric pressure using a gamma-Fe2O3 catalyst," ACS Sustainable Chem. Eng., 2017, pp. 10986-10995, vol. 5.
Zhong-Hua Xue et al., "Electrochemical reduction of N2 into NH3 by donor-acceptor couples of Ni and Au nanoparticles with a 67.8% Faradaic efficiency," Journal of American Chemical Soceity, 2019, pp. 14976-14980, vol. 141.
Si-Jia Li et al.," Amorphizing of Au nanoparticles by CeOx-RGO hybrid support towards highly efficient electrocatalyst for N2 reduction under ambient conditions," Advanced Materials, 2017, 6 pages, vol. 29, No. 1700001.
Fang Lu et al., "Nitrogen-coordinated single Fe sites for efficient electrocatalytic N2 fixation in neutral media," Nano Energy, 2019, pp. 420-427, vol. 61.
Yu-Chen Hao et al., "Promoting nitrogen electroreduction to ammonia with bismuth nanocrystals and potassium cations in water," Nature Catalysis, 2019, pp. 448-456.
Pengzuo Chen et al.," Interfacial engineering of cobalt sulfide/graphene hybrids for highly efficient ammonia electrosynthesis," PNAS, 2019, pp. 6635-6640, vol. 116, No. 14.
Jin-Tao Ren et al., "Promotion of electrocatalytic nitrogen reduction reaction on N-doped porous carbon with secondary heteroatoms," Applied Catalysis B, 2020, 7 pages.
Di Bao et al., "Electrochemical reduction of N2 under ambient conditions for artificial N2 fixation and renewable energy storage using N2/NH3 cycle," Advanced Materials, 2017, 5 pages, vol. 29, 1604799.
Pengfei Song et al., "Electrochemical nitrogen reduction to ammonia at ambient conditions on nitrogen and phosphorus co-doped porous carbon," ChemComm, 2019, pp. 687-690, The Royal Society of Chemistry.
Jie Li et al., "Accelerated dinitrogen electroreduction to ammonia via interfacial polarization triggered by single-atom protrusions," Chem, 2020, pp. 885-901.
Zhigang Geng et al., "Achieving a Record-High Yield Rate of 120.9 for N2 Electrochemical Reduction over Ru Single-Atom Catalysts," Advanced Materials, 2018, 6 pages, vol. 30, 1803498.
Qinglin Li et al., "Biomass-Derived Nitrogen-Doped Porous Carbon for Highly Efficient Ambient Electro-Synthesis of NH3," Catalysts, 2020, 8 pages, vol. 10, No. 353.
Ling Zhang et al., "Electrochemical Ammonia Synthesis via Nitrogen Reduction Reaction on a MoS2 Catalyst: Theoretical and Experimental Studies," Advanced Materials, 2018, 6 pages, vol. 30, 1800191.
Yongjin Fang et al., "Bullet-like Cu9S5 Hollow Particles Coated with Nitrogen-Doped Carbon for Sodium-Ion Batteries," Angewandte Chemie, Apr. 2019, pp. 7826-7830, vol. 131, Issue 23.
Younes Abghoui et al., "Biomimetic Nitrogen Fixation Catalyzed by Transition Metal Sulfide Surfaces in an Electrolytic Cell," ChemSusChem, Jul. 2019, pp. 4265-4273, vol. 12, Issue 18.
Sandhya Yadav et al., "Role of precursors in controlling the size, shape and morphology in the synthesis of copper sulfide nanoparticles and their application for fluorescence detection," Journal of Alloys and Compounds, 2019, pp. 579-592, vol. 772.
Wenjie Zang et al., "Copper Single Atoms Anchored in Porous Nitrogen-Doped Carbon as Efficient pH-Universal Catalysts for the Nitrogen Reduction Reaction," ACS Catalysis, 2019, pp. 10166-10173, vol. 9, American Chemical Society.

* cited by examiner

CATALYST FOR ELECTROCHEMICAL SYNTHESIS OF AMMONIA, METHOD FOR PREPARING SAME, AND METHOD FOR REGENERATING SAME

CROSS-REFERENCE TO RELATED APPLICATION

This application claims the priority of Korean Patent Application No. 10-2020-0098505 filed on Aug. 6, 2020, and all the benefits accruing therefrom under 35 U.S.C. § 119, the contents of which in its entirety are herein incorporated by reference.

TECHNICAL FIELD

Description of Government-Supported Research and Development

This research was supervised by the Korea Institute of Science and Technology and supported by the Ministry of Science and ICT. Research project is Future materials discovery (R&D) and Research title is Development of structural alchemy technology for preparation of fractal catalyst (project ID: 1711105282).

The present disclosure relates to a catalyst for electrochemical synthesis of ammonia, which includes a metal sulfide, a method for preparing the same and a method for regenerating the same.

BACKGROUND ART

Ammonia ($NH_3$) is a very important chemical in various applications, including plastics, textile industry, agriculture and food production. In addition, it draws attentions as a hydrogen carrier that can be transported easily. As of 2017, the total production of $NH_3$ worldwide exceeded 150 million ton, and the demand for $NH_3$ is increasing consistently. At present, most of industrial production of ammonia depends on the traditional Haber-Bosch process whereby ammonia is produced from high-quality nitrogen and hydrogen gases at high temperature (300-500° C.) and pressure (150-300 atm). This process has the problems of a lot of natural gas consumption and severe environmental problems such as a large quantity of $CO_2$ emission. In order to resolve the problems of the Haber-Bosch process, a new ammonia synthesis method which is environment-friendly and consumes less energy is necessary.

Nowadays, electrochemical nitrogen reduction reaction (eNRR) has been proposed as an alternative method for producing $NH_3$ from $N_2$ and $H_2O$ under ambient conditions. Although this $NH_3$ production method is environment-friendly and renewable, about 941 $kJmol^{-1}$ of energy is necessary to break the strong triple bond of the $N_2$ molecule. Therefore, eNRR has the problems of low FE efficiency and ammonia production yield. To solve this disadvantage, an electrocatalyst with high activity is necessary for renewable and environment-friendly conversion from $N_2$ to $NH_3$.

Meanwhile, although various eNRR catalysts have been investigated for improved eNRR performance, including noble metal, transition metal oxide, nitride, carbide, sulfide and metal-free catalysts, researches on the regeneration of catalysts for renewable eNRR with high yield has never been reported.

REFERENCES OF RELATED ART

Non-Patent Documents (Non-patent document 1) Wang, M.; Liu, S.; Qian, T.; Liu, J.; Zhou, J.; Ji, H.; Xiong, J.; Zhong, J.; Yan, C., Over 56.55% Faradaic efficiency of ambient ammonia synthesis enabled by positively shifting the reaction potential. *Nat. Commun.,* 2019, 10, 1-8.

(Non-patent document 2) Chu, K.; Liu, Y.-p.; Li, Y.-b.; Wang, J.; Zhang, H., Electronically Coupled $SnO_2$ Quantum Dots and Graphene for Efficient Nitrogen Reduction Reaction. *ACS Appl. Mater. Interfaces* 2019, 11, 31806-31815.

(Non-patent document 3) Cheng, H.; Ding, L. X.; Chen, G. F.; Zhang, L.; Xue, J.; Wang, H., Molybdenum carbide nanodots enable efficient electrocatalytic nitrogen fixation under ambient conditions. *Adv. Mater.* 2018, 30, 1803694.

(Non-patent document 4) Kong, J.; Lim, A.; Yoon, C.; Jang, J. H.; Ham, H. C.; Han, J.; Nam, S.; Kim, D.; Sung, Y.-E.; Choi, J., Electrochemical synthesis of NH3 at low temperature and atmospheric pressure using a γ2O3 catalyst. *ACS Sustainable Chem. Eng.* 2017, 5, 10986-10995.

(Non-patent document 5) Xue, Z.-H.; Zhang, S.-N.; Lin, Y.-X.; Su, H.; Zhai, G.-Y.; Han, J.-T.; Yu, Q.-Y.; Li, X.-H.; Antonietti, M.; Chen, J.-S., Electrochemical reduction of $N_2$ into $NH_3$ by donor-acceptor couples of Ni and Au nanoparticles with a 67.8% Faradaic efficiency. *J. Am. Chem. Soc.* 2019, 141, 14976-14980.

(Non-patent document 6) Li, S. J.; Bao, D.; Shi, M. M.; Wulan, B. R.; Yan, J. M.; Jiang, Q., Amorphizing of Au nanoparticles by CeOx-RGO hybrid support towards highly efficient electrocatalyst for $N_2$ reduction under ambient conditions. *Adv. Mater.* 2017, 29, 1700001.

(Non-patent document 7) Lü, F.; Zhao, S.; Guo, R.; He, J.; Peng, X.; Bao, H.; Fu, J.; Han, L.; Qi, G.; Luo, J., Nitrogen-coordinated single Fe sites for efficient electrocatalytic $N_2$ fixation in neutral media. *Nano Energy* 2019, 61, 420-427.

(Non-patent document 8) Hao, Y.-C.; Guo, Y.; Chen, L.-W.; Shu, M.; Wang, X.-Y.; Bu, T.-A.; Gao, W.-Y.; Zhang, N.; Su, X.; Feng, X., Promoting nitrogen electroreduction to ammonia with bismuth nanocrystals and potassium cations in water. *Nat. Catal.,* 2019, 2, 448-456.

(Non-patent document 9) Chen, P.; Zhang, N.; Wang, S.; Zhou, T.; Tong, Y.; Ao, C.; Yan, W.; Zhang, L.; Chu, W.; Wu, C., Interfacial engineering of cobalt sulfide/graphene hybrids for highly efficient ammonia electrosynthesis. *Proc. Natl. Acad. Sci. U.S.A.,* 2019, 116, 6635-6640.

(Non-patent document 10) Ren, J.-T.; Wan, C.-Y.; Pei, T.-Y.; Lv, X.-W.; Yuan, Z.-Y., Promotion of electrocatalytic nitrogen reduction reaction on N-doped porous carbon with secondary heteroatoms. *Appl. Catal.*, B, 2020, 118633.

(Non-patent document 11) Bao, D.; Zhang, Q.; Meng, F. L.; Zhong, H. X.; Shi, M. M.; Zhang, Y.; Yan, J. M.; Jiang, Q.; Zhang, X. B., Electrochemical reduction of $N_2$ under ambient conditions for artificial $N_2$ fixation and renewable energy storage using $N_2/NH_3$ cycle. *Adv. Mater.* 2017, 29, 1604799.

(Non-patent document 12) Song, P.; Wang, H.; Kang, L.; Ran, B.; Song, H.; Wang, R., Electrochemical nitrogen reduction to ammonia at ambient conditions on nitrogen and phosphorus co-doped porous carbon. *Chem. Commun.,* 2019, 55, 687-690.

(Non-patent document 13) Li, J.; Chen, S.; Quan, F.; Zhan, G.; Jia, F.; Ai, Z.; Zhang, L., Accelerated dinitrogen electroreduction to ammonia via interfacial polarization triggered by single-atom protrusions. *Chem,* 2020, 6, 885-901.

(Non-patent document 14) Geng, Z.; Liu, Y.; Kong, X.; Li, P.; Li, K.; Liu, Z.; Du, J.; Shu, M.; Si, R.; Zeng, J., Achieving a Record-High Yield Rate of 120.9 for $N_2$ Electrochemical Reduction over Ru Single-Atom Catalysts. *Adv. Mater.* 2018, 30, 1803498.

DISCLOSURE

Technical Problem

In an aspect, the present disclosure is directed to providing a metal sulfide-based catalyst which exhibits remarkable NRR activity and overcomes weak durability.

In another aspect, the present disclosure is directed to providing a method for preparing a metal sulfide-based catalyst convenient via a thermal heating process and a solid-state reaction.

In another aspect, the present disclosure is directed to providing a method for achieving remarkable eNRR reaction by using an electrochemical regeneration process between continuous eNRR reactions.

Technical Solution

In an aspect, the present disclosure provides a catalyst for electrochemical synthesis of ammonia, which includes a copper-sulfur compound and N-doped carbon.

In another aspect, the present disclosure provides an electrode for ammonia synthesis, which includes the catalyst for ammonia synthesis described above.

In another aspect, the present disclosure provides a method for preparing a catalyst for ammonia synthesis, which includes a step of preparing a mixture of a copper precursor containing N and a sulfur precursor containing C and N; and a step of heat-treating the mixture.

In another aspect, the present disclosure provides a method for regenerating the catalyst for ammonia synthesis described above, which includes a step of synthesizing ammonia by electrochemical nitrogen reduction reaction (eNRR) in the presence of a catalyst for electrochemical synthesis of ammonia; and a step of regenerating the catalyst for electrochemical synthesis of ammonia after the step of synthesizing ammonia using $Na_2S$.

Advantageous Effects

According to an aspect of the present disclosure, there is provided an electrochemical regeneration method providing remarkably superior ammonia synthesis activity as compared to the existing single metal or metal oxide catalyst and being applicable to continuous NRR. The method may be used to improve the production yield and synthesis speed of a catalyst in an environment-friendly way.

BEST MODE

Hereinafter, specific exemplary embodiments of the present disclosure are described in detail referring to the attached drawings.

The described exemplary embodiments of the present disclosure are provided for the purpose of illustration only. The exemplary embodiments of the present disclosure may also be embodied into other various forms, without being limited to the described exemplary embodiments.

The present disclosure may be changed variously and may have various exemplary embodiments. The exemplary embodiments are not intended to limit the present disclosure, and should be understood to include all changes, equivalents and substitutes included in the technical idea and scope of the present disclosure.

In the present disclosure, when a portion is described to "include" a certain element, it does not mean that another element is excluded but means that another element can be included unless specially stated otherwise.

Catalyst for Electrochemical Synthesis of Ammonia

In exemplary embodiments of the present disclosure, there is provided a catalyst for electrochemical synthesis of ammonia, which includes a copper-sulfur compound and N-doped carbon.

The present disclosure discloses a copper-sulfur compound/NC (N-doped carbon) composite which exhibits superior NRR activity and is prepared by a thermal heating process and a solid-state reaction under an Ar atmosphere.

In an exemplary embodiment, the copper-sulfur compound may be represented by the chemical formula $Cu_xS_y$ (wherein x is 1.7-1.8 when y is 1).

In an exemplary embodiment, the copper-sulfur compound may be represented by the chemical formula $Cu_xS_y$ (wherein x is 8.5-9 when y is 5).

Figure 5A:
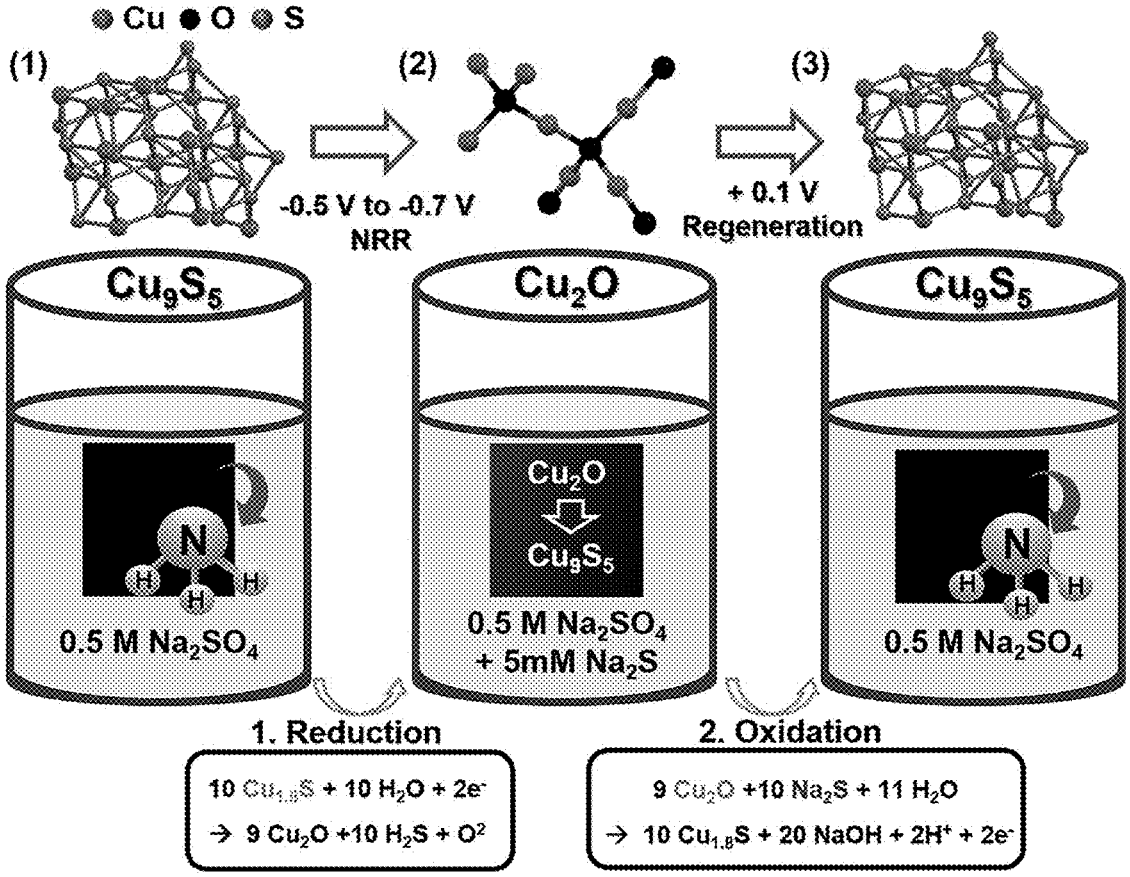
FIG. 5A schematically illustrates electrochemical NRR and regeneration processes including an electrochemical reaction using a $Cu_9S_5$/NC electrode.

In an exemplary embodiment, the copper-sulfur compound may be represented by the chemical formula of $Cu_9S_5$. The actual structure of the copper-sulfur compound may be the same as (1) in FIG. 5A. When N-doped carbon is present together, a complex may be formed and exist in a dispersed state as shown in FIG. 5B.

In an exemplary embodiment, the copper-sulfur compound and the N-doped carbon may be complexed with each other and dispersed throughout the catalyst.

Figure 5B:
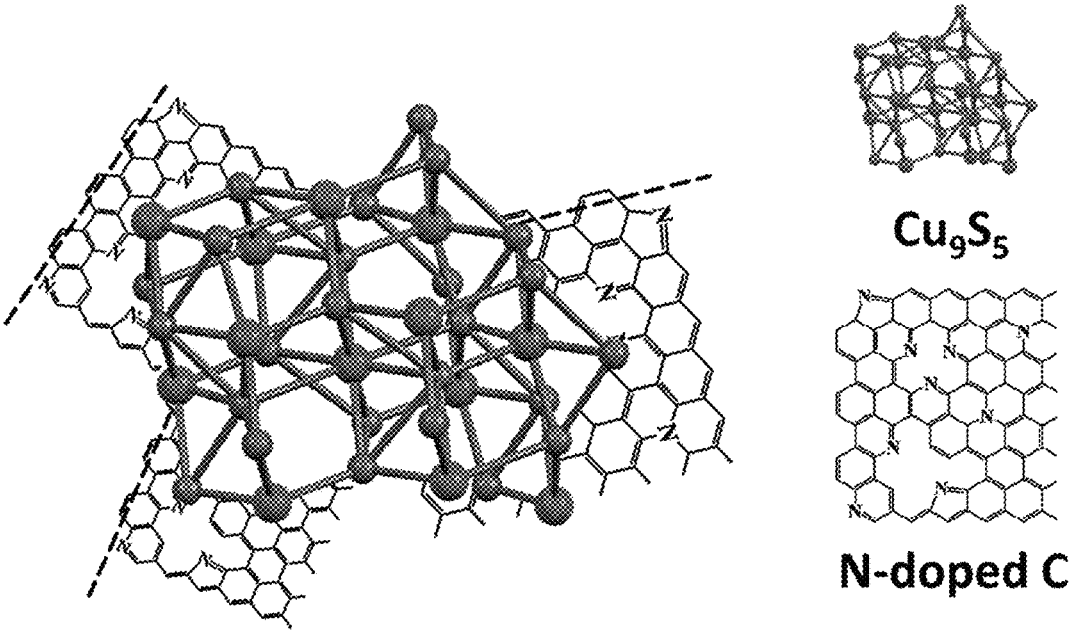
FIG. 5B shows the structure of finally produced $Cu_9S_5$/NC.

FIG. 5B schematically shows the structure of $Cu_9S_5$/NC formed according to an exemplary embodiment of the present disclosure. In the figure, the dotted lines means that the illustrated structure is repeated.

Referring to FIG. 5B, the N-doped carbon serves as a carrier or a support. The copper-sulfur compound may be dispersed on the N-doped carbon, and the N-doped carbon and the copper-sulfur compound may be complexed with each other and dispersed throughout the catalyst as a 3-dimensional structure.

In an exemplary embodiment, a mass ratio of the copper-sulfur compound may be 65-85% based on the total mass of the catalyst. If the mass ratio is lower than 65%, the apparent activity of an electrode may be low due to insufficient catalyst loading. And, if it exceeds 85%, the mass activity of the catalyst may decrease due to aggregation of excess catalyst and it may be difficult to achieve an NRR electron transfer effect due to low NC content.

In an exemplary embodiment, the catalyst may have a size of 0.1-10 μm.

In an exemplary embodiment, the catalyst may have a specific surface area (SSA) of 5-20 $m^2g^{-1}$.

In an exemplary embodiment, the catalyst may have a total pore volume of 0.001-0.15 $cm^3g^{-1}$.

In an exemplary embodiment, the catalyst may have an ammonia production yield of 600 nmol/$hcm^2$ or higher at −0.5 $V_{RHE}$.

In an exemplary embodiment, the catalyst may be regenerated using $Na_2S$.

Another exemplary embodiment of the present disclosure provides an electrode for ammonia synthesis including the catalyst for ammonia synthesis.

Method for Preparing Catalyst for Electrochemical Synthesis of Ammonia

Figure 1A:
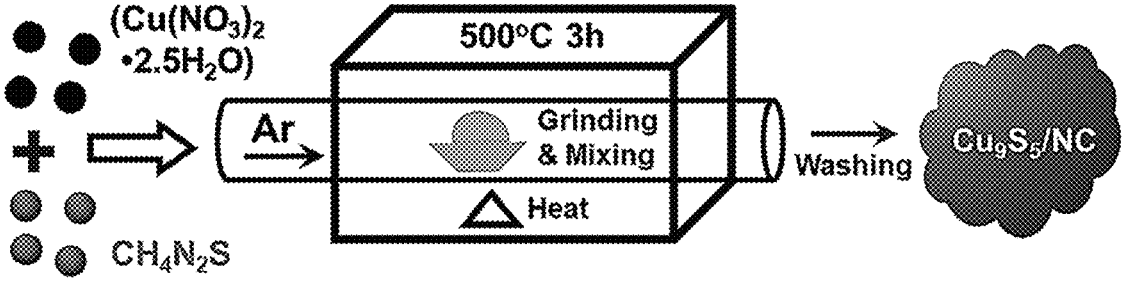
FIGS. 1A-1E show a schematic of a $Cu_9S_5$/NC synthesis process (1A), an XRD pattern of a $Cu_9S_5$/NC sample (1B), an SEM image of $Cu_9S_5$/NC (1C), a TEM image of $Cu_9S_5$/NC (1D) and an EDX elemental mapping of $Cu_9S_5$/NC (1E). The insert in FIG. 1D shows the enlarged lattice structure, and the larger image in FIG. 1D shows a result of observing the bulk state (low magnification). The insert in FIG. 1D shows the lattice structure of $Cu_9S_5$/NC and the crystal lattice of $Cu_9S_5$ observed by HR-TEM. From the TEM image analysis result, it can be seen that a composite structure wherein N-doped carbon is attached to $Cu_9S_5$ is formed. The interatomic distance corresponding to the (0015) crystal plane of $Cu_9S_5$ can be confirmed from the high-resolution TEM result.

Another exemplary embodiment of the present disclosure provides a method for preparing a catalyst for electrochemical synthesis of ammonia, which includes: a step of preparing a mixture of a copper precursor comprising N and a sulfur precursor comprising C and N; and a step of heat-treating the mixture (see FIG. 1A).

In an exemplary embodiment, the copper precursor may be $Cu(NO_3)_2 \cdot 6H_2O$ and the sulfur precursor may be $CH_4N_2S$.

The copper precursor is a hydrate $Cu(NO_3)_2 \cdot H_2O$ and the sulfur precursor is thiourea ($CH_4N_2S$). As $Cu_9S_5$ is formed from the S of the sulfur precursor and the Cu of the copper precursor under a high-temperature condition, and N-doped carbon is synthesized from the remaining C and N sources.

In an exemplary embodiment, in the step of preparing the mixture, the copper precursor and the sulfur precursor may be pulverized and mixed.

In an exemplary embodiment, the step of heat-treating the mixture may be performed by a solid-state reaction.

In an exemplary embodiment, the step of heat-treating the mixture may be performed at 400-600° C. for 1-5 hours.

In an exemplary embodiment, the step of heat-treating the mixture may be performed under Ar atmosphere.

Method for Regenerating Catalyst for Electrochemical Synthesis of Ammonia

Another exemplary embodiment of the present disclosure provides a method for regenerating a catalyst for ammonia synthesis, which includes: a step of synthesizing ammonia by electrochemical nitrogen reduction reaction (eNRR) in the presence of a catalyst for electrochemical synthesis of ammonia; and a step of regenerating the catalyst for electrochemical synthesis of ammonia after the step of synthesizing ammonia using $Na_2S$.

Despite the simple synthesis process and remarkable NRR activity of the catalyst for ammonia synthesis described above, the catalyst experiences composition change to $Cu_2O$ during NRR due to the weak durability of the metal sulfide/NC (N-doped carbon). In order to overcome the disadvantage of the metal sulfide-based catalyst, the deteriorated of the catalyst such as $Cu_9S_5$/NC, i.e., $Cu_2O$, may be regenerated by an electrochemical regeneration process in between the continuous eNRR reaction. During the electrochemical metal oxide/sulfide redox regeneration cycle, $NH_3$ and $H_2$ are produced from dissolved $N_2$ and $H_2O$ through repeated $N_2$ fixation reactions.

Until now, electrochemical $NH_3$ production using a catalyst regenerated by oxide/sulfide redox cycles mimicking the natural regeneration of a $N_2$ fixation catalyst has not been reported yet. This unprecedented method for achieving remarkable eNRR reaction provides an insight for an electrochemical $N_2$ reduction mechanism on the metal sulfide surface. Accordingly, it is expected that regeneration redox cycle of the eNRR catalyst provided in the present disclosure will provide a new method for preparing a material for an effective eNRR catalyst.

In an exemplary embodiment, the step of regenerating the catalyst for electrochemical synthesis of ammonia may be performed by immersing the catalyst for electrochemical synthesis of ammonia in an aqueous solution containing $Na_2S$ and an electrolyte.

In an exemplary embodiment, the step of regenerating the catalyst for electrochemical synthesis of ammonia may be performed at a potential of 0.05-1 $V_{RHE}$ for 30 minutes to 5 hours.

In an exemplary embodiment, after the step of regenerating the catalyst for electrochemical synthesis of ammonia, the step of synthesizing ammonia may be repeated using the regenerated catalyst.

Hereinafter, the present disclosure will be described in more detail through examples.

However, the following examples are for illustrating the present disclosure in more detail, and it will be obvious to those having ordinary skill in the art that the scope and contents of the present disclosure are not reduced or limited by the examples. In addition, it is also obvious that those having ordinary skill in the art that can easily carry out the present disclosure based on the disclosure of the present disclosure even for the matters experimental data of which are not presented and such changes and modifications belong to the scope of the appended claims.

EXAMPLES

Experimental Methods

Reagents and Chemicals $CuCl_2 \cdot 2H_2O$ (Sigma-Aldrich), $Cu(NO_3)_2 \cdot 2.5H_2O$ (Sigma-Aldrich), ethylene glycol (99.8%, Sigma-Aldrich), $Na_2S$ (99%, Sigma-Aldrich), p-dimethylaminobenzaldehyde (99%, Sigma-Aldrich), thiourea (99%, Junsei), ethanol (95%, Daejung), Nafion resin solution (5 wt %, Sigma-Aldrich) and isopropyl alcohol (99.5%, Duksan) were used. All chemicals were of analytical grade and used without further purification.

Synthesis of $Cu_9S_5$/NC (Catalyst for Electrochemical Synthesis of Ammonia)

A $Cu_9S_5$/NC catalyst was prepared by pulverizing $Cu(NO_3)_2 \cdot 2.5H_2O$ and $CH_4N_2S$ powders and then heat-treating the same in a crucible (FIG. 1A).

Specifically, $Cu(NO_3)_2 \cdot 2.5H_2O$ (0.8 g) and thiourea (1.2 g) were mixed as follows. The precursors were mixed well physically in an agate mortar by agitating for about 5 minutes.

After transferring to a ceramic crucible, the mixture was heated in a tube furnace at 773 K (500° C.) for 1 hour with a heating rate of 8.3 K/min under Ar gas atmosphere. The prepared catalyst was washed 4 times with deionized water.

Synthesis of $Cu_9S_5$ $CuCl_2 \cdot 2H_2O$ (1 g) and thiourea (1 g) were added to ethylene glycol (40 mL). After stirring for 30 minutes, the precursors were heated in an oven controlled to 150° C. (423 K) for 4 hours under an autoclave condition. Then, the prepared catalyst was washed several times with deionized water and ethanol.

NRR Measurement

For preparation of a working electrode, the wet-dispersed $Cu_9S_5$/NC or $Cu_9S_5$ catalyst was sprayed manually onto carbon paper (2.5 cm×2.5 cm, Toray T-120) and then dried in a desiccator at ambient temperature. The loading amount of the catalyst coated on the electrode was set to 1 mg/cm$^2$. A catalyst ink was prepared by mixing 10 mg of the catalyst powder with 1 mL of an IPA solution. Prior to starting experiment, the working electrode was rinsed with 0.5 M $Na_2SO_4$ (pH 7) to remove water-soluble pollutants attached to the surface. As an electrolyte for eNRR, 0.5 M $Na_2SO_4$ (99%, aqueous solution) was used. 10 mM $H_2SO_4$ was used to trap $NH_3$ in the electrolysis chamber. The cathode and anode chambers of H-cell were separated using an anion exchange membrane (FAA-3, Fumatech), which were pretreated with 1 M KOH for 24 hours prior to the test, and then further pretreated with DI water for 1 hour. The Bio-Logic SP-300 potentiostat was used for all electrochemical experiments. Electrochemical experiments were conducted at room temperature under atmospheric pressure. For a 3-electrode system, a standard calomel electrode (SCE) and a graphite rod were used as a reference electrode and a counter electrode, respectively, and carbon paper covered with the catalyst powder was used as a working electrode. All potentials were referenced to the reversible hydrogen electrode scale. The activity of electrochemical ammonia synthesis was measured by chronoamperometry (CA) for different potentials from −0.4 to −0.8 $V_{RHE}$ for an hour. For NRR, $^{14}N_2$ (99.999%, Sinyang) and $^{15}N_2$ (98 atom %, Sigma) were bubbled for about 20 minutes prior to measurement and then purged into the cathode compartment at a flow rate of 250 ccm and 5 ccm, respectively, during the experiment. The redox characteristics of the catalyst loaded onto a glossy carbon (GC) electrode were investigated in different electrolytes by cyclic voltammetry (CV) at a scan rate of 50 mV/s.

Regeneration of Metal Chalcogenide Electrode

During the NRR measurement, the $Cu_9S_5$/NC electrode was decomposed in an aqueous solution (0.5 M $Na_2SO_4$) to $Cu_2O$/NC at −0.5 $V_{RHE}$. The electrode was regenerated by oxidizing and restoring to $Cu_9S_5$ via an electrochemical regeneration process. For regeneration, the used electrode was treated for 1 hour at a constant potential of 0.1 $V_{RHE}$ in an aqueous solution containing 5 mM $Na_2S$ and 0.5 M $Na_2SO_4$. After completely washing the regenerated electrode with deionized (DI) water, NRR was measured at −0.5 to −0.7 $V_{RHE}$ as described above. After repeating $N_2$ reduction and electrochemical sulfurization processes several times, the produced $NH_3$ was quantified by the indophenol method.

Physical Properties

X-ray diffraction (XRD) patterns were obtained on Mini-Flex-2 (Rigaku) equipped with Cu Kα radiation (λ=1.5406 Å). Scanning electron microscopy (SEM) images were obtained using the Inspect F50 microscope with an acceleration voltage of 10 kV. TEM images were recorded using a transmission electron microscope (Talos F200X), and X-ray photoelectron spectroscopy (XPS) spectra were measured using the PHI VersaProbe system with a 100-W ALK α X-ray source.

Low-temperature nitrogen adsorption-desorption isotherms were measured at 77 K (−196° C.) using the volumetric adsorption analyzer BEL (BEL, Inc., Japan). Prior to the measurement, all the samples were deaerated at 173 K (100° C.) for 12 hours under a constant-volume condition in vacuo. Specific surface area was measured from the nitrogen adsorption isotherms by the Brunnauer-Emmet-Teller (BET) method in the relative pressure ($P/P_0$) range of 0.05-0.20. Pore size distribution (PSD) was measured by the Barrett-Joyner-Halenda (BJH) method. Total pore volume was determined at $P/P_0$ of 0.99. Temperature-programmed desorption (TPD) was performed on Micromeritics AutoChem II 2920 TPR/TPD.

Thermogravimetric analysis (TGA) was conducted on SDT Q600 (TA Instruments Inc., New Castle, De, USA).

$NH_3$ Detection

The concentration of the produced ammonia was measured by the indophenol blue method. First, 1 mL of a sample solution was added to an electrochemical cathode reactor. Then, 1 mL of a phenol solution (0.64 M $C_6H_5OH$, 0.38 M NaOH and 1.3 mM $C_5FEN_6Na_2O$) and 1 mL of a hypochlorite solution (55 mM NaOCl and 0.75 M NaOH) were added. After reaction at room temperature for 2 hours, the absorbance of the sample was analyzed at 900-350 nm by UV-vis spectroscopy. UV-Vis spectra were obtained using the Cary UV-vis 100 spectrophotometer (Agilent). Absorbance peaks at 633 nm were calibrated by subtracting the background absorbance measured at 875 nm. In the UV-Vis spectra, the background absorbance means the absorbance of the bulk electrolyte solution at 0 ppm ($NH_3$). In addition, the production of $NH_3$ was confirmed from the $^{14}N$ and $^{15}N$ spectra acquired by $^1H$ NMR (nuclear magnetic resonance) using Bruker Avance III HD 400 MHz.

$N_2H_4$ Detection

The quantity of the byproduct, $N_2H_4$, produced during the electrochemical $NH_3$ production was measured by the Watt and Chrisp method. A mixture of p-dimethylaminobenzaldehyde) (6 g), HCl (37%, 30 mL) and ethanol (300 mL) was used as an indicator. Measurement was performed after mixing 2 mL of an electrolyte and 2 mL of the indicator solution for 5 minutes. For measurement of the hydrazine, a standard curve was plotted from a series of $N_2H_4 \cdot H_2O$ solutions of different concentrations, diluted with 0.5 M $Na_2SO_4$. The absorbance of $N_2H_4$ was measured at 455 nm.

Calculation of Faradaic Efficiency (FE) and $NH_3$ Yield

Assuming that three electrons are required to produce one $NH_3$, FE is calculated as follows.

$$FE=(3F\times V\times C_{NH3})/(m_{NH3}\times Q)$$

In the above equation, F is the Faraday constant (96485 C $mol^{-1}$), V is the volume (mL) of an electrolyte, $C_{NH3}$ is the concentration (g/mL) of $NH_3$ determined 1 hour after CA for UV-Vis measurement, $m_{NH3}$ is the molar mass of $NH_3$ (17 g/mol), and Q is the total charge (C) accumulated for 1 hour during CA.

The $NH_3$ yield is calculated as follows.

(1) Production speed of $NH_3$ normalized to the mass of catalyst, $r_{mass}=(C_{NH3}\times V)/(m_{NH3}\times m_{Cat})$ (2) Production speed of $NH_3$ per time, normalized to geometrical area, $r_{area}=(C_{NH3}\times V)/(m_{NH3}\times A)$ In the above equations, $C_{NH3}$ is the concentration (g/mL) of determined 1 hour after CA for UV-Vis measurement, V is the volume (mL) of an electrolyte in the cathode chamber, $m_{NH3}$ is the molar mass of $NH_3$ (17 g/mol), $m_{Cat}$ is the mass (mg) of the cathode catalyst, and A is the geometrical area of the electrode (6.25 $cm^2$).

TEST EXAMPLES

Observation of Synthesized Catalyst

Figure 1B:
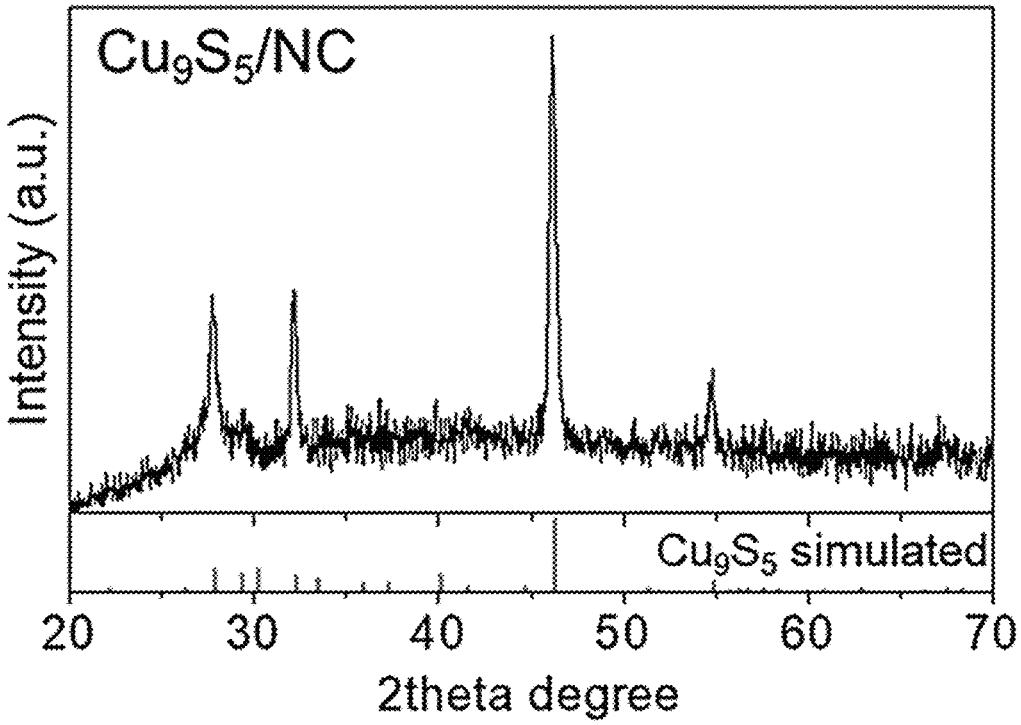
Figure 1C:
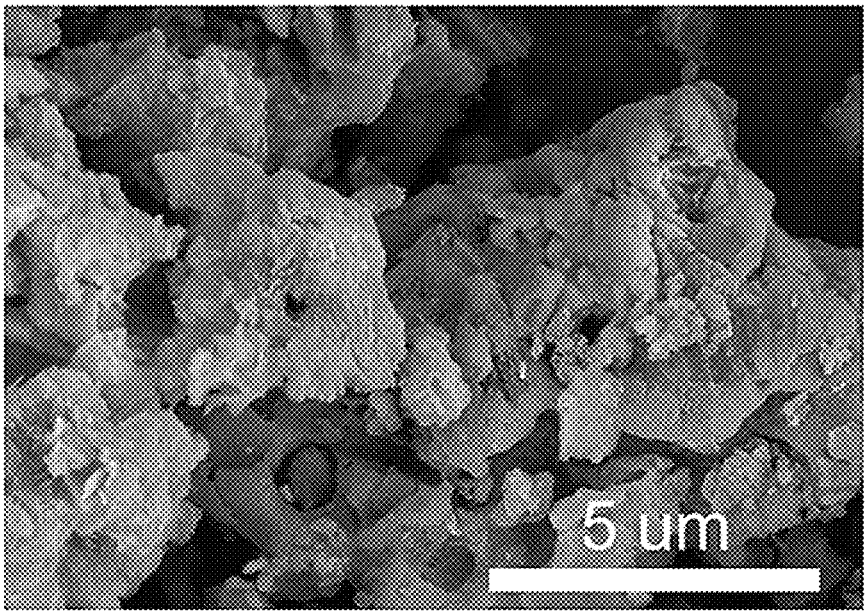
Figure 1D:
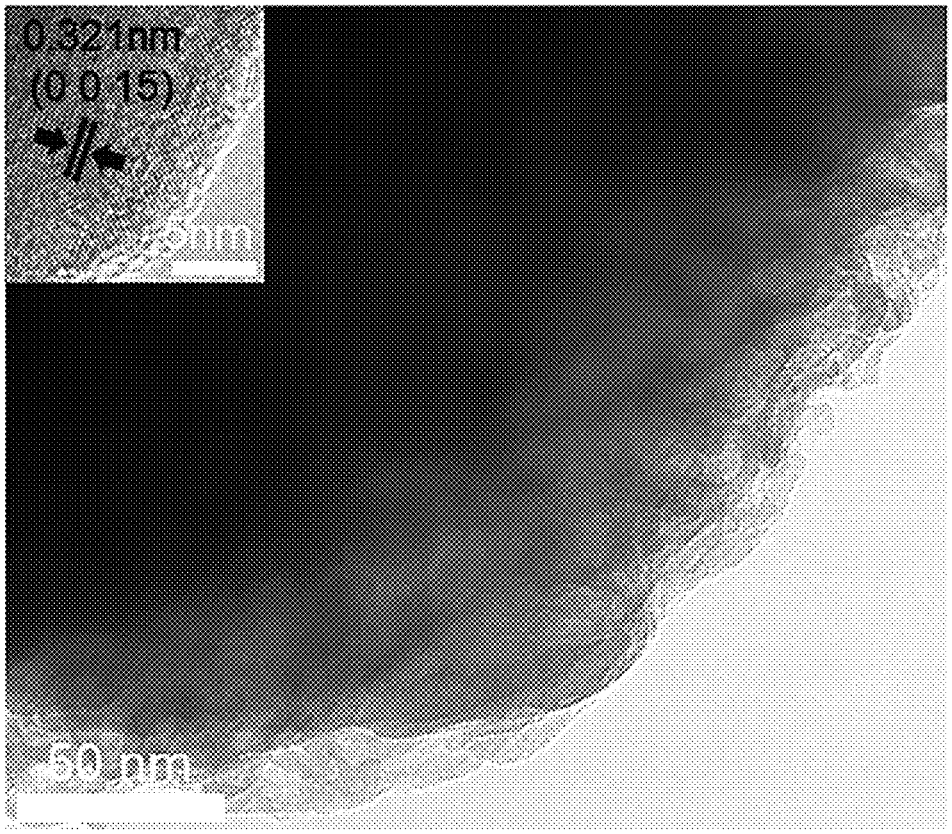
Figure 6A:
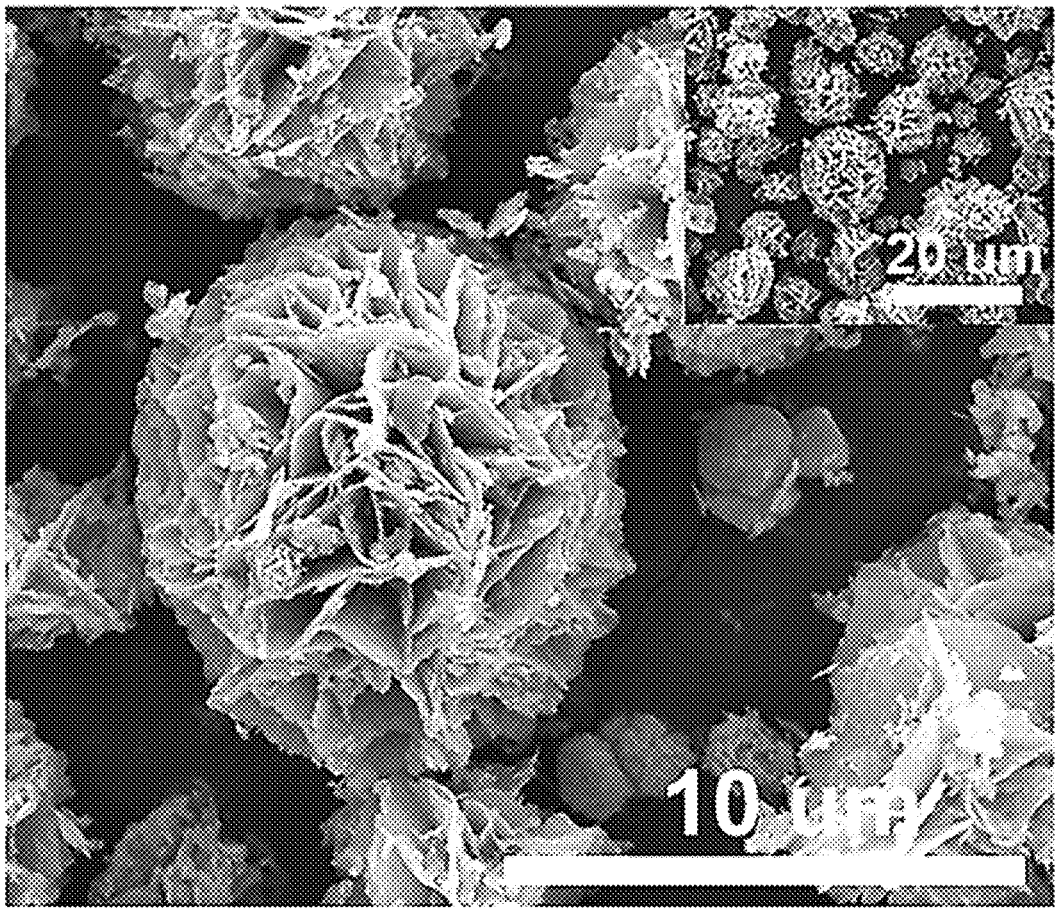
FIGS. 6A-6B show the SEM (6A) and XRD pattern (6B) of a $Cu_9S_5$ catalyst synthesized by a hydrothermal method.
Figure 6B:
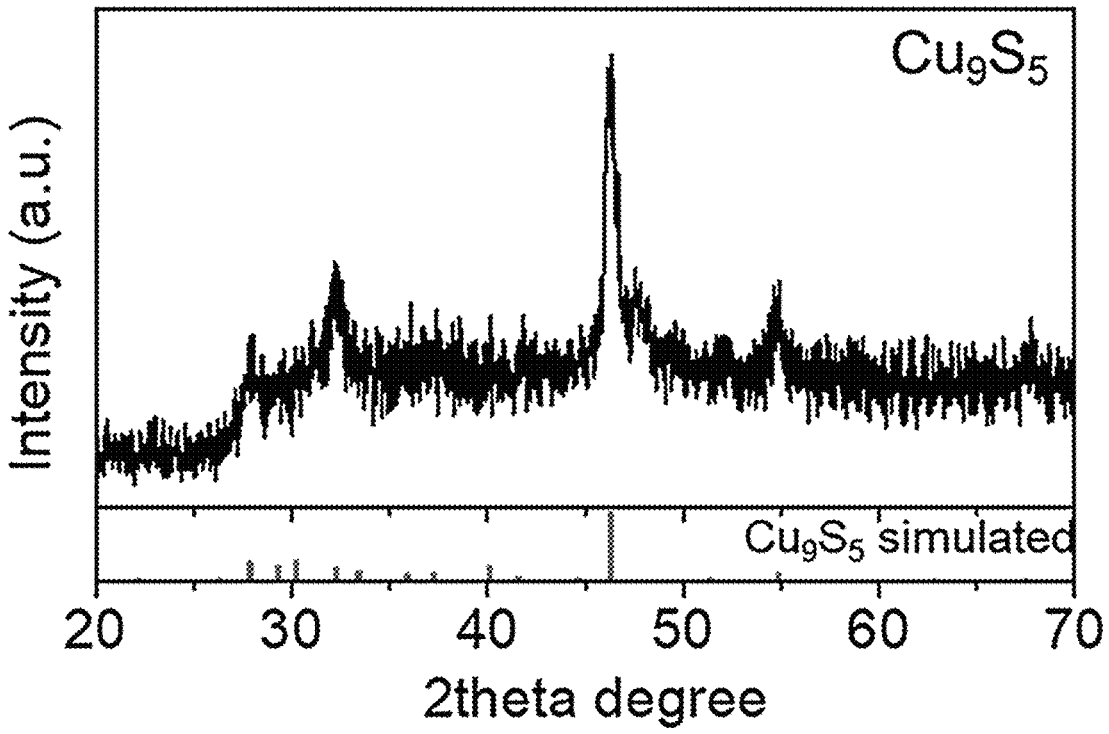
Figure 7A:
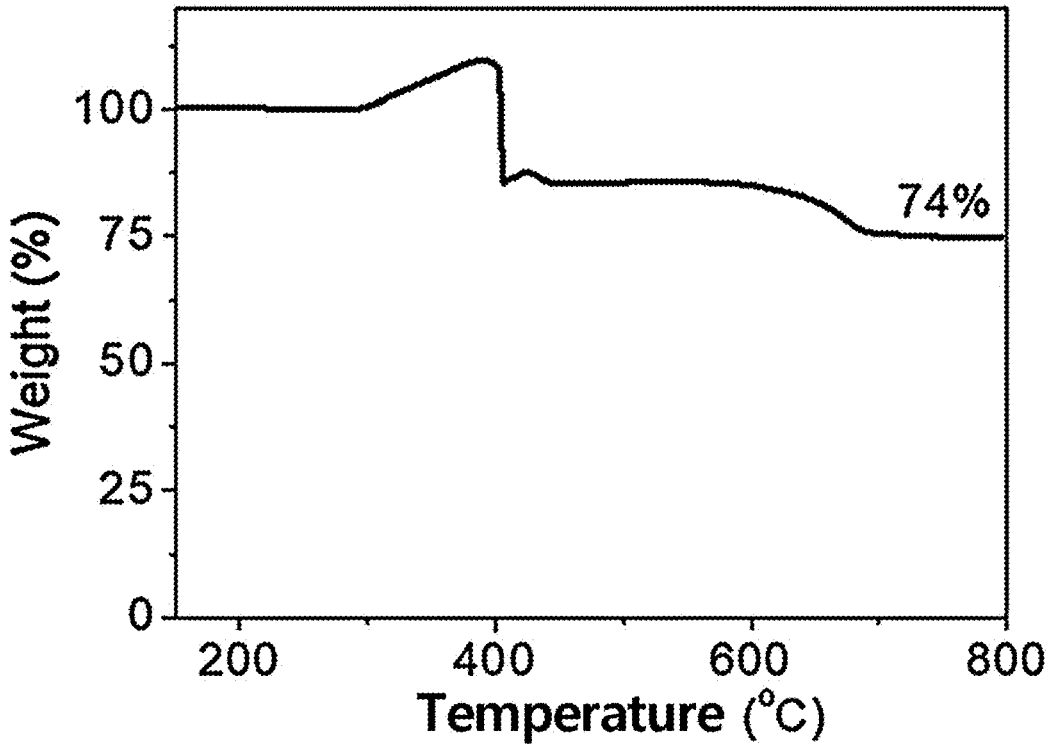
FIGS. 7A-7C show a TGA result of $Cu_9S_5$/NC (7A), $N_2$ adsorption isotherms of $Cu_9S_5$/NC and $Cu_9S_5$ (7B), and BJH plots of $Cu_9S_5$/NC and $Cu_9S_5$ (7C).

The XRD pattern of the prepared catalyst is shown in FIG. 1B. The XRD peaks of $Cu_9S_5$/NC were observed at 2θ=27.8°, 29.5°, 32.2°, 37.6°, 42.0°, 5.3°, 48.8° and 54.7°, which correspond to the (0015), (107), (1010), (0114), (0117), (0120), (119) and (1115) planes, respectively, of hexagonal-phase $Cu_9S_5$ (JCPDS No. 26-0476, FIG. 1B). The morphology of the sample was observed by SEM and TEM (FIGS. 1C-1D). A chunk with no uniform shape can be seen from FIG. 1C. The size of the $Cu_9S_5$/NC composite was confirmed to be 1-5 μm from the SEM image. The structure of the $Cu_9S_5$/NC composite can be confirmed from the TEM image. The HR-TEM lattice image of $Cu_9S_5$/NC shows 0.321-nm lattice fringes corresponding to the (0015) plane of $Cu_9S_5$ and carbon materials attached to $Cu_9S_5$ (FIG. 1D). The NC-free $Cu_9S_5$ sample shows a flower-like morphology along with sheet-like plates with a size of 5-10 μm (FIG. 6A). However, the crystal structure was not affected by the presence of NC as can be seen from the XRD pattern (hexagonal $Cu_9S_5$, JCPDS No. 26-0476, FIG. 6B). The proportion of the active site of the $Cu_9S_5$/NC catalyst, i.e., the mass ratio of $Cu_9S_5$, was 74% as estimated from the TGA analysis (FIG. 7A).

Figure 1E:
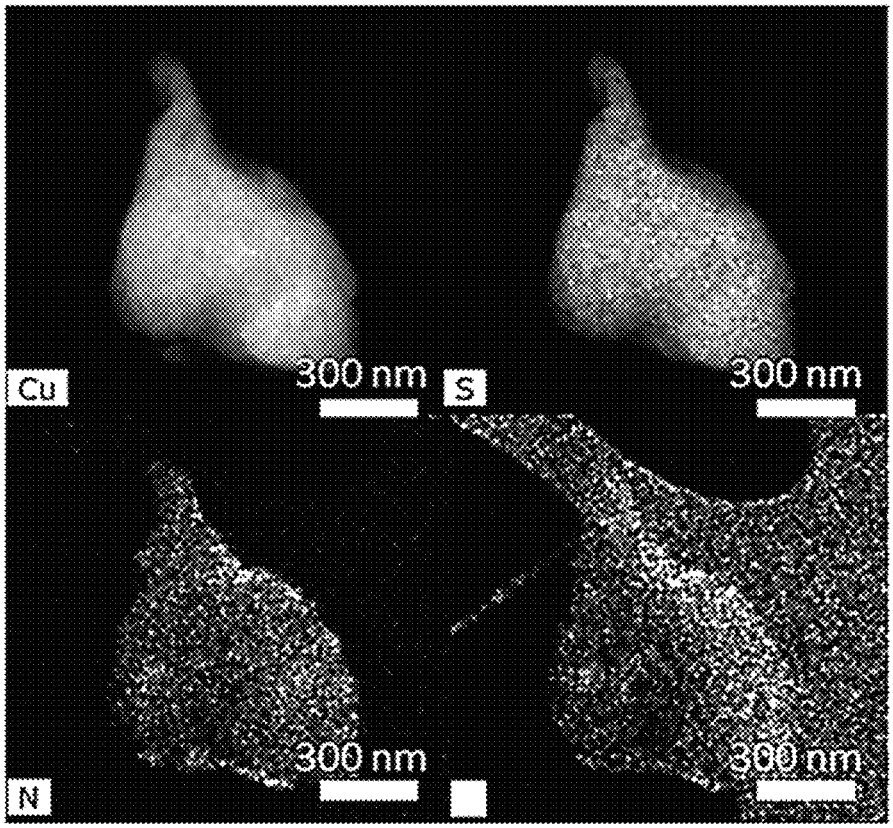
Figure 2A:
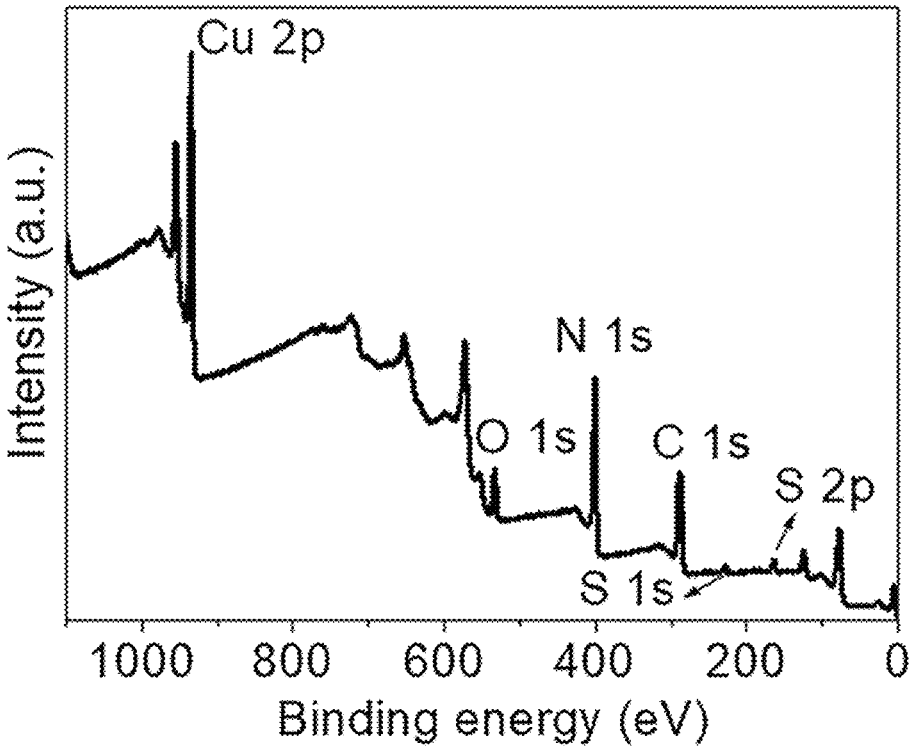
FIGS. 2A-2D show a survey scan of $Cu_9S_5$/NC (2A) and high-resolution XPS results of Cu 2p (2B), S 2p (2C) and N 1s (2D) of $Cu_9S_5$/NC.
Figure 2B:
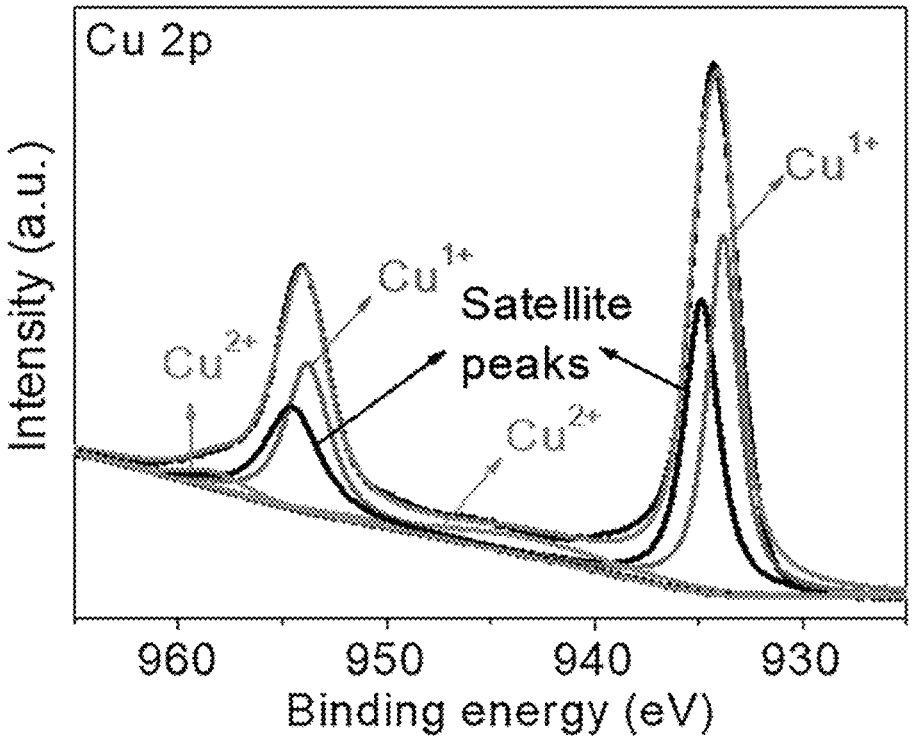
Figure 2C:
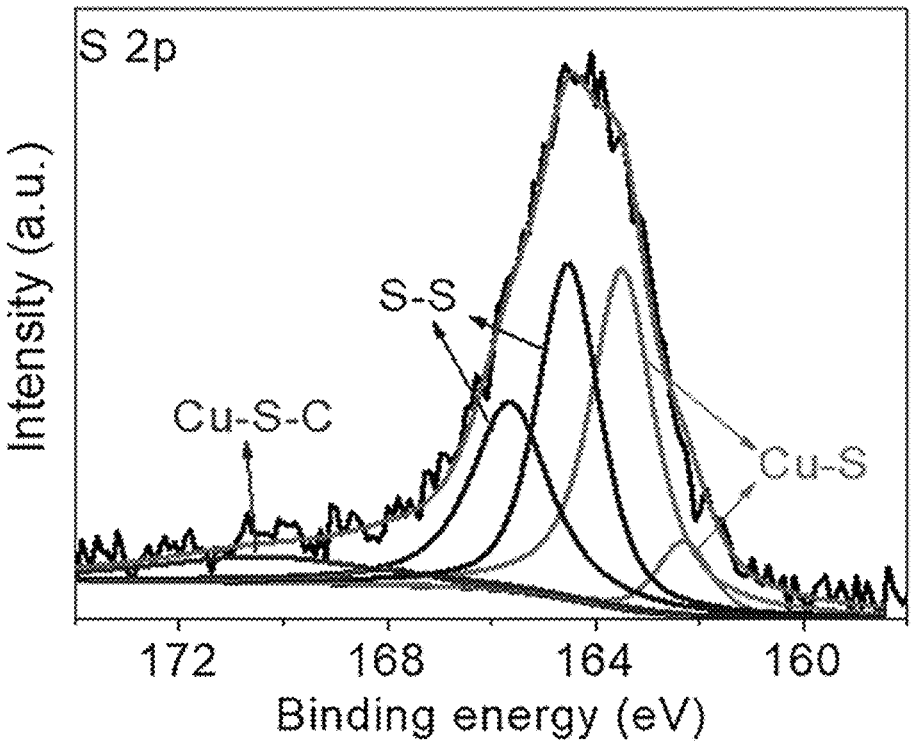
Figure 2D:
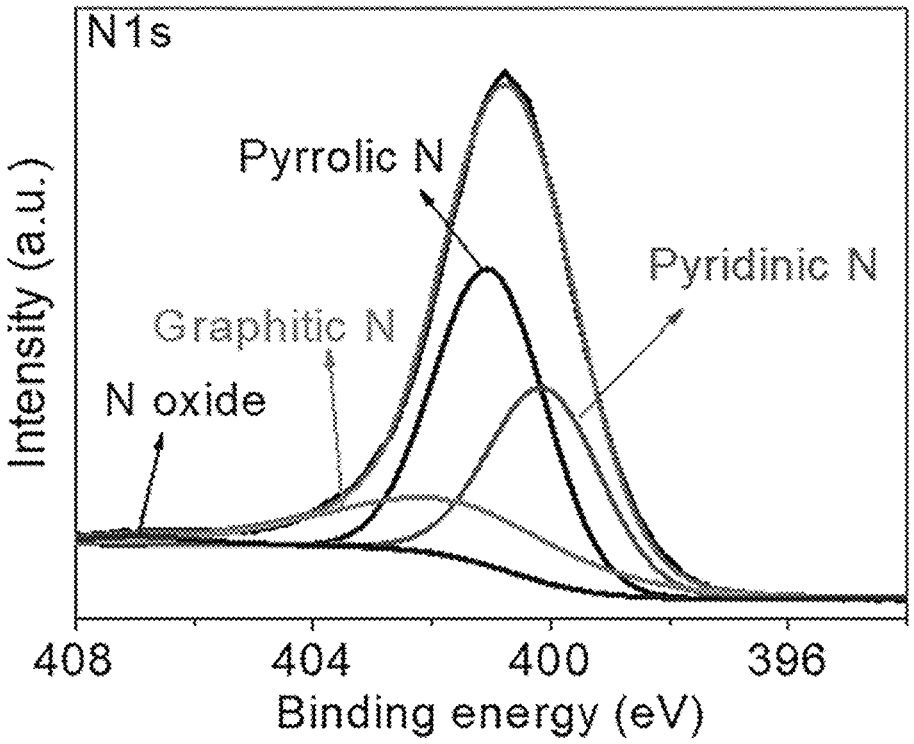

As a result of energy-dispersive X-ray spectroscopy (EDX) mapping, it was confirmed that Cu, S, C and N were distribute uniformly throughout the entire structure of the $Cu_9S_5$/NC catalyst (FIG. 1E). The XPS survey spectrum confirms the presence of Cu, S, C and N in the composite and is consistent well with the EDX mapping result (FIG. 2A). The Cu 2p spectra show two main peaks at 933.9 and 953.8 eV, which correspond to Cu and $Cu^{1+}$ of $Cu_9S_5$/NC, respectively. A pair of weak peaks at 943.7 and 958.4 eV correspond to Cu and $Cu^{2+}$ of $Cu_9S_5$/NC, respectively. The remaining peaks (at 934.9 and 954.7 eV) are satellite peaks of Cu (FIG. 2B). In the high-resolution S 2p spectra of FIG. 2C, the peaks at 162.3, 163.5, 164.6, 165.7 and 170.3 eV reveal the presence of the covalent bonds Cu—S (162.3, 163.5 eV), S—S (164.6, 165.7 eV) and Cu—S—C (170.3 eV). The high-resolution N 1s spectra are shown in FIG. 2D. The four peaks at 400.1, 401.1, 402 and 406.7 eV correspond to pyridinic N, pyrrolic N, quaternary N and N oxide, respectively.

Figure 7B:
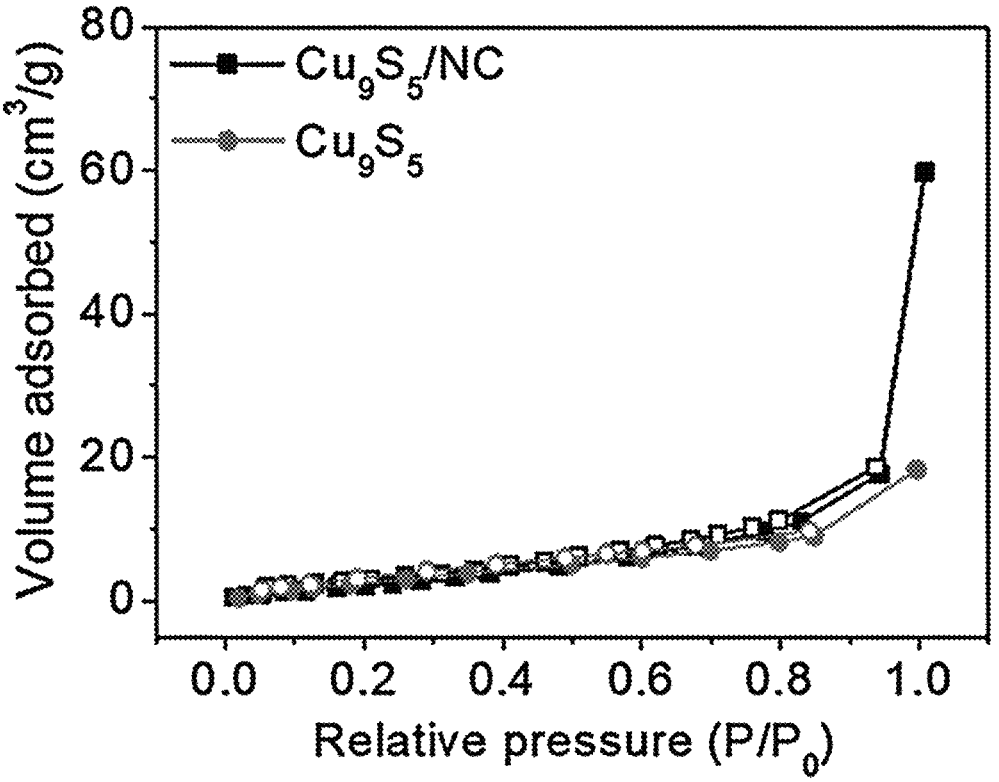

The conductive support, i.e., NC, was used in $Cu_9S_5$/NC to improve the active surface area of the catalyst. For characterization of the catalyst, the textural property of $Cu_9S_5$/NC and $Cu_9S_5$ was investigated by $N_2$ adsorption analysis. From the $N_2$ adsorption-desorption isotherms, the specific surface area (SSA) and total pore volume of $Cu_9S_5$/NC and $Cu_9S_5$ were determined to be 12 $m^2g^{-1}$ and 0.084 $cm^3g^{-1}$, and 8 $m^2g^{-1}$ and 0.051 $cm^3g^{-1}$, respectively (FIGS. 7B and 7C).

Figure 7C:
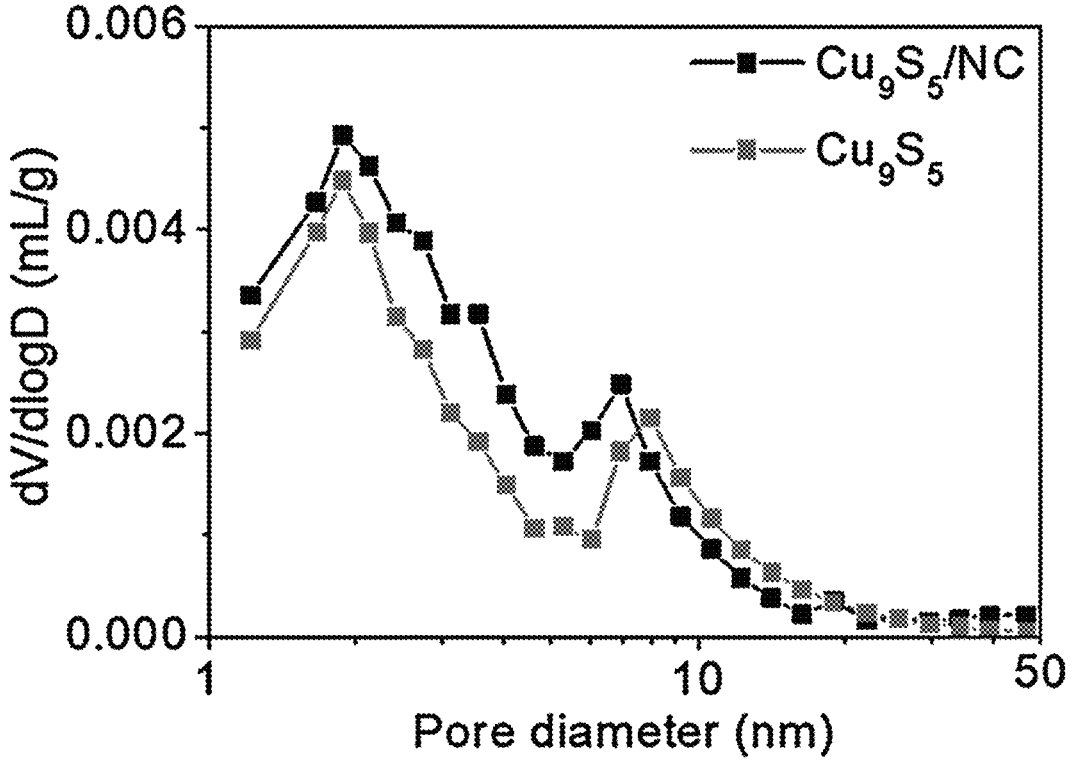

As expected, the BJH plots revealed that $Cu_9S_5$/NC had mesoporosity with a size 2-8 nm larger than $Cu_9S_5$ (FIG. 7C). Accordingly, it is expected that the larger surface area and porous structure of $Cu_9S_5$/NC will provide more exposed active sites for a NRR electrocatalyst as compared to the unsupported $Cu_9S_5$ (FIG. 7C).

Electrochemical NRR Activity

Figure 3A:
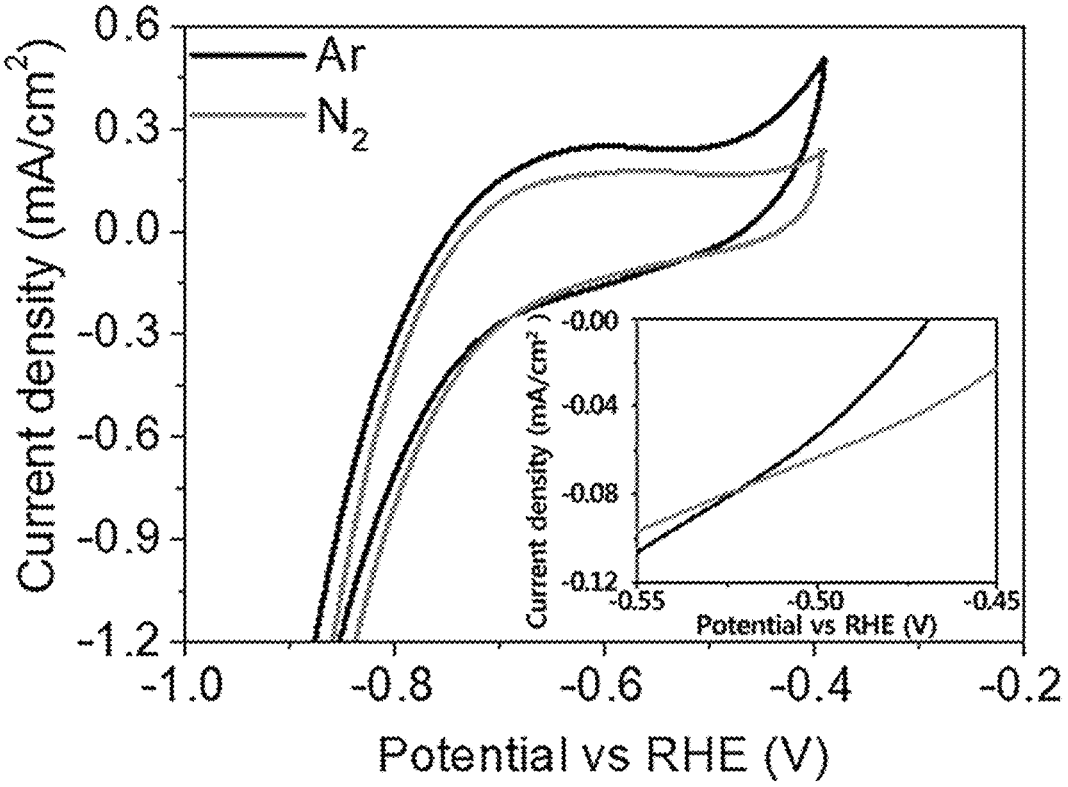
FIGS. 3A-3F show CV curves of $Cu_9S_5$/NC under Ar- and $N_2$-saturated conditions (3A), $NH_3$ yield and FE (%) of a $Cu_9S_5$/NC catalyst at different potentials (−0.4V to −0.8V vs RHE) (3B), a chronoamperometric curve $Cu_9S_5$/NC at −0.5 V for 16 hours (3C), XRD spectra of a $Cu_9S_5$/NC catalyst 1 hour after CA at −0.5 V in a $N_2$-saturated electrolyte solution (3D), chronoamperometric curves of $Cu_9S_5$/NC at −0.5 V under Ar- or $N_2$-saturated atmosphere (3E), and an XRD result of a $Cu_9S_5$/NC catalyst after HER at −0.5 V in an Ar-saturated electrolyte solution (3F).
Figure 3B:
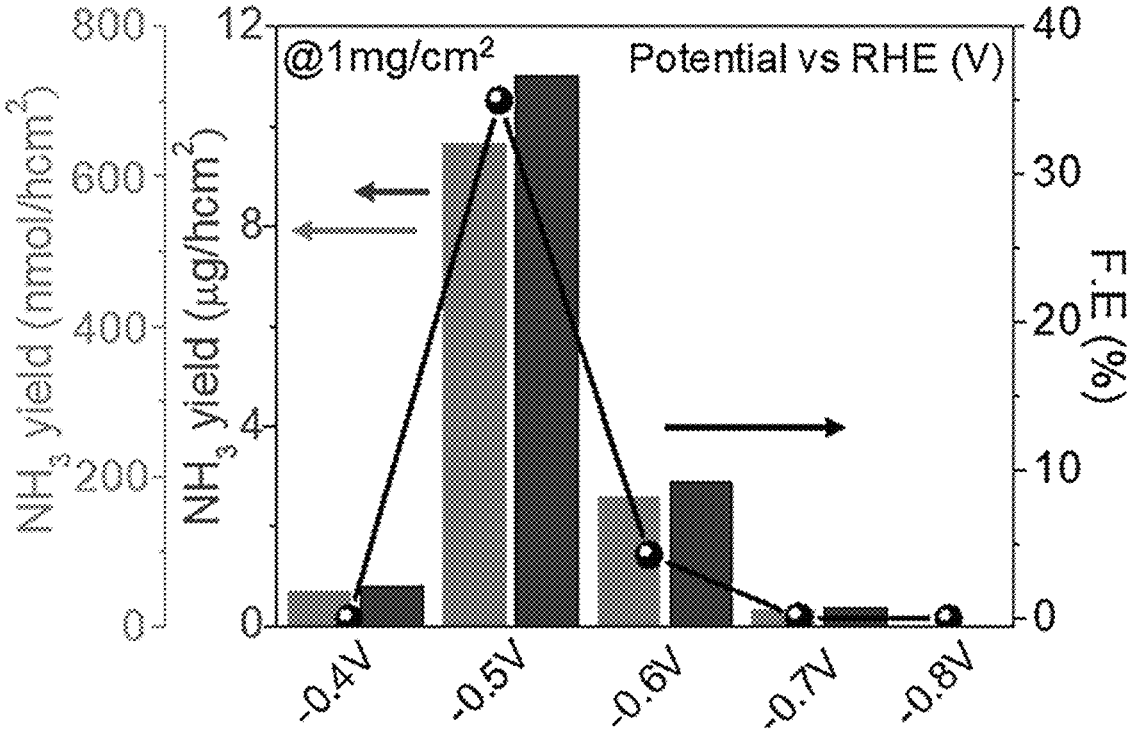

The NRR performance of $Cu_9S_5$/NC was investigated in a $N_2$-saturated 0.5 M $Na_2SO_4$ electrolyte using a H-cell under an ambient condition (FIG. 3A). In CV analysis, the current density of $N_2$-saturated electrolyte solution did not show distinct difference from that observed in an Ar-saturated solution. Whereas it is difficult to find a unique peak current or onset potential for NRR, the onset potential for hydrogen evolution reaction (HER) is clearly detected at about −0.7 $V_{RHE}$ under $N_2$ and Ar atmosphere. Instead, the NRR activity of $Cu_9S_5$/NC can be estimated only from the amount of $NH_3$ detected in the electrolyte solution after CA for 1 hour at different potentials (FIG. 3B). However, the current observed in CV and CA was changed with time, as can be seen from the changed double layer charging current in the continuous CV cycles (FIG. 3A). This is mainly due to the change in $Cu_9S_5$ composition under the electrochemical reaction condition (FIG. 4B). If the catalyst is unstable and the NRR activity is limited when compared with HER or degradation current, it is difficult to estimate NRR activity from CV. Accordingly, a longer time period was used in order to investigate the NRR activity and FE of $Cu_9S_5$/NC from CA at different potentials.

Figure 8A:
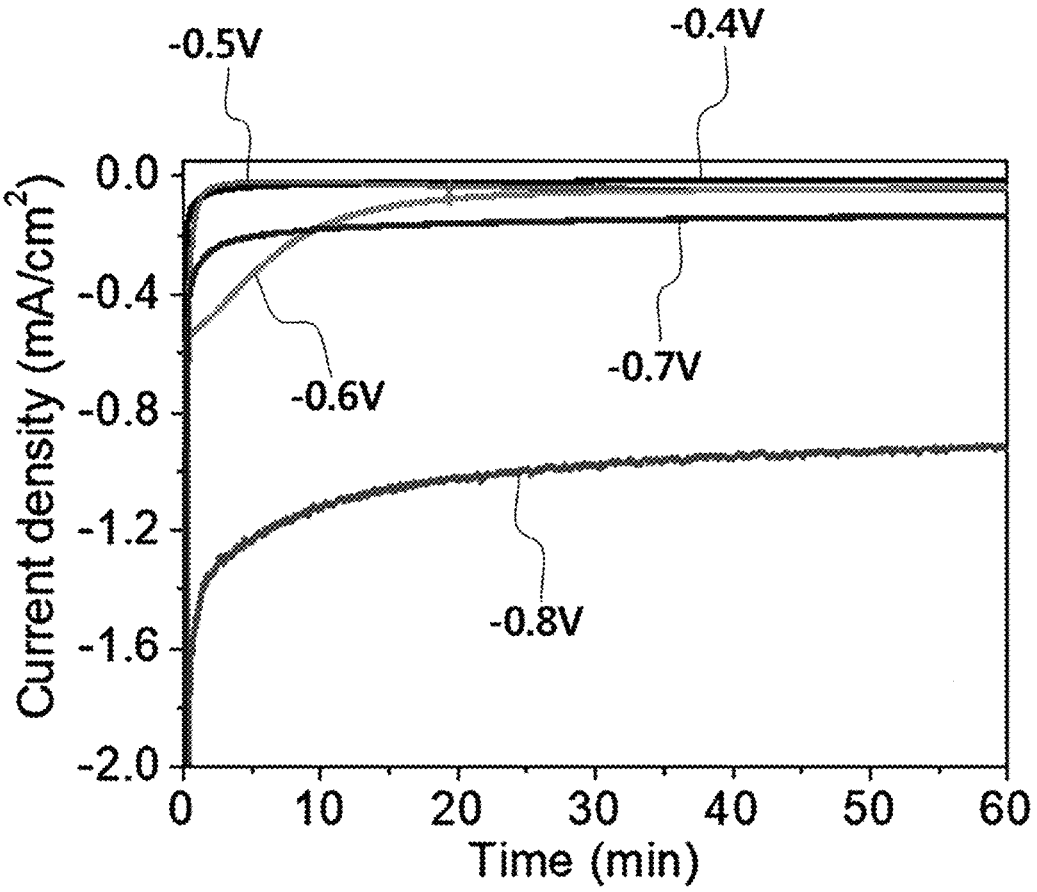
FIGS. 8A-8B show chronoamperometric curves of $Cu_9S_5$/NC at −0.4 to −0.8 $V_{RHE}$ (8A), and a result of UV-Vis spectroscopy in a 0.5 M electrolyte after NRR test at −0.4 to −0.8 $V_{RHE}$ (measurement was made by changing potential from −0.4 V to −0.8 V with a step size of 0.1 V) for 1 hour (8B).
Figure 8B:
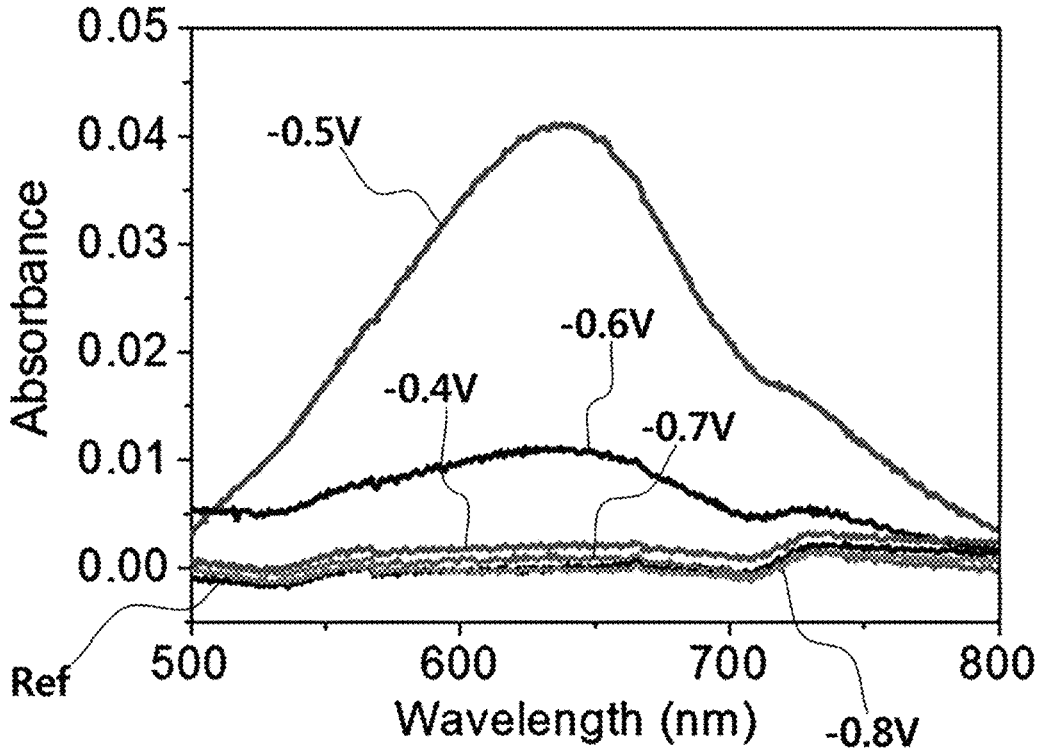
Figure 9A:
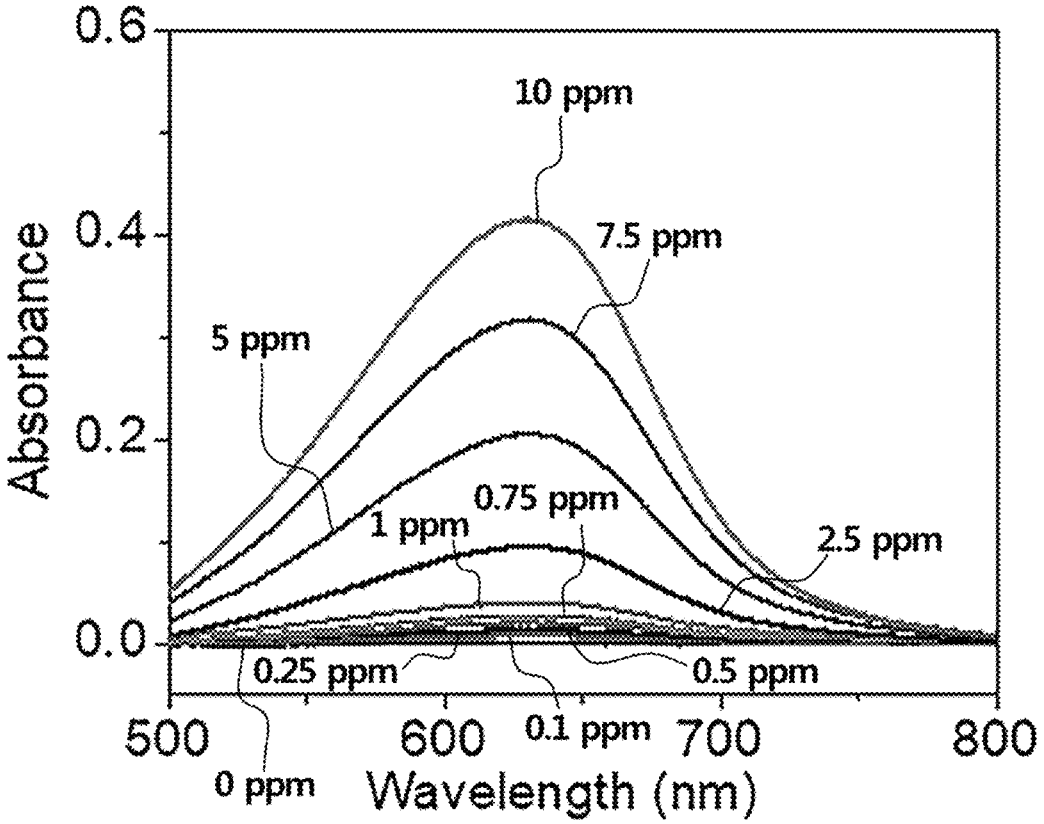
FIGS. 9A-9C show a result of quantifying $NH_3$ using a $NH_4Cl$ solution with a known concentration (ppm): (9A) UV-Vis spectra, (9B) calibration curve, (9C) images of solutions with increasing ammonia concentrations treated with the indophenol blue indicator.
Figure 9B:
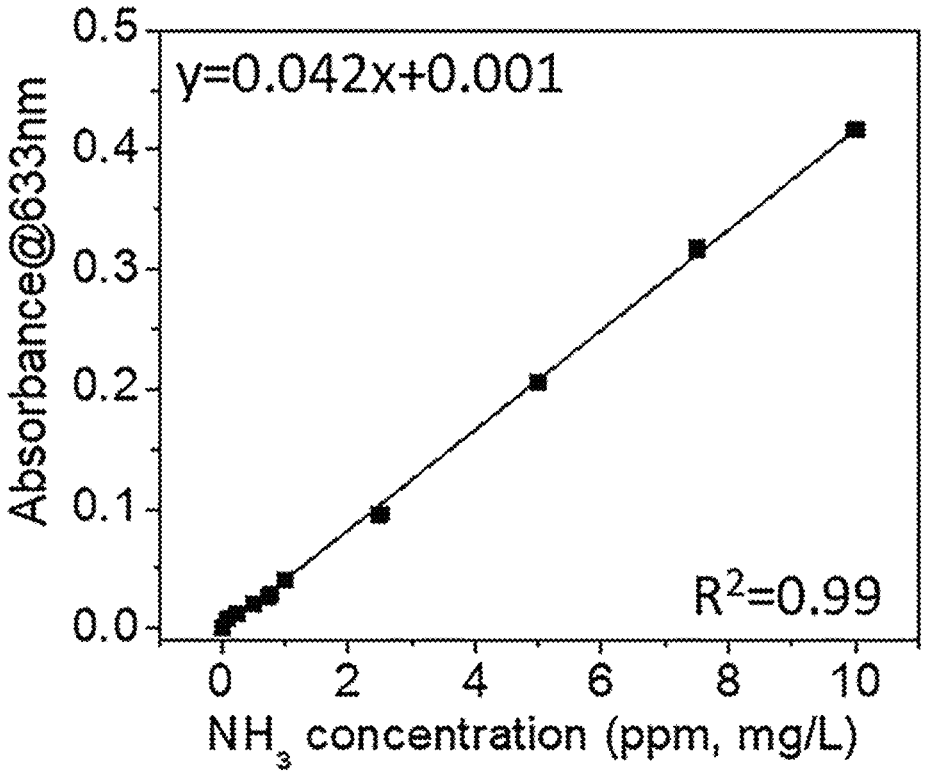
Figure 9C:
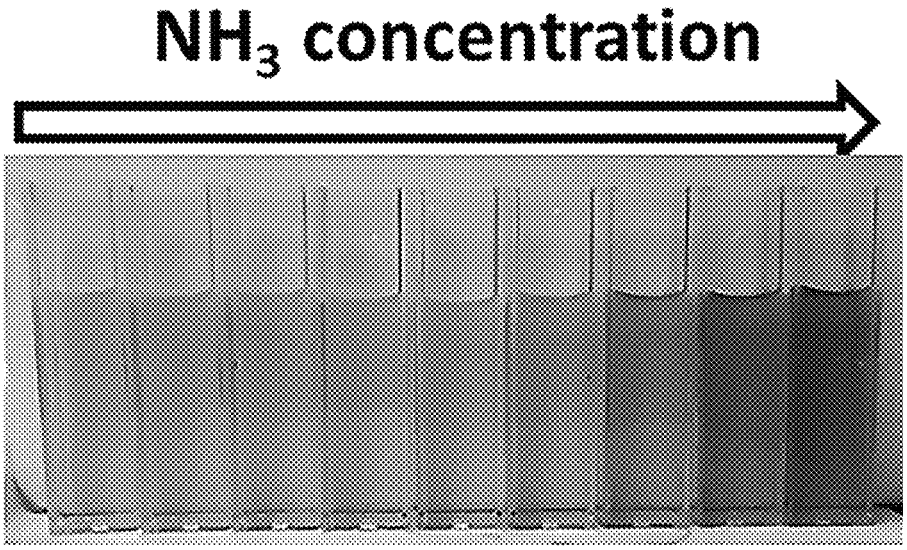

In order to measure the NRR activity of the $Cu_9S_5$/NC and $Cu_9S_5$ catalysts, chronoamperometry (CA) was conducted in a $N_2$-saturated 0.5 M $Na_2SO_4$ electrolyte at different potentials in the range from −0.4 to −0.8 $V_{RHE}$ (FIG. 3B and FIG. 8). The UV-Vis spectra of an indophenol blue solution prepared from the electrolyte solution after the CA experiment are shown in FIG. 9. $NH_3$ yield was calculated from absorption at 633 nm after subtracting background absorption from a blank solution and comparing with a standard calibration curve (FIG. 9). For the $Cu_9S_5$/NC surface, the $NH_3$ production yield reached 11 μg/$hcm^2$ (or 645 nmol/$hcm^2$) at −0.5 $V_{RHE}$ (FIG. 3B). The maximum $NH_3$ production yield corresponded to a current density of 52 μA/$cm^2$, which is 35% (FE) of total average current density measured at −0.5 $V_{RHE}$. The NRR performance of $Cu_9S_5$/NC was similar to the highest performance of NRR catalysts reported in previous literatures (see Table 1).

TABLE 1

Comparison of NRR performance of various samples with previously known data

| Sample | Electrolyte | FE (%) | $NH_3$ yield (μg/$hmg_{cat}$) | $NH_3$ yield (nmol/$hcm^2$) | Reference |
|---|---|---|---|---|---|
| $Cu_9S_5$/NC | 0.5M $Na_2SO_4$ | 35 | 11.0 11.0 μg/$hcm^2$ | 645 | The present disclosure |
| $Fe_{SA}$-N-C | 0.1M KOH | 56.55 | 7.48 | — | Non-patent document 1 |
| $SnO_2$/RGO | 0.1M $Na_2SO_4$ | 7.1 | 25.6 | — | Non-patent document 2 |
| $Mo_2C$/C | 0.5M $Li_2SO_4$ | 7.8 | 11.3 | — | Non-patent document 3 |
| γ-$Fe_2O_3$ | 0.1M KOH | 1.96 | — | 44 | Non-patent document 4 |
| Au-Ni | 0.05M $H_2SO_4$ | 67.8 | 7.4 | — | Non-patent document 5 |
| a-Au/CeOx-RGO | 0.1M HCl | 8.3 | 10.1 | — | Non-patent document 6 |
| ISAS-Fe/NC | 0.1M PBS | 18.6 | 62.9 | — | Non-patent document 7 |
| BiNCs/CB/GC | 0.5M $K_2SO_4$ | 67 | — | $6.2 \times 10^{-3}$ (mmol/$hcm^2$) | Non-patent document 8 |
| CoSx/NS-G | 0.05M $H_2SO_4$ | 25.9 | 25 | — | Non-patent document 9 |
| N,B-FC | 0.1M HCl | 10.6 | 16.4 | — | Non-patent document 10 |
| Au NRs | 0.1M KOH | 4.02 | 1.65 | — | Non-patent document 11 |
| NPC | 0.1M HCl | 4.2 | 0.97 | — | Non-patent document 12 |
| SACs-$MoS_2$-Fe-2.0 | 0.1M KOH | 31.6 | 91.5 (μg/$hcm^2$) | — | Non-patent document 13 |
| Ru SAs/N-C | 0.05M $H_2SO_4$ | 29.6 | 120.9 | — | Non-patent document 14 |

Figure 10:
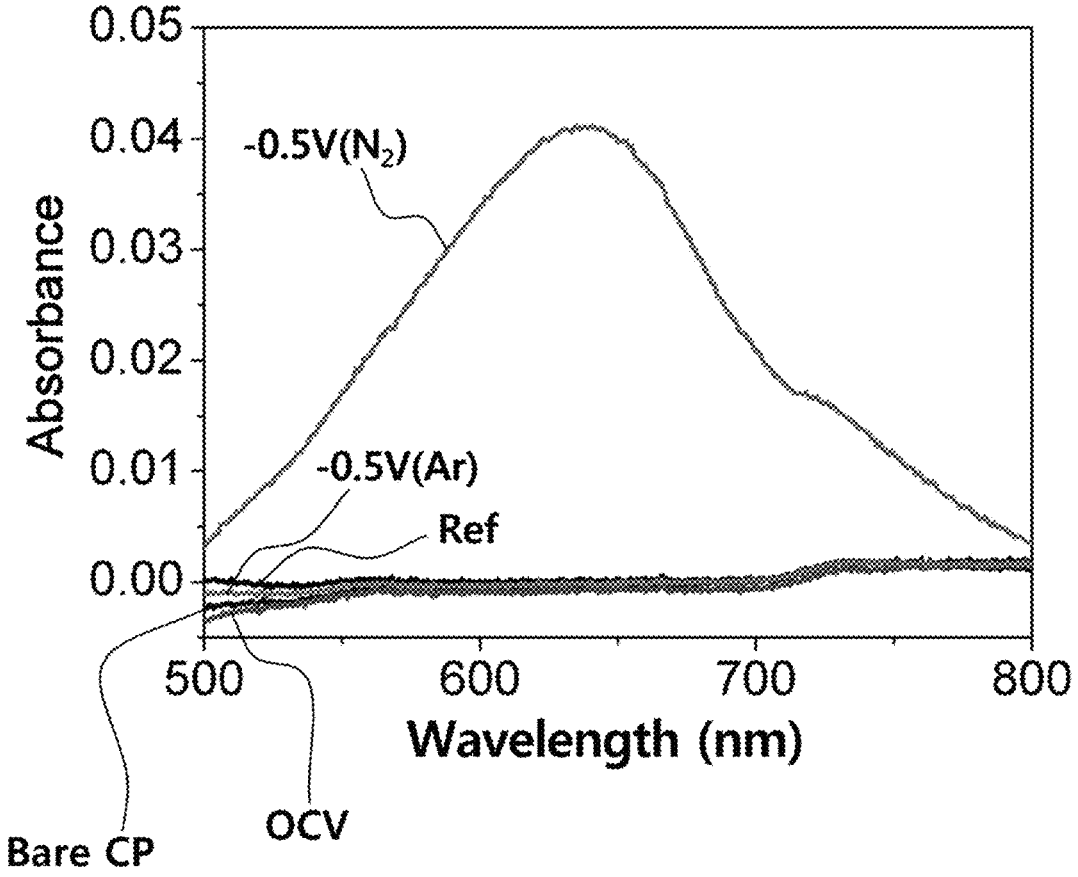
FIG. 10 shows the UV-Vis absorption spectra of bare CP, OCV, $N_2$ and Ar when treated with a $Cu_9S_5$/NC catalyst and an indophenol indicator at −0.5 $V_{RHE}$ for 1 hour.
Figure 11:
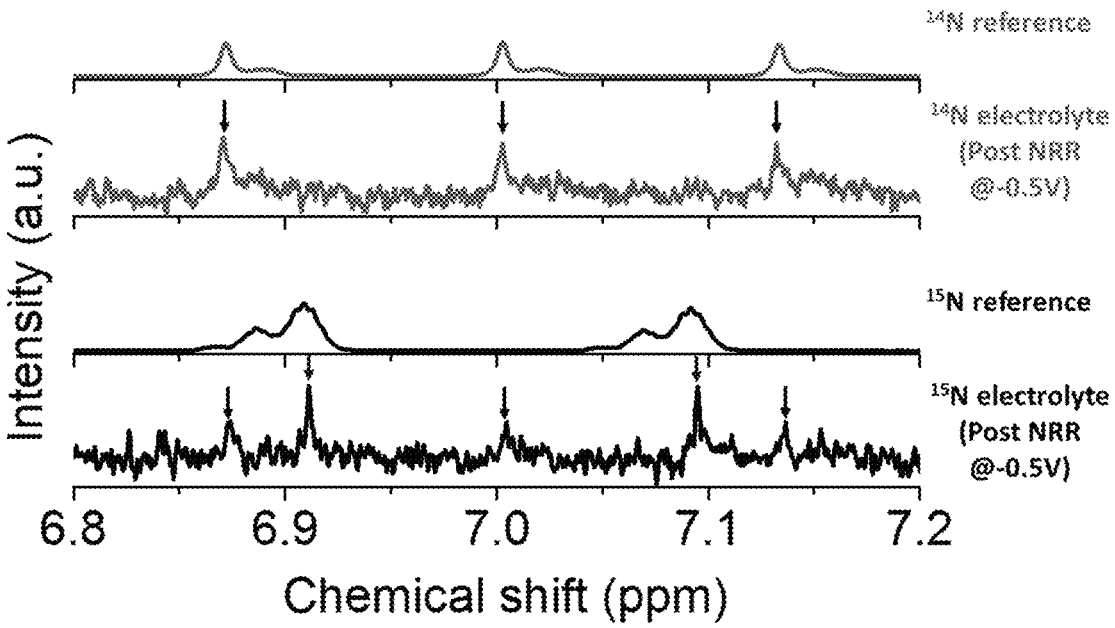
FIG. 11 shows the $^1H$ ($^{14}N$ and $^{15}N$) NMR spectra of an electrolyte after NRR at −0.5 $V_{RHE}$.
Figure 12A:
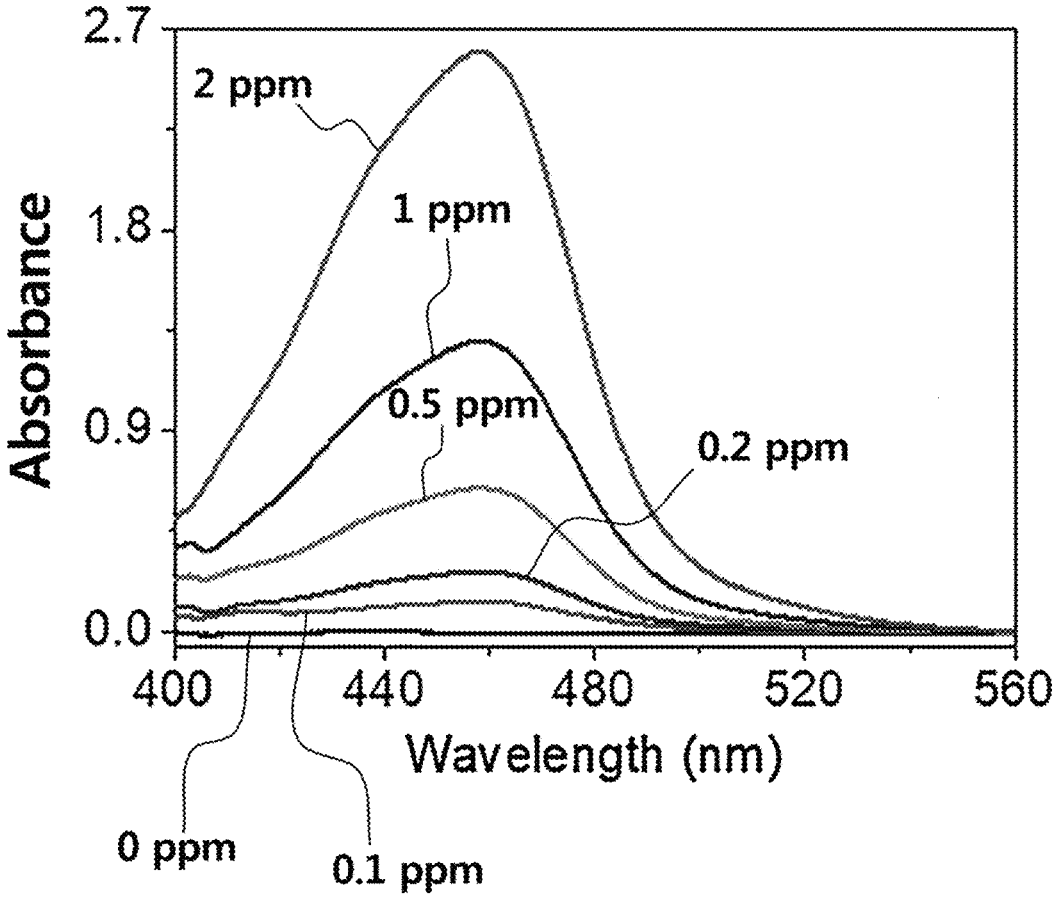
FIGS. 12A-12D show a result of quantifying $N_2H_4$ using a solution with a known concentration (ppm): (12A) UV-Vis spectra, (12B) calibration curve, (12C) images of solutions with increasing ammonia concentrations subjected to the Watt and Chrisp method, (12D) UV-Vis absorption spectra of an electrolyte evaluated at −0.4 to −0.7 $V_{RHE}$ for 1 hour by the Watt and Chrisp method.
Figure 12B:
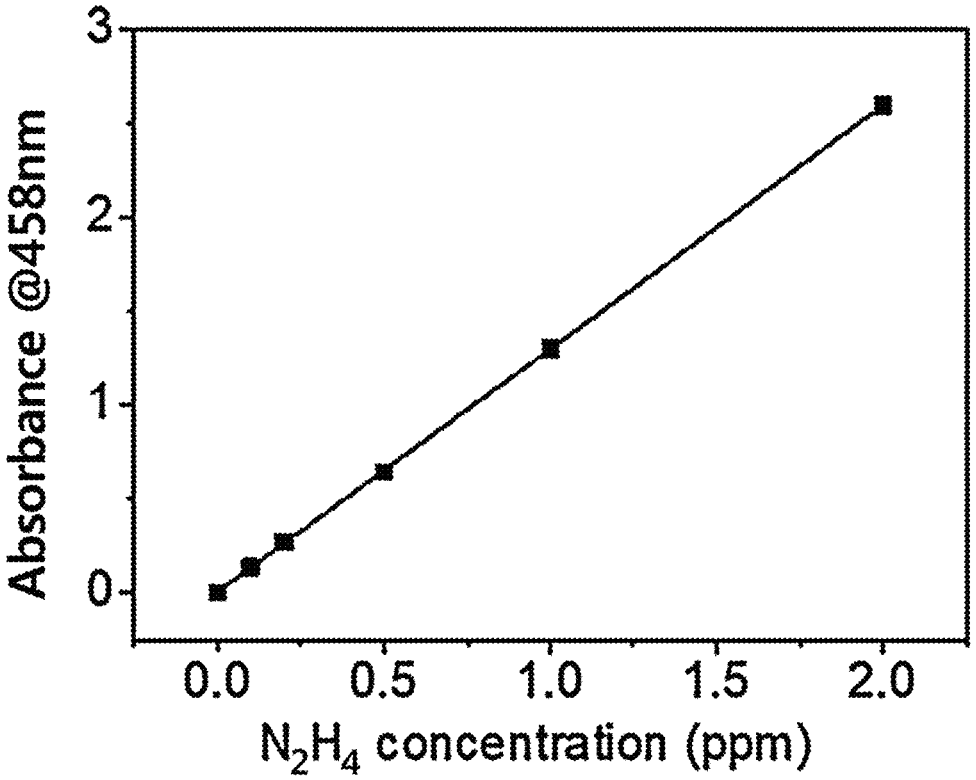
Figure 12C:
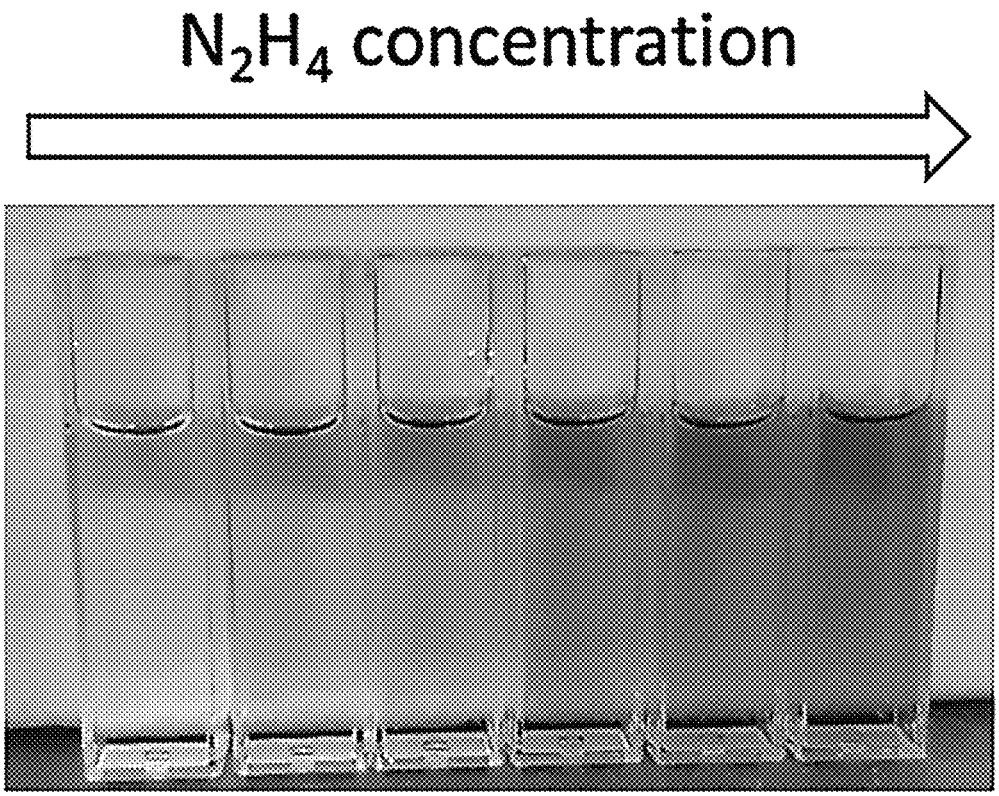
Figure 12D:
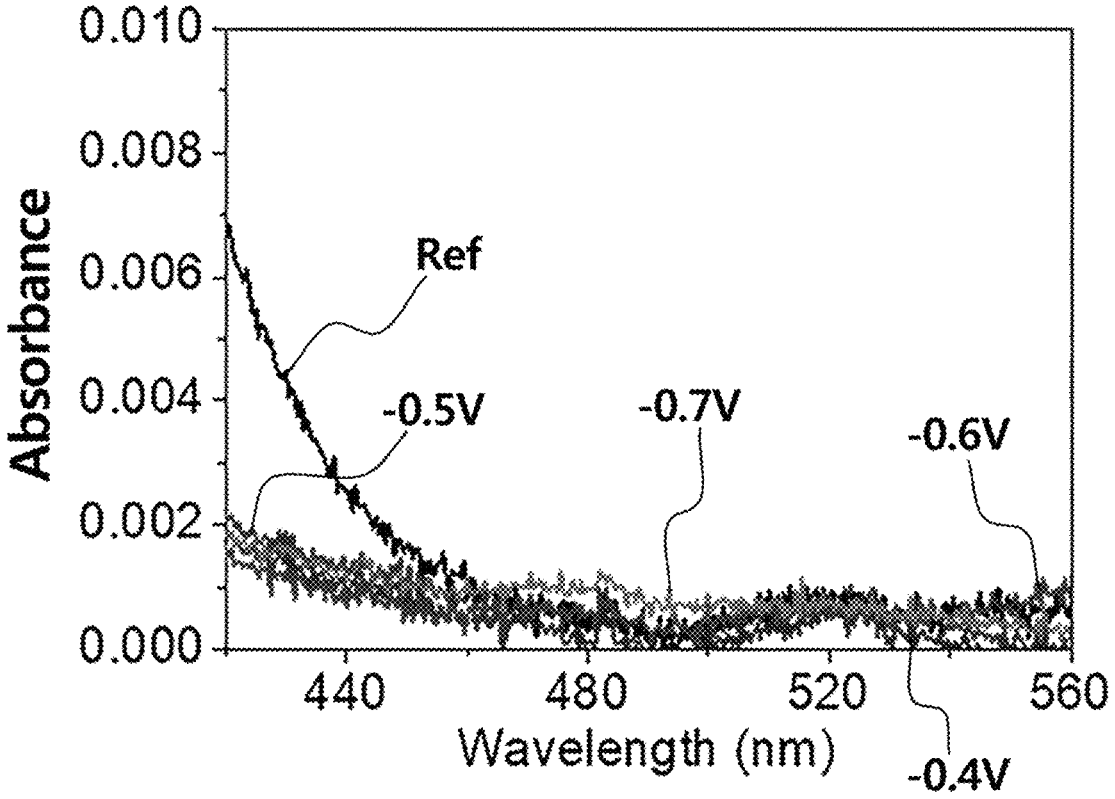
Figure 13A:
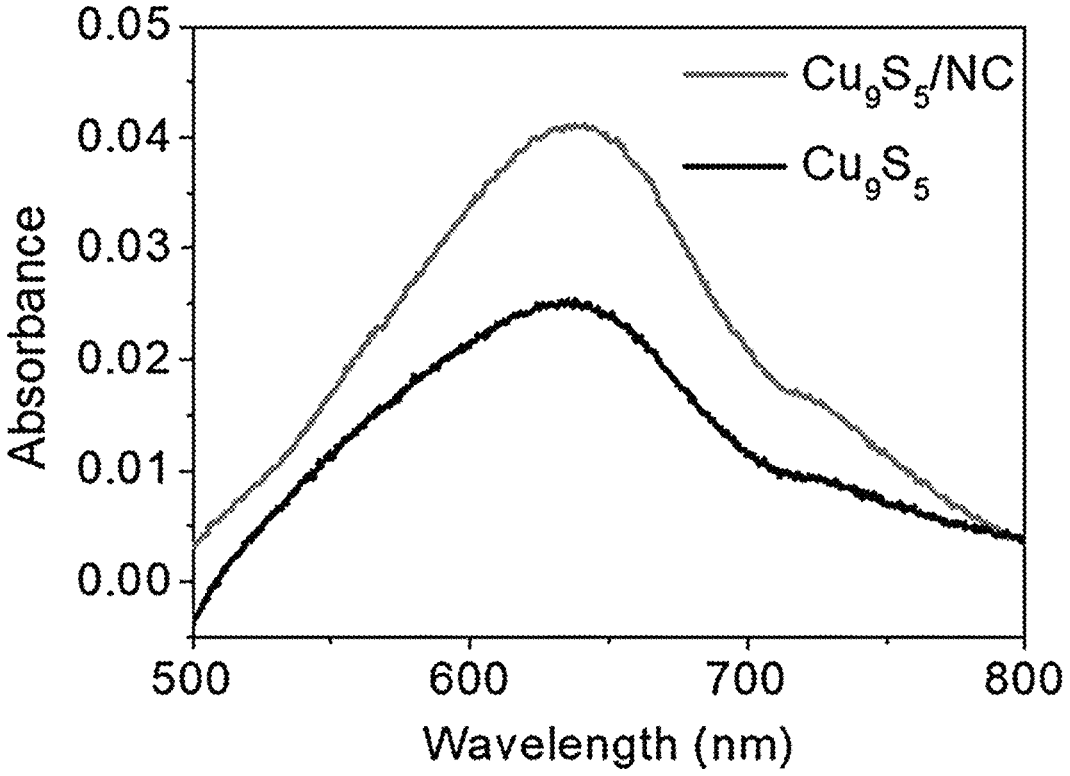
FIGS. 13A-13B show the UV-Vis absorption spectra of $Cu_9S_5$/NC and $Cu_9S_5$ at −0.5 $V_{RHE}$ for 1 hour (13A), and chronoamperometric curve of $Cu_9S_5$ at −0.5 $V_{RHE}$ (13B).
Figure 13B:
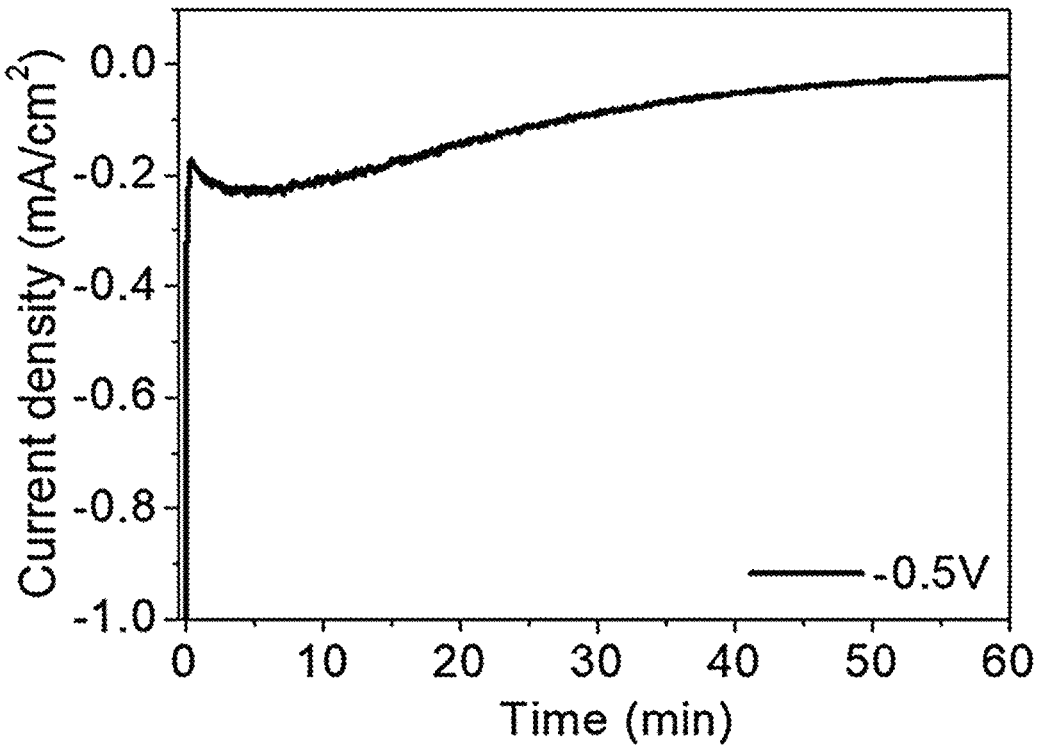
Figure 14A:
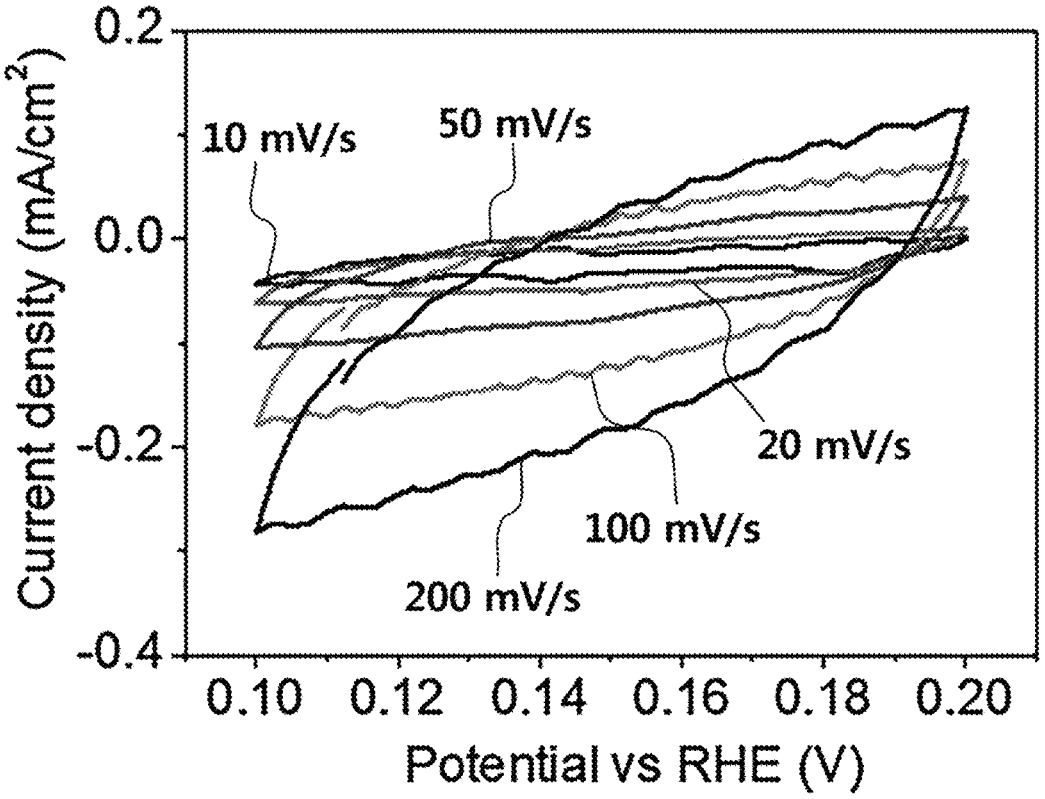
FIGS. 14A-14B show the CV curves of $Cu_9S_5$ (14A) and $Cu_9S_5$/NC (14B) in the non-faradaic capacitance at a scan rate of 10-200 mV/s.
Figure 14B:
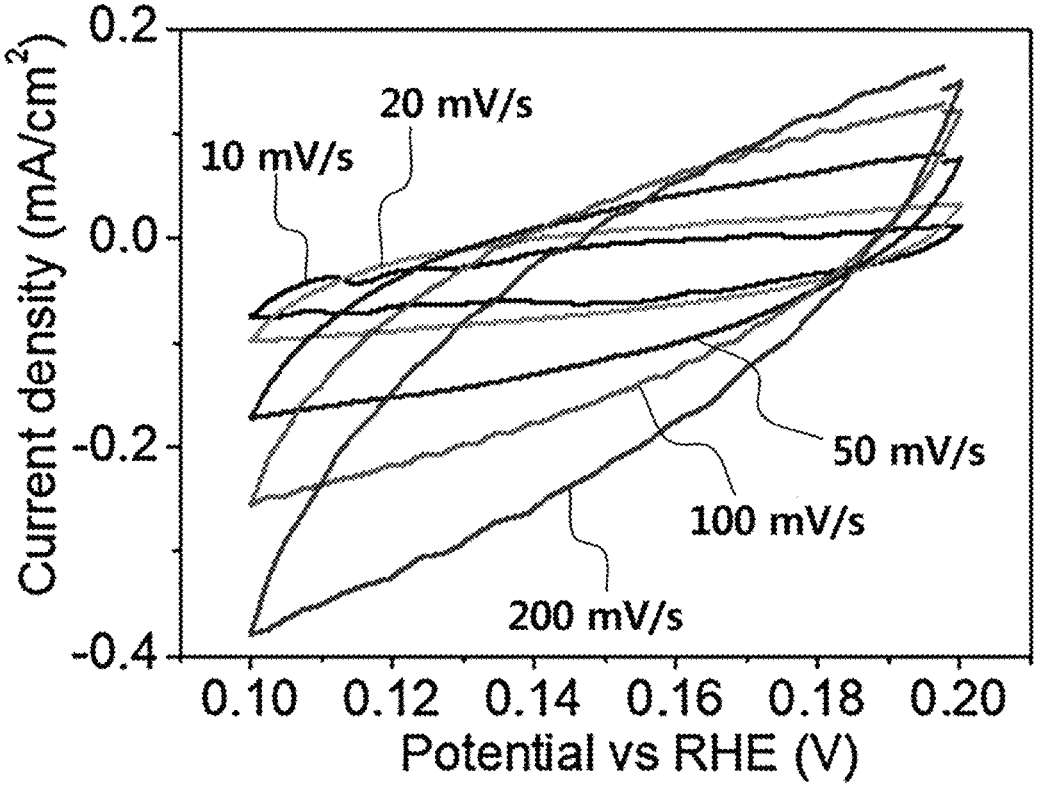
Figure 14C:
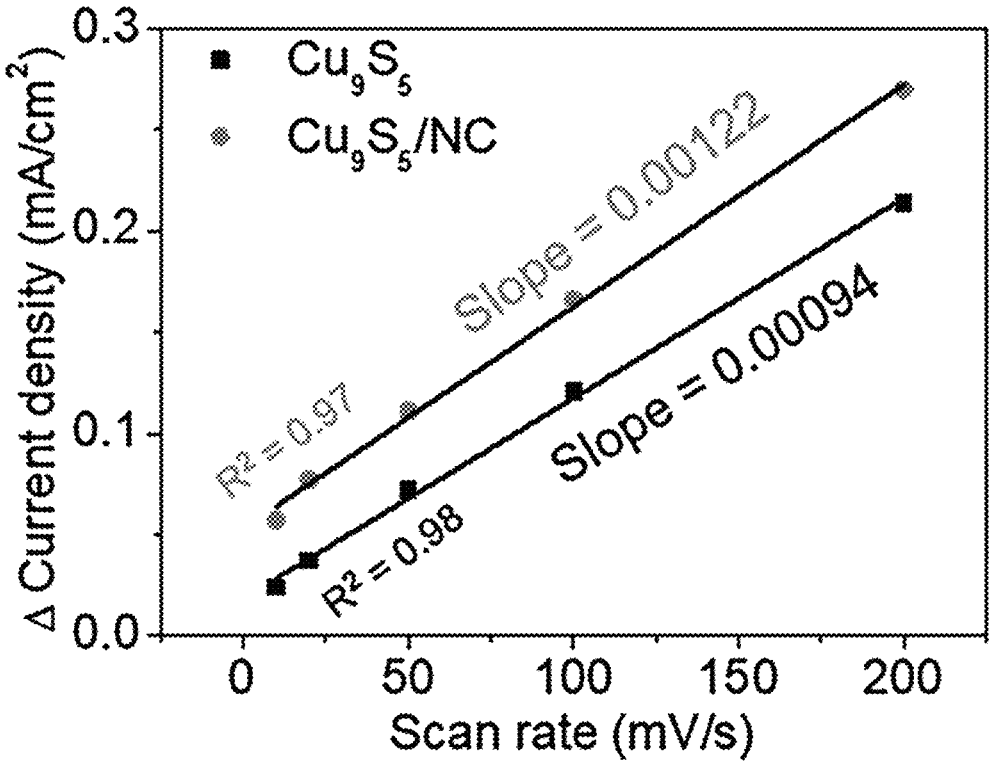
FIGS. 14C-14D show the electrochemical double-layer capacitance of $Cu_9S_5$/NC and $Cu_9S_5$ (14C) and the $N_2$-TPD profiles of $Cu_9S_5$/NC and $Cu_9S_5$ (14D).
Figure 14D:
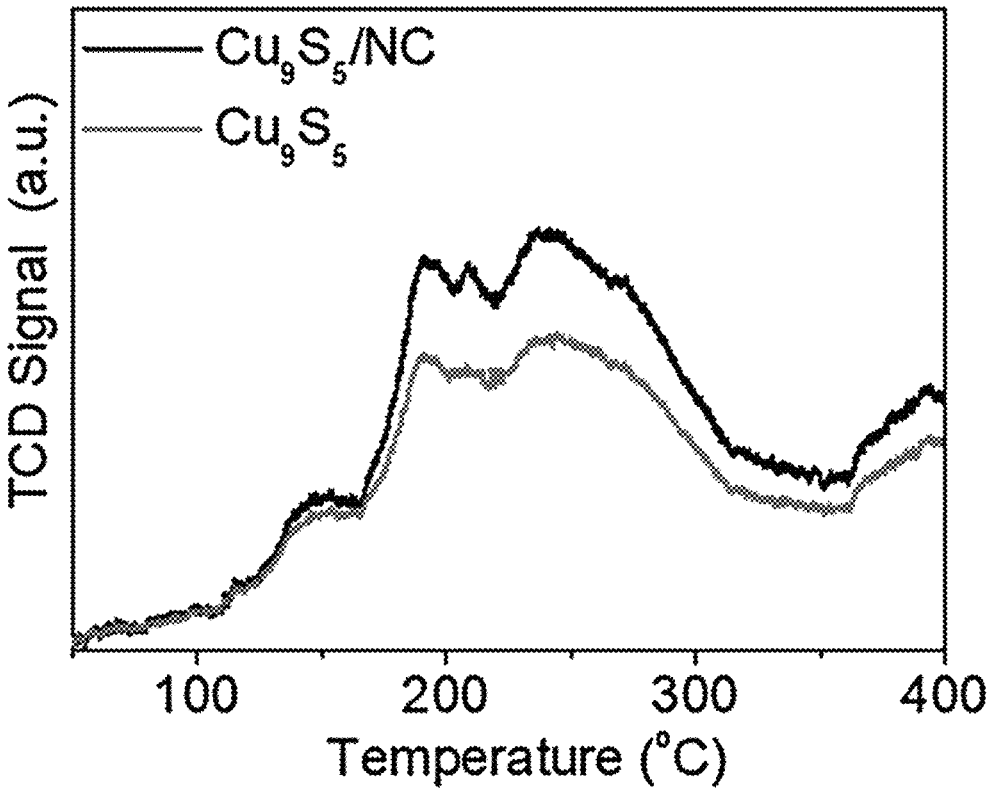

Additional controlled CA experiment was conducted to confirm the electrochemical NRR result obtained with the $Cu_9S_5$/NC catalyst. The conditions of the controlled experiment are as follows: (1) $Cu_9S_5$/NC-free carbon paper under $N_2$ atmosphere, (2) $Cu_9S_5$/NC electrode under $N_2$ atmosphere, open-circuit potential with no voltage applied, and (3) $Cu_9S_5$/NC, −0.5 $V_{RHE}$ in an Ar-saturated 0.5 M $Na_2SO_4$ electrolyte solution (FIG. 10). Under these conditions, a negligible amount of $NH_3$ was produced. This experiment confirms that $NH_3$ was synthesized by electrochemical NRR at controlled potentials in the presence of the supplied $N_2$ gas. The production of $NH_3$ was additionally supported $^1H$ ($^{14}N$ and $^{15}N$) NMR analysis and colorimetric observation (FIG. 11). In $^1H$ NMR, the triplet and doublet peaks of $^{14}NH_3$ and $^{15}NH_3$ were observed. This strongly supports that $NH_3$ was generated in the electrolyte solution by electrochemical NRR. Although the production of $N_2H_4$ by side reactions during NRR was investigated by the Watt and Chrisp method, no $N_2H_4$ was detected (FIGS. 12C and 12D). Thus, the inventors of the present disclosure concluded that the $Cu_9S_5$/NC catalyst produces $NH_3$ via electrochemical fixation of $N_2$ under ambient conditions. In order to investigate the effect of NC on the NRR activity of $Cu_9S_5$/NC, the NRR activity of the $Cu_9S_5$ catalyst was measured in a 0.5 M $Na_2SO_4$ electrolyte (FIG. 13). The $Cu_9S_5$ catalyst exhibited an FE of 7.0% and a reaction rate of 7.9 μg/hcm$^2$ (420 nmol/h cm$^2$) at −0.5 $V_{RHE}$. When compared with $Cu_9S_5$/NC, the activity was lower by 35% and the selectivity (FE) was lower by 80%. The difference in the NRR activity and the selectivity is partially due to SSA (FIGS. 7B and 7C) and difference in composition. The result of measuring the conductive surface area of $Cu_9S_5$ and $Cu_9S_5$/NC also shows clearly that $Cu_9S_5$/NC has a larger active surface area than $Cu_9S_5$, which is evidenced by a 24% steeper slope depending on scan rate in the plot of the charging current density (FIGS. 14A-14C). In addition, the $N_2$-TPD analysis result shows that $Cu_9S_5$/NC has 28% more $N_2$-adsorbed sites (which are favorable for NRR) as compared to $Cu_9S_5$ (FIG. 14D). In addition, since NC is semiconducting and allows facile transport of electrons between $Cu_9S_5$ and the supporting electrode (carbon paper), unnecessary ohmic drop may be reduced using the electrode. Due to the advantage of the $Cu_9S_5$/NC composite structure, the degradation and regeneration of the $Cu_9S_5$ catalyst for NRR were studied further.

Degradation and Regeneration of Catalyst

In general, the electrochemical reaction rate (i.e., current) is improved with increased overpotential. The exponential increase of current at applied overpotential is explained by the Butler-Volmer equation using two simple variables of transfer coefficient and overpotential. The NRR and FE of $Cu_9S_5$/NC decreased greatly at higher negative potentials (see Table 2, FIG. 3B and FIG. 8B).

TABLE 2

$J_{NH3}$, FE and $NH_3$ yield of $Cu_9S_5$/NC catalyst depending on potential (vs RHE)

| Potential (vs RHE) | $j_{NH3}$ (μA/cm$^2$) | FE (%) | $NH_3$ yield (μg/hmg$_{cat}$) | $NH_3$ yield (nmol/cm$^2$) | $NH_3$ yield (μg/hcm$^2$) |
|---|---|---|---|---|---|
| −0.4 V | 0.05 | 0.01 | 0.8 | 47 | 0.8 |
| −0.5 V | 52 | 35 | 11 | 645 | 11 |
| −0.6 V | 14 | 4.3 | 2.9 | 173 | 2.9 |
| −0.7 V | 1.8 | 0.12 | 0.37 | 22 | 0.37 |
| −0.8 V | 0 | 0 | 0 | 0 | 0 |

Figure 3C:
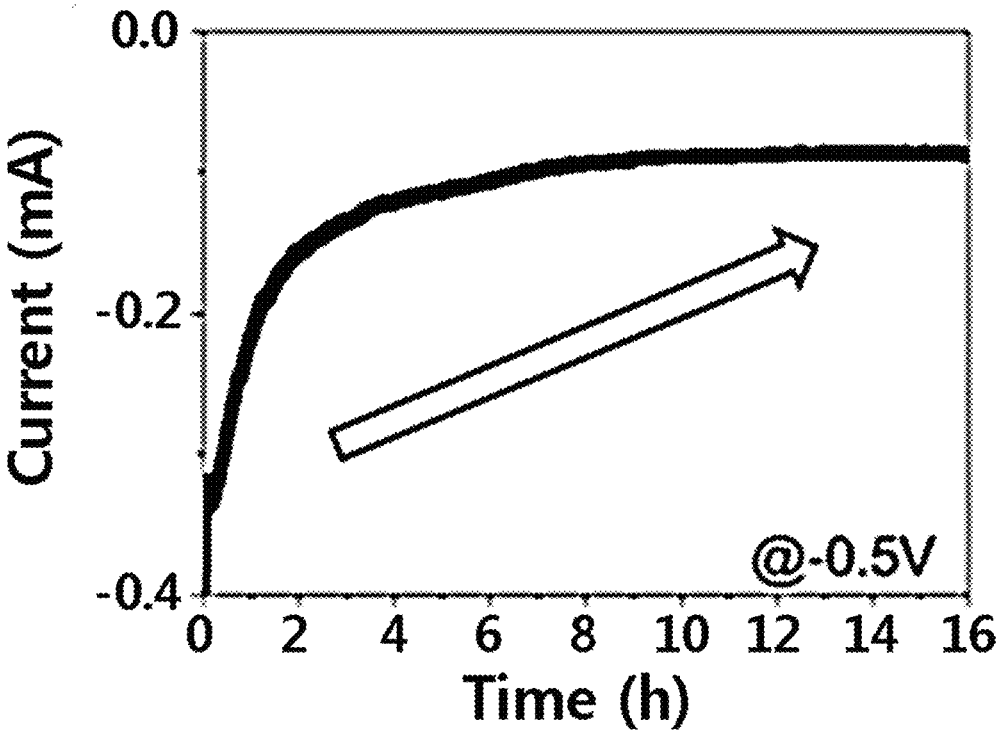
Figure 3D:
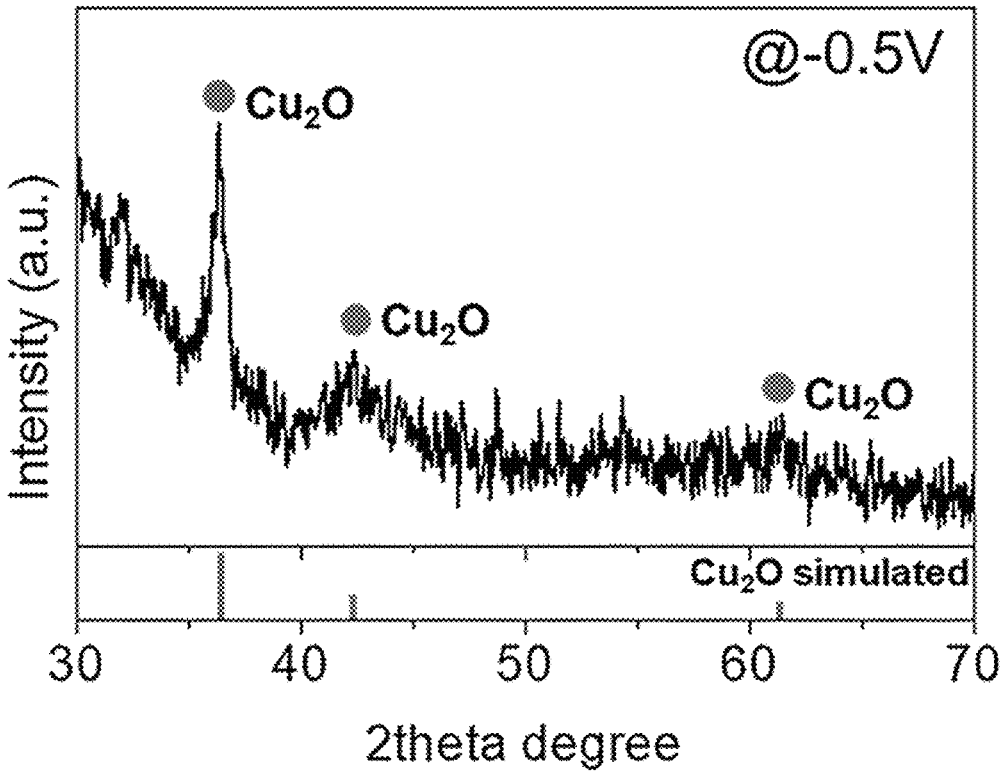
Figure 3E:
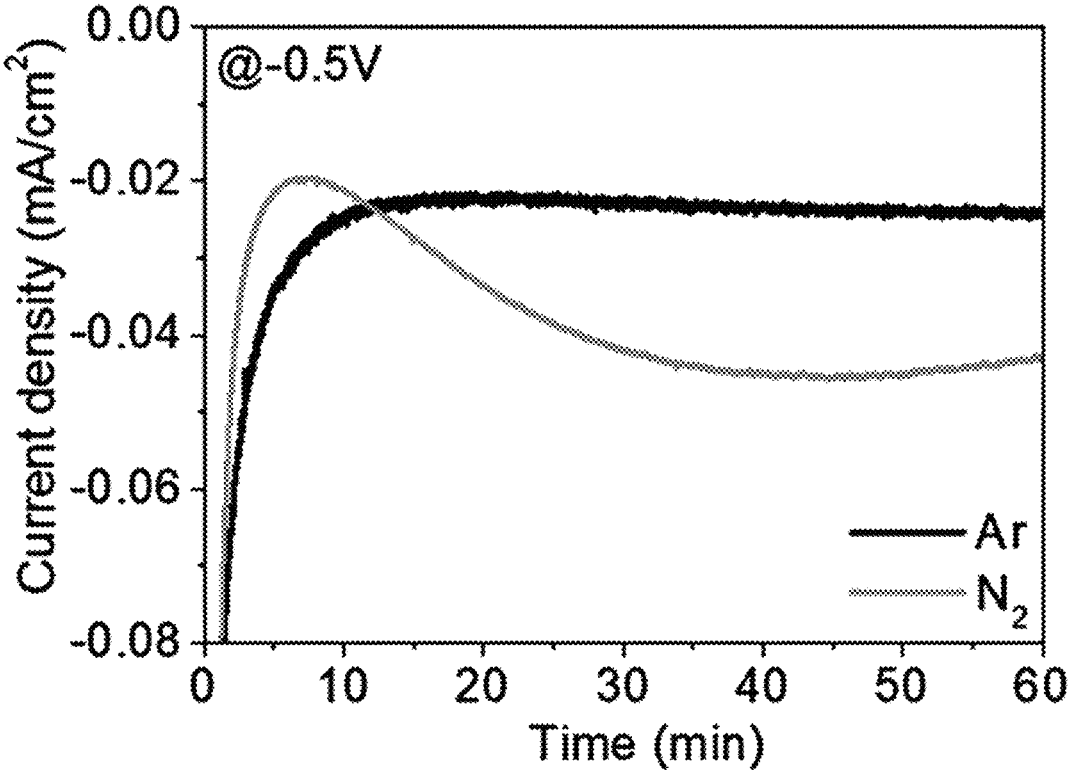
Figure 3F:
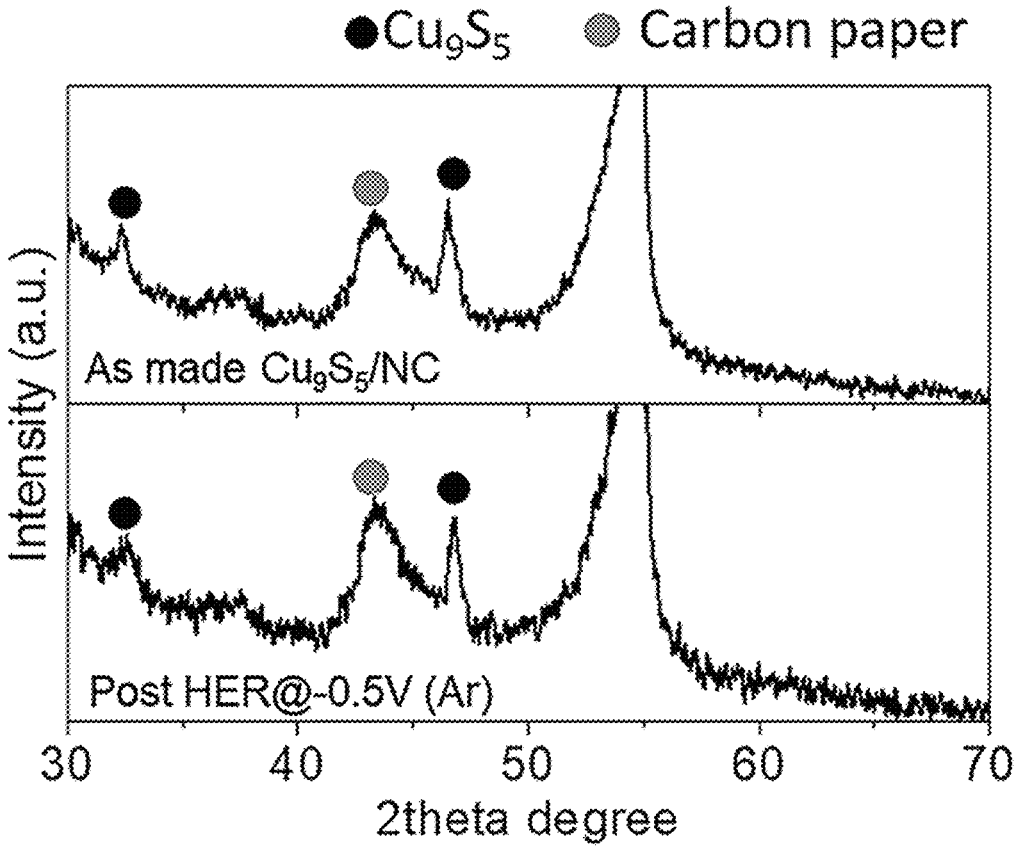
Figure 15A:
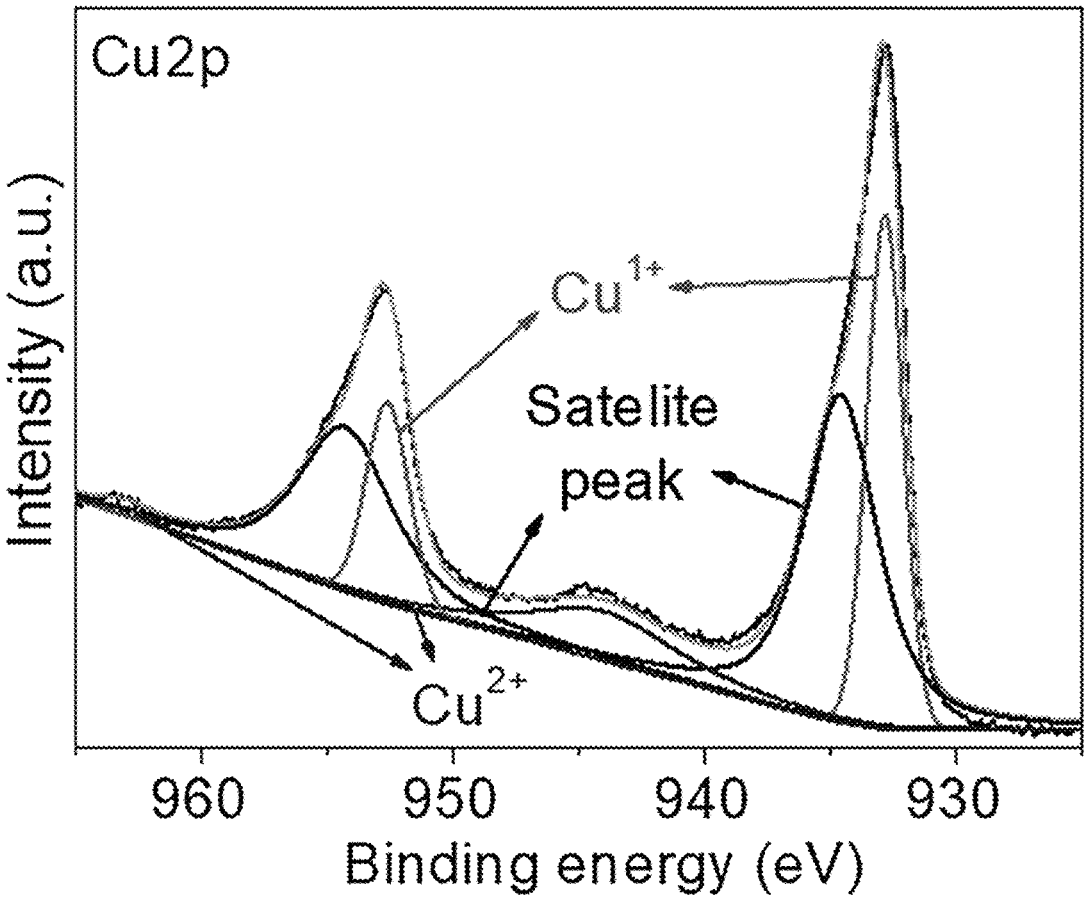
FIGS. 15A-15B show the high-resolution XPS spectra of Cu 2p (15A) and S 2p (15B) of $Cu_9S_5$/NC after NRR at −0.5 $V_{RHE}$.
Figure 15B:
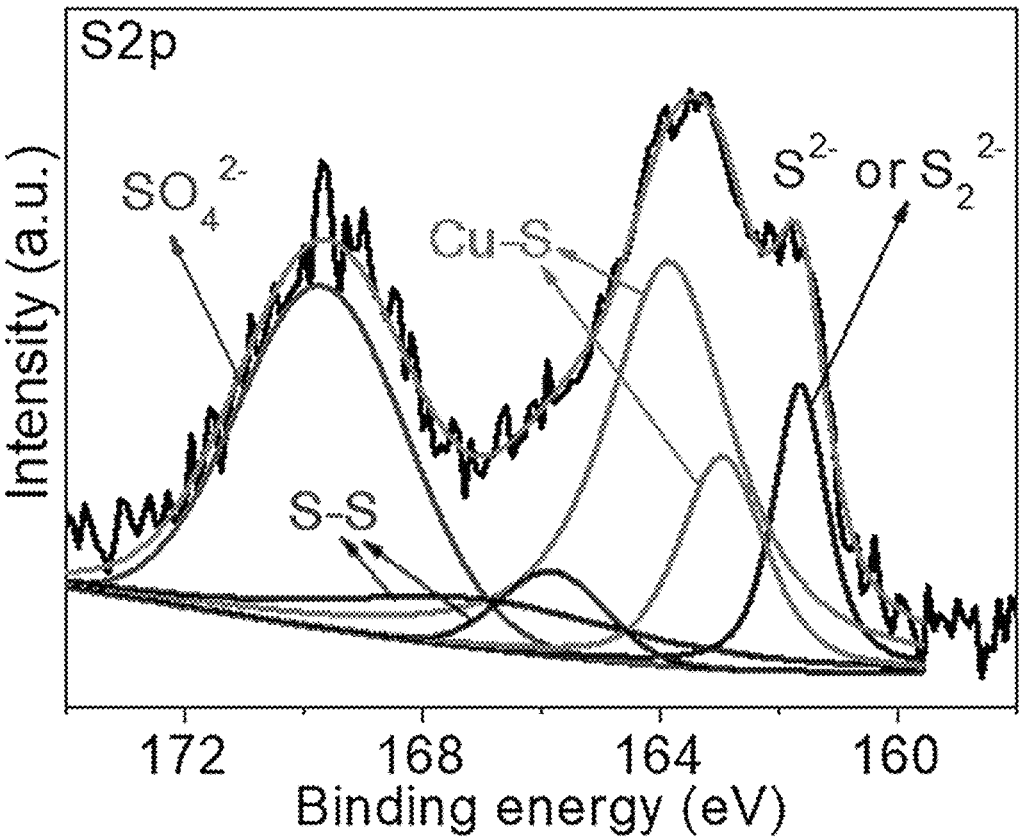

The $NH_3$ production rate was decreased from 645 to 22 nmol/hcm$^2$ as the applied potential was increased from −0.5 to −0.7 $V_{RHE}$, and then to 0.37 μg/hcm$^2$ at a potential of 11 $V_{RHE}$. The inverse relationship between the NRR activity and the overpotential may be derived from two possible effects: (i) $N_2$ adsorption may be interrupted on more negative surface, and proton adsorption and reduction may dominate the reduction reaction, or (ii) the catalyst activity may be lost as the surface is actually changed or electrochemically degraded at potential. Although the decrease in reaction rate with increased overpotential was proposed in the inverted Marcus region for electrochemical reactions, it was not considered in the present disclosure. The decrease in NRR activity at higher overpotential for $Cu_9S_5$/NC was observed as decreased current density, which is commensurate with both HER and NRR in extended CA experiments under $N_2$ atmosphere (FIG. 3C). The total current density of $Cu_9S_5$/NC was decreased from −0.4 to −0.1 mA/cm$^2$ at −0.5 $V_{RHE}$ during CA for 16 hours. Additionally, the surface degradation of the $Cu_9S_5$/NC catalyst was investigated by XRD following the CA at −0.5 $V_{RHE}$ for 16 hours, after the NRR activity measurement (FIG. 3D). The cubic pattern of $Cu_2O$ appeared whereas the intensity of the XRD peak corresponding to the hexagonal $Cu_9S_5$ was decreased rapidly immediately after the reduction reaction (FIG. 3D). More interestingly, the change in CA and catalyst structure was observed in the $N_2$-saturated aqueous solution only, whereas the reduction current and crystal structure remained intact after HER in the Ar-saturated electrolyte solution at −0.5 $V_{RHE}$ for 1 hour. The XRD analysis showed that the structure of $Cu_9S_5$ was maintained after the HER at −0.5 $V_{RHE}$ in the Ar-saturated aqueous solution (FIGS. 3E and 3F). This means that the catalyst surface was reconstituted after the NRR, not after the HER. In other words, although the strong adsorption of $N_2$ onto the Cu—S surface breaks the unstable Cu—S bond and forms $Cu_2O$ during NRR, the decrease in protons does not change the surface structure. The XPS analysis of the $Cu_9S_5$/NC catalyst after the NRR (FIGS. 15A and 15B) shows that the XPS spectra of Cu 2p are not significantly different from those of $Cu_9S_5$/NC, because $Cu_2O$ and $Cu_9S_5$ are similar in oxidation state and electron binding energy. However, the peaks of sulfur anions ($S^{2-}$ or $S_2^{2-}$ at 161.5 eV) dissolved during the NRR process appear in the S 2p spectra, together with the peak of $SO_4^{2-}$ at 170 eV from the $Na_2SO_4$ electrolyte (FIG. 15B). The peaks of the Cu—S and S—S bonds of $Cu_9S_5$ were still observed after the degradation. However, whereas the sulfur content was decreased rapidly after the NRR, the oxygen content was increased (see Table 3).

TABLE 3

Atomic ratio of Cu, S and O of as-prepared $Cu_9S_5$/NC and after NRR at −0.5 $V_{RHE}$ estimated from XPS spectra

| Element | Initially (as-prepared) (at %) | After NRR at −0.5 V (at %) |
|---|---|---|
| Cu | 61.9 | 22 |
| S | 33.8 | 9.4 |
| O | 4.3 | 68.8 |

Figure 4A:
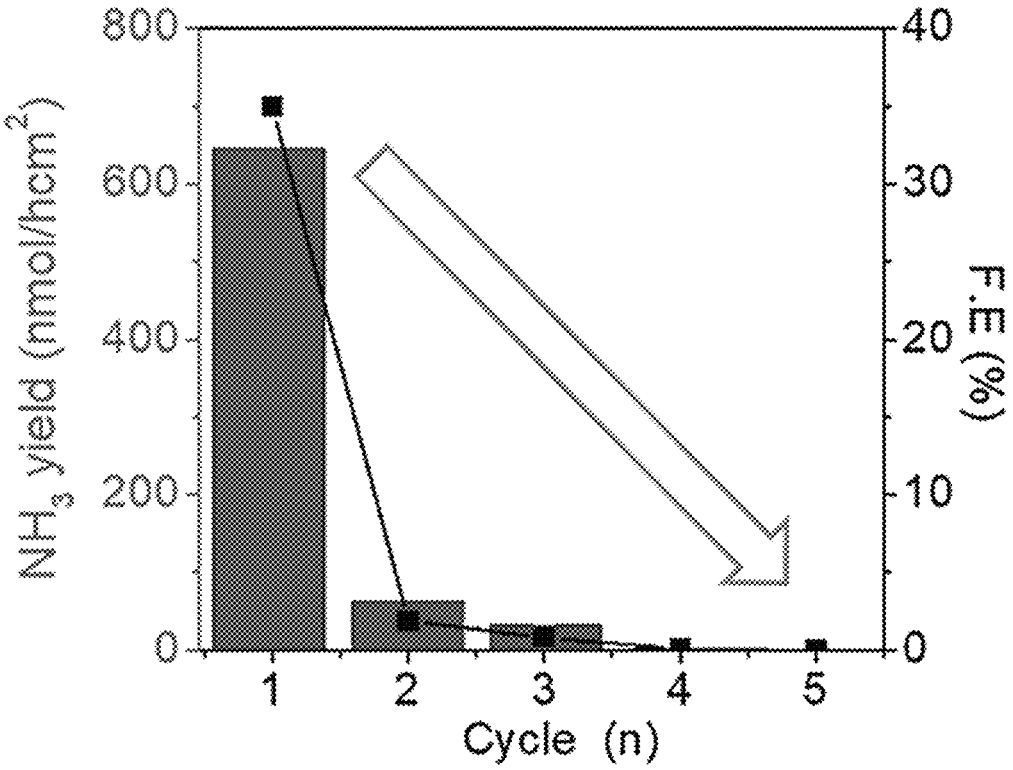
FIGS. 4A-4F show the $NH_3$ yield and FE of $Cu_9S_5$/NC after repeating NRR test for 5 cycles (4A), XRD patterns of $Cu_9S_5$/NC after NRR at −0.5 $V_{RHE}$ without $Na_2S$ treatment and $Cu_9S_5$/NC after an electrochemical regeneration process at +0.1 V in 5 mM $Na_2S$ (4B), $NH_3$ yield in a test for determining whether regeneration can be achieved at other potentials (4C), $NH_3$ yield and FE (%) after repeated electrochemical regeneration processes (4D), a $^1H$ ($^{14}N$) NMR analysis result of NRR using a catalyst regenerated by a first electrochemical regeneration process at 0.1 $V_{RHE}$ (4E), and CV curves of a $Cu_9S_5$/NC catalyst in 0.5 M $Na_2SO_4$ depending on the presence or absence of 5 mM $Na_2S$ (4F).
Figure 4B:
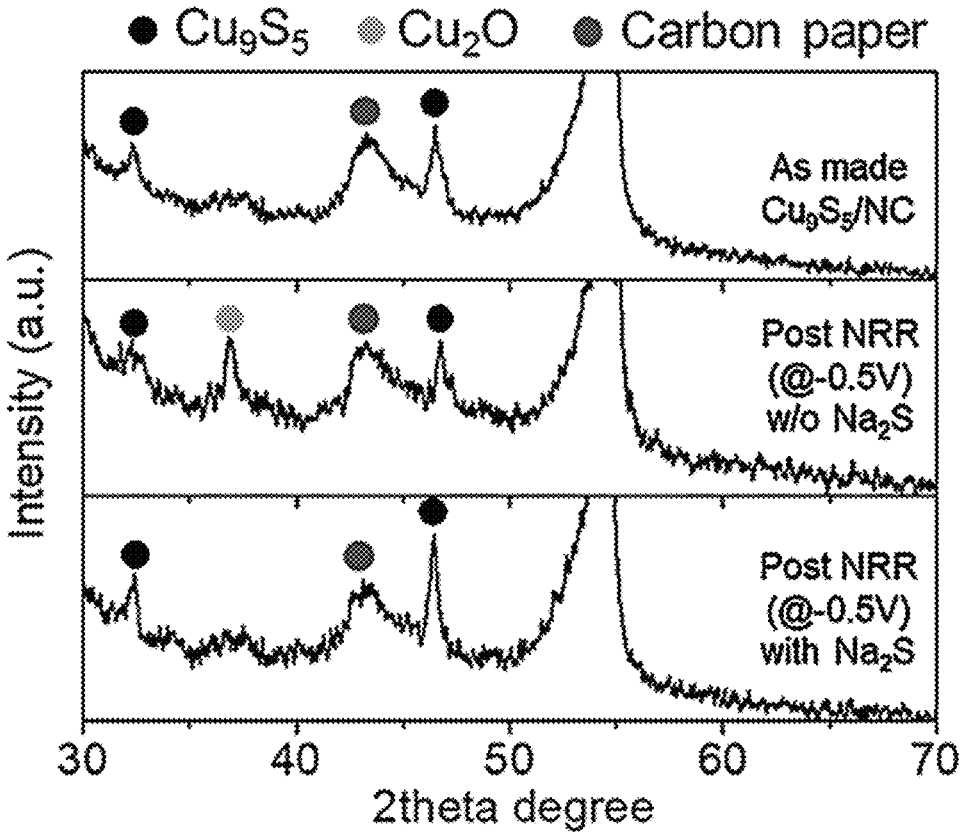
Figure 16:
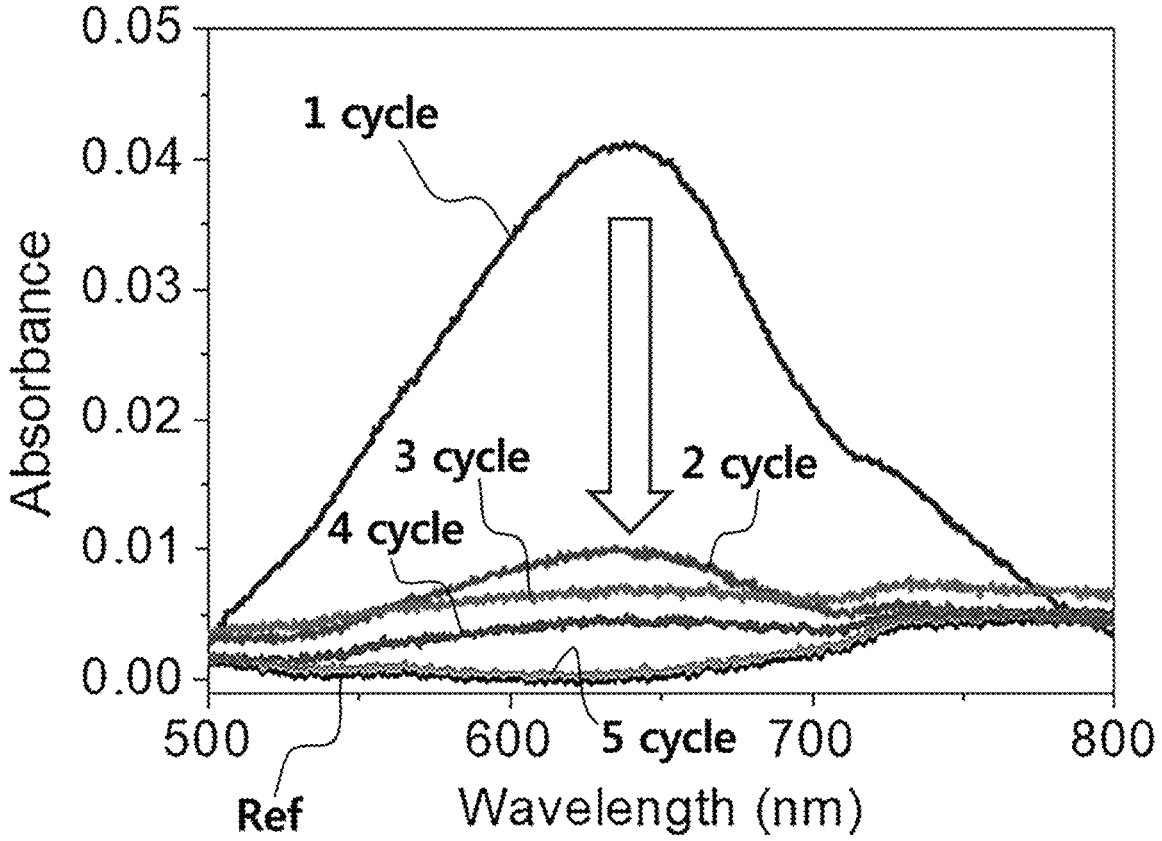
FIG. 16 shows the UV-Vis absorption spectra of bare CP, OCV, $N_2$ and Ar after chronoamperometric analysis at −0.5 $V_{RHE}$ for 1 hour using the indophenol indicator. Specifically, after conducting chronoamperometry (CA) experiment of monitoring change in current by changing potential from −0.4 V (RHE) to −0.8 V with a step size of 0.1 V while maintaining each potential for 1 hour, the amount of $NH_3$ produced for 1 hour at each potential was quantified with absorption spectra.

Referring to FIG. 4A and FIG. 16, the results of XRD and XPS support the electrochemical degradation of $Cu_9S_5$/NC, together with the decreased NRR activity due to repeated CA at 0.5 $V_{RHE}$. The decrease in NRR activity at higher overpotentials is due to the degradation of the catalyst surface under the electrochemical reaction condition. Under reducing environments, the electrochemical formation of $Cu_2O$ from $Cu_9S_5$ may occur according to the following half-reaction.

$$10Cu_{1.8}S+10H_2O+2e^- \rightarrow 9Cu_2O+10H_2S+O^{2-}$$

Although the faradaic peak current associated with the reductive degradation of $Cu_9S_5$ was not clearly observed in CV, the structural change and activity loss at more negative potentials than −0.5 $V_{RHE}$ strongly suggests the electrochemical degradation of the catalyst.

Figure 4C:
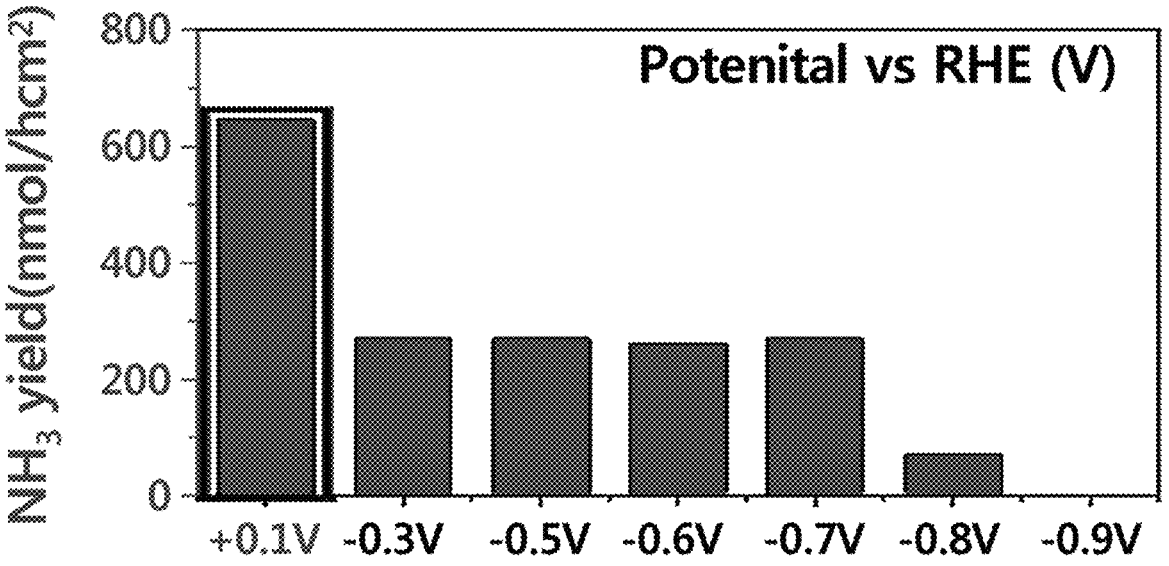
Figure 4D:
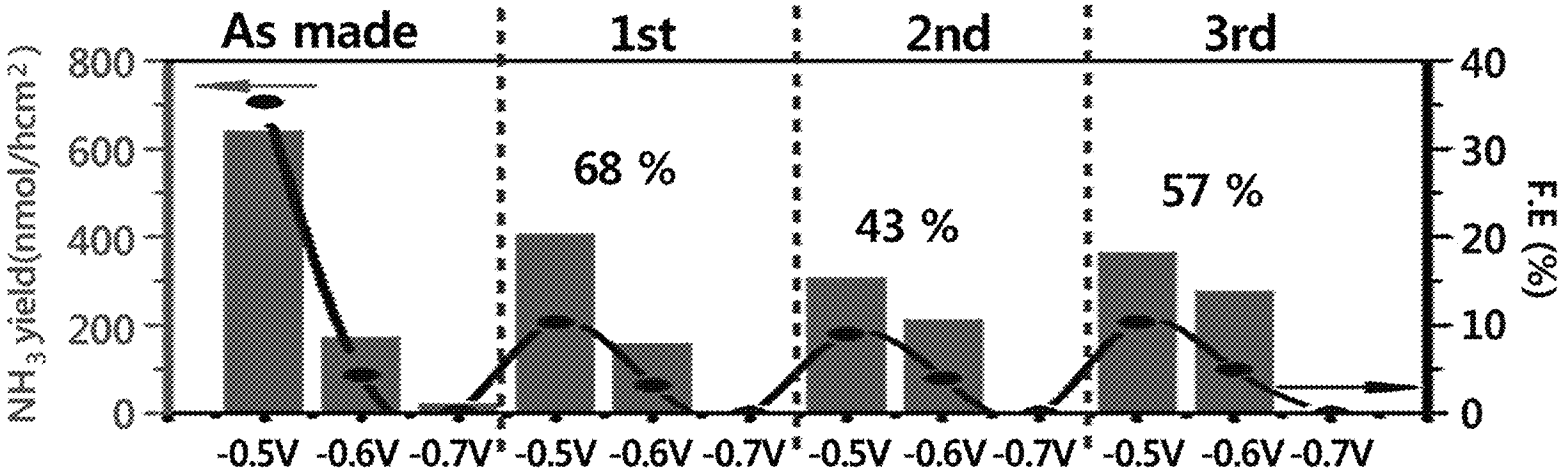
Figure 17A:
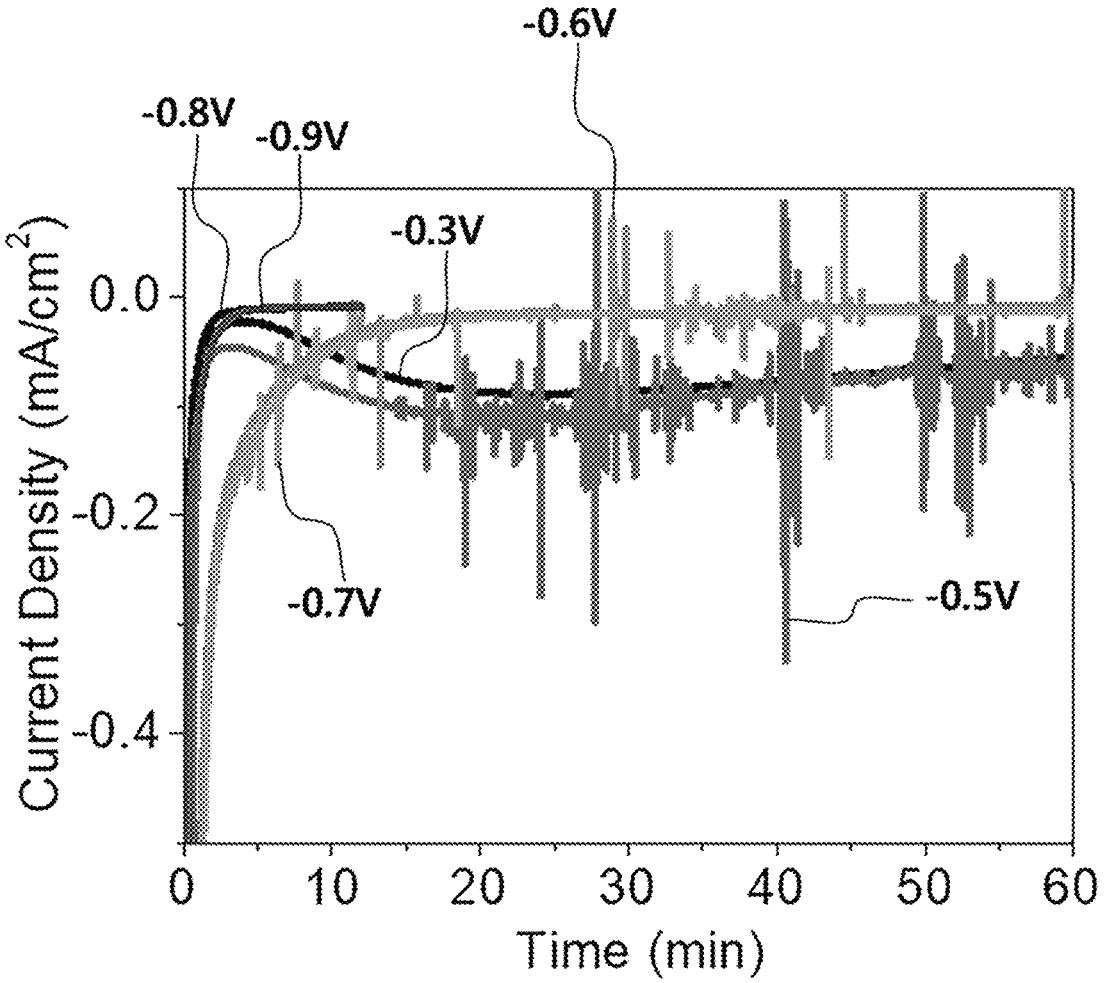
FIGS. 17A-17B show the CA curves (17A) and UV-Vis absorption spectra (17B) obtained using a catalyst regenerated by electrochemical regeneration at various potentials (−0.3 to −0.9 $V_{RHE}$), detected with the indophenol blue reagent.
Figure 17B:
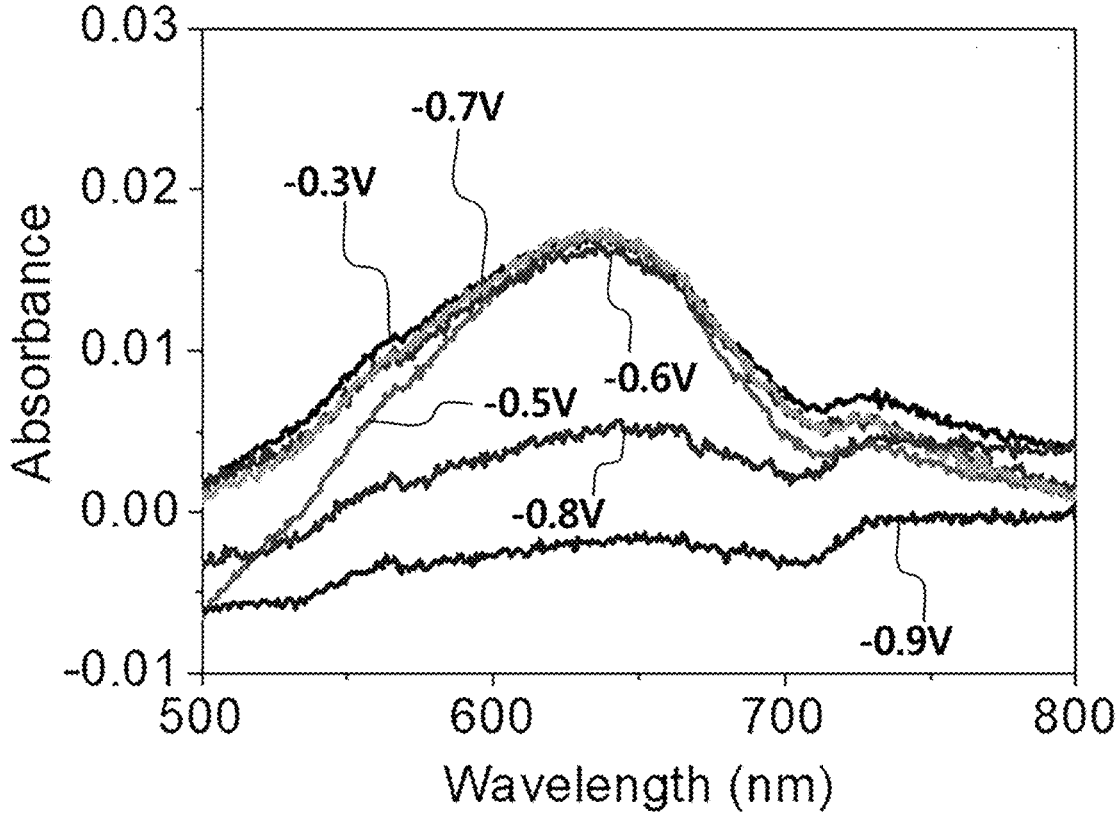
Figure 18A:
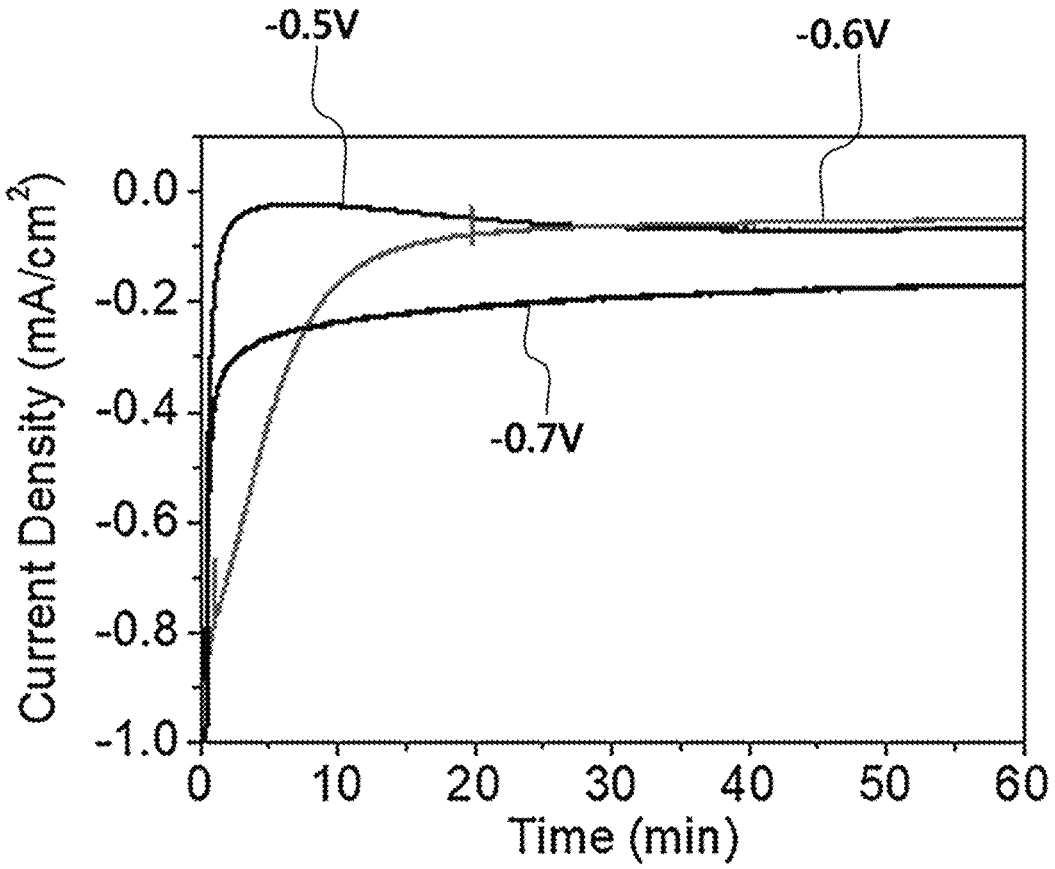
FIGS. 18A-18F show the chronoamperometric curves and UV-Vis spectra of $Cu_9S_5$/NC after an electrochemical regeneration process. The electrochemical regeneration was carried out once (18A, 18D), twice (18B, 18E) or 3 times (18C, 18F).
Figure 18B:
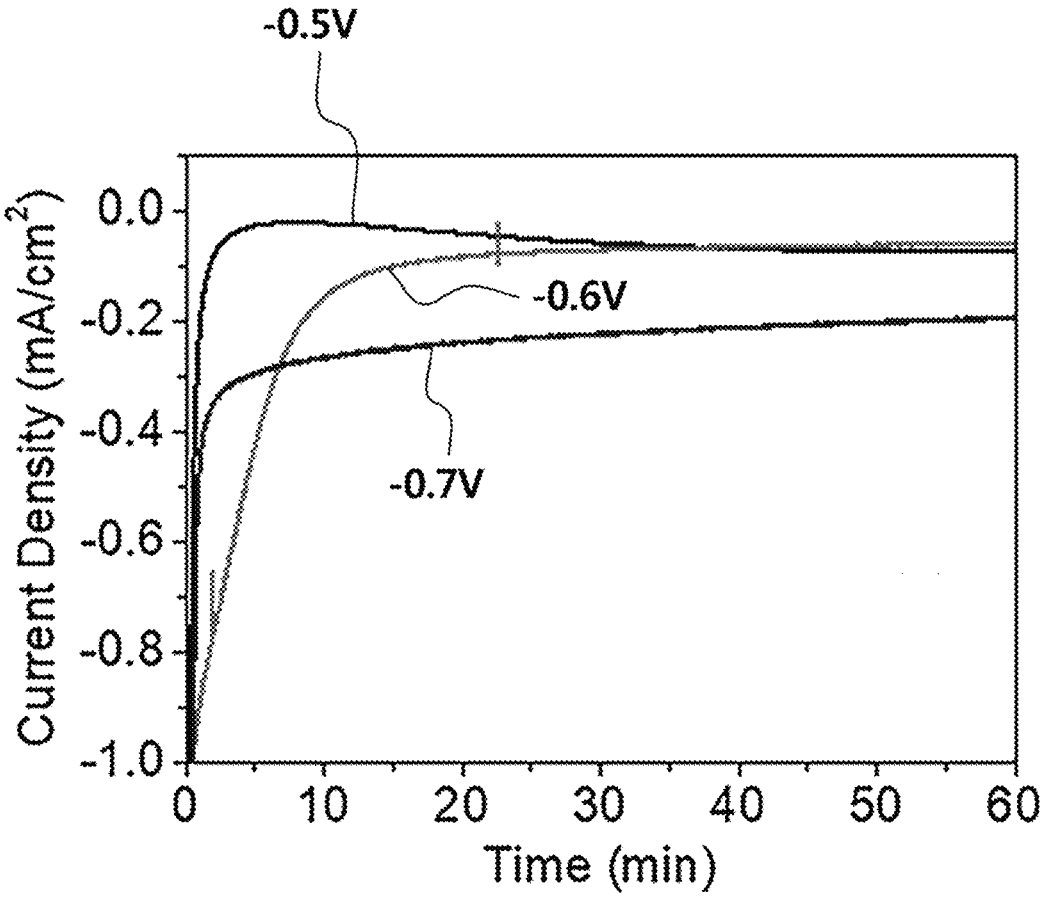
Figure 18C:
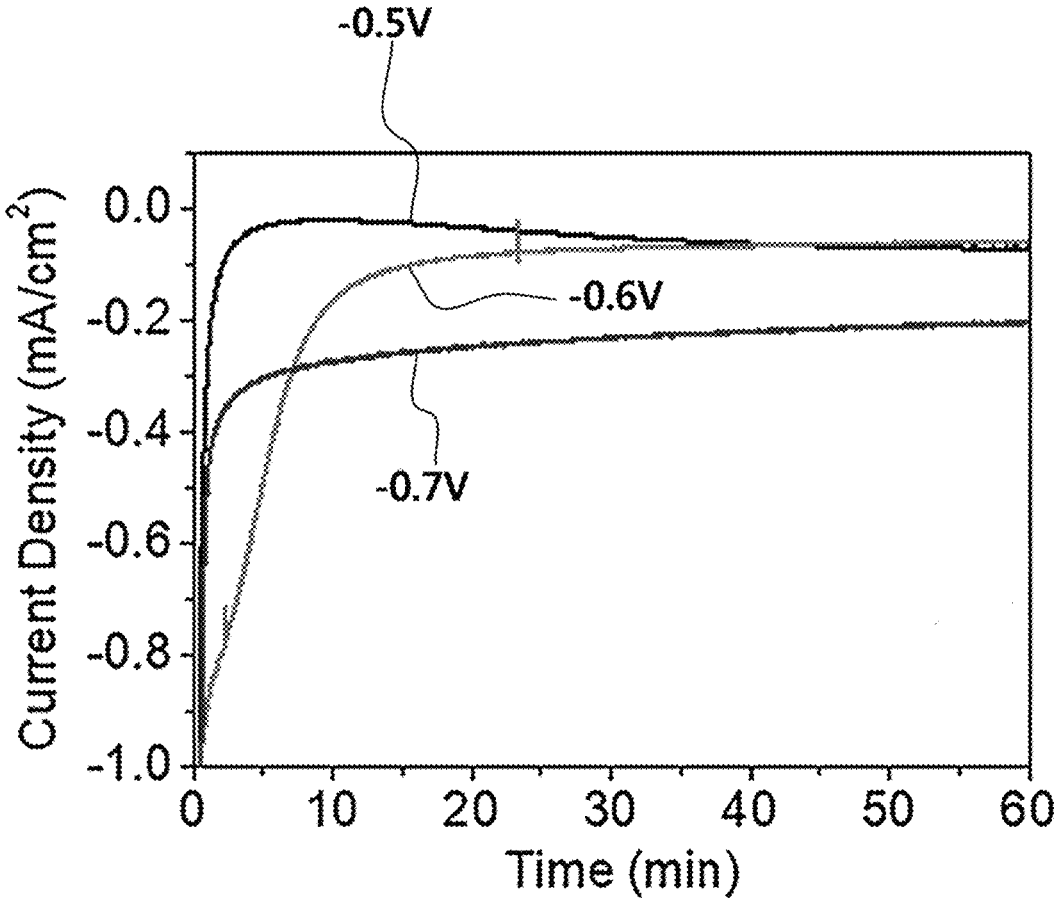
Figure 18D:
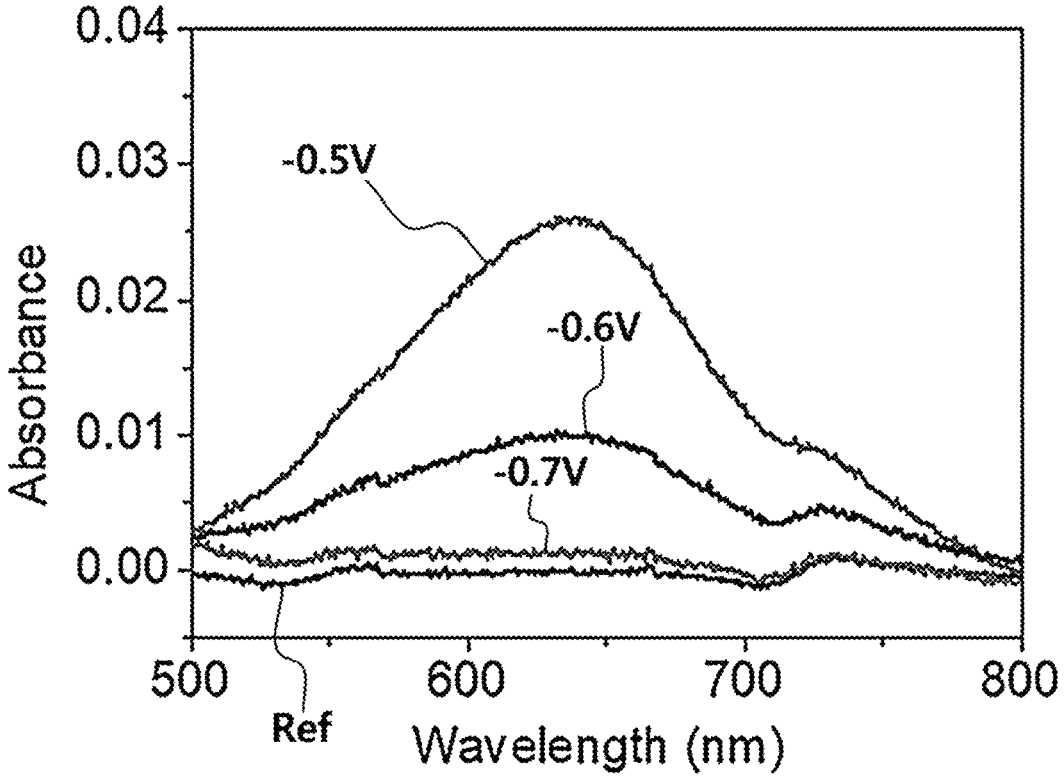
Figure 18E:
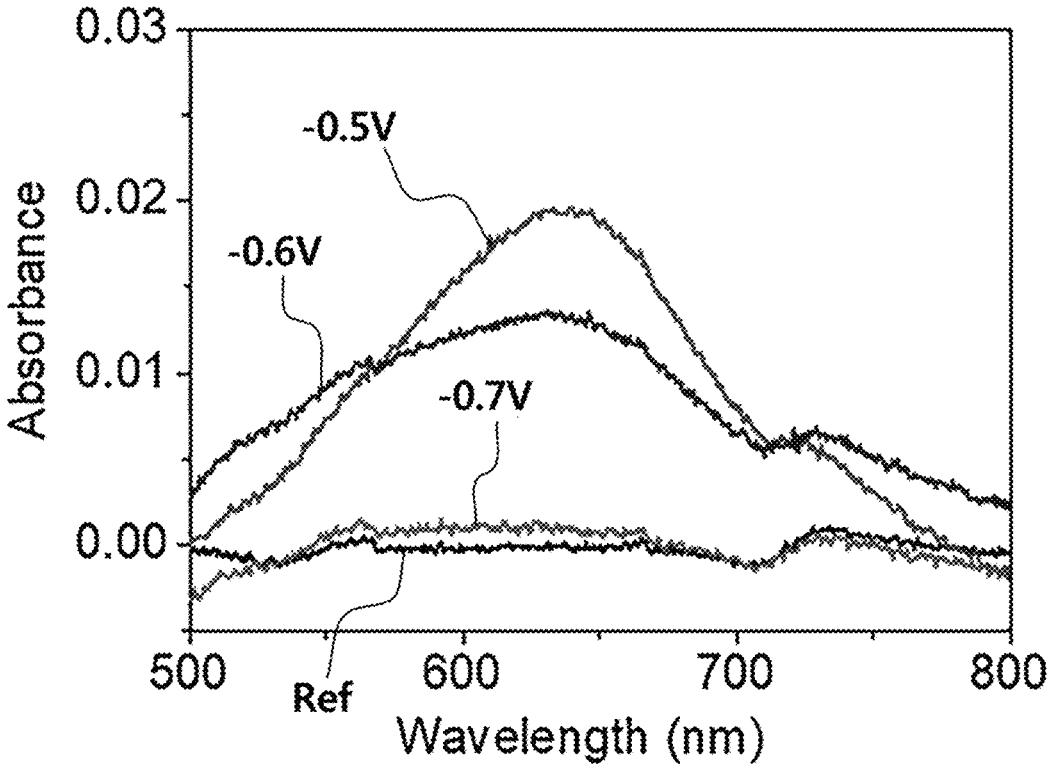
Figure 18F:
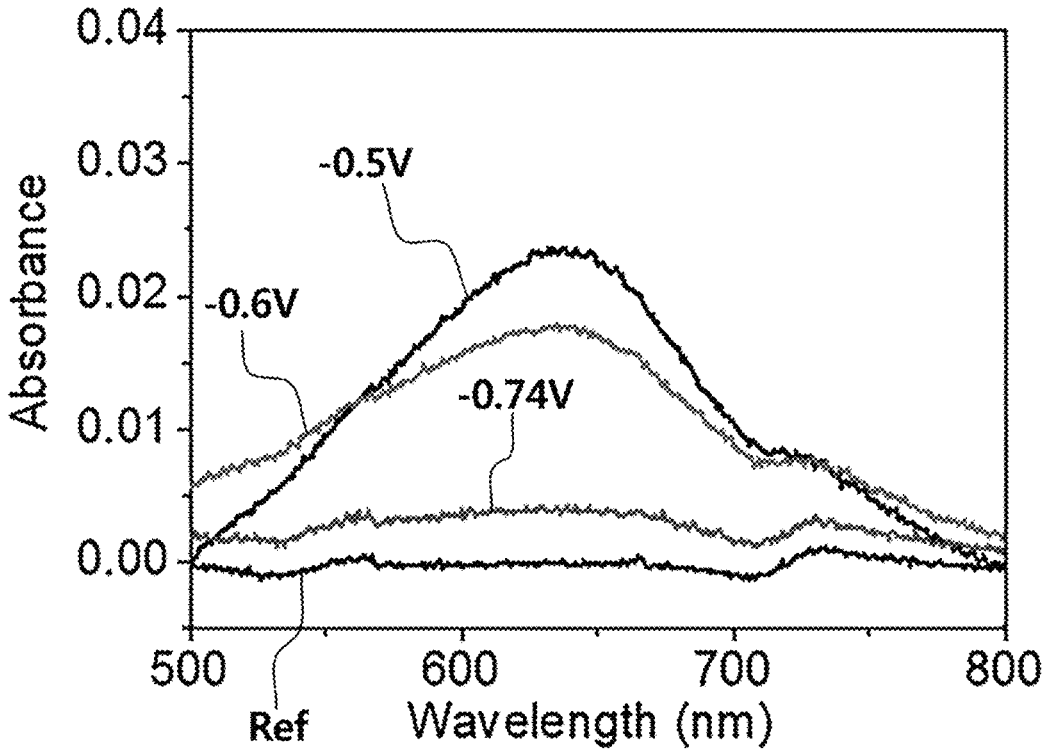

The inventors of the present disclosure hypothesized that the Cu—S bond is cleaved during NRR and the restoration of the Cu—S bond will recover NRR activity. Therefore, in order to mimic the unstable chemistry of the sulfhydryl group of the FeMo cofactor and restore NRR activity, ex-situ electrochemical sulfurization reaction was used to restore the Cu—S bond on the $Cu_9S_5$/NC surface. Specifically, a degraded $Cu_9S_5$/NC electrode was re-oxidized by CA in 5 mM $Na_2S$ and 0.5 M $Na_2SO_4$ aqueous solutions for 1 hour at a potential in the range from −0.9 to 0.1 $V_{RHE}$ (FIG. 4B and FIGS. 17A-17B). Then, the electrode was subjected to NRR under $N_2$ atmosphere in a fresh 0.5 M $Na_2SO_4$ aqueous solution (FIG. 4C). Importantly, the NRR activity was recovered at the $Cu_9S_5$/NC electrode which was treated at more positive potential than −0.7 $V_{RHE}$ in the 5 mM $Na_2S$ solution. The electrochemical regeneration process is described in detail in FIG. 5. The restoration of the $Cu_9S_5$ structure was confirmed by XRD. The diffraction pattern of hexagonal $Cu_9S_5$ appeared again in the regenerated electrode, whereas the peaks of $Cu_2O$ decreased significantly (FIG. 4B). Through continuous NRR/regeneration of 4 cycles, the $NH_3$ production speed was recovered to 68, 43 and 57%, respectively, as compared to the initial NRR of a fresh $Cu_9S_5$/NC electrode (see FIG. 4D, FIGS. 18A-18F and Table 4).

TABLE 4

NRR performance after electrochemical regeneration process depending on cycle number

| Regeneration cycle | Potential (vs RHE) | FE (%) | $NH_3$ yield (nmol/hcm$^2$) |
|---|---|---|---|
| As-prepared | −0.5 V | 35 | 645 |
| $Cu_9S_5$/NC | −0.6 V | 4.3 | 173 |
| | −0.7 V | 0.12 | 22 |
| 1st regeneration | −0.5 V | 10.3 | 406 |
| | −0.6 V | 3.2 | 159 |
| | −0.7 V | — | — |
| 2nd regeneration | −0.5 V | 9.0 | 308 |
| | −0.6 V | 4.0 | 212 |
| | −0.7 V | — | — |
| 3rd regeneration | −0.5 V | 10.4 | 365 |
| | −0.6 V | 5.0 | 278 |
| | −0.7 V | — | — |

Figure 4E:
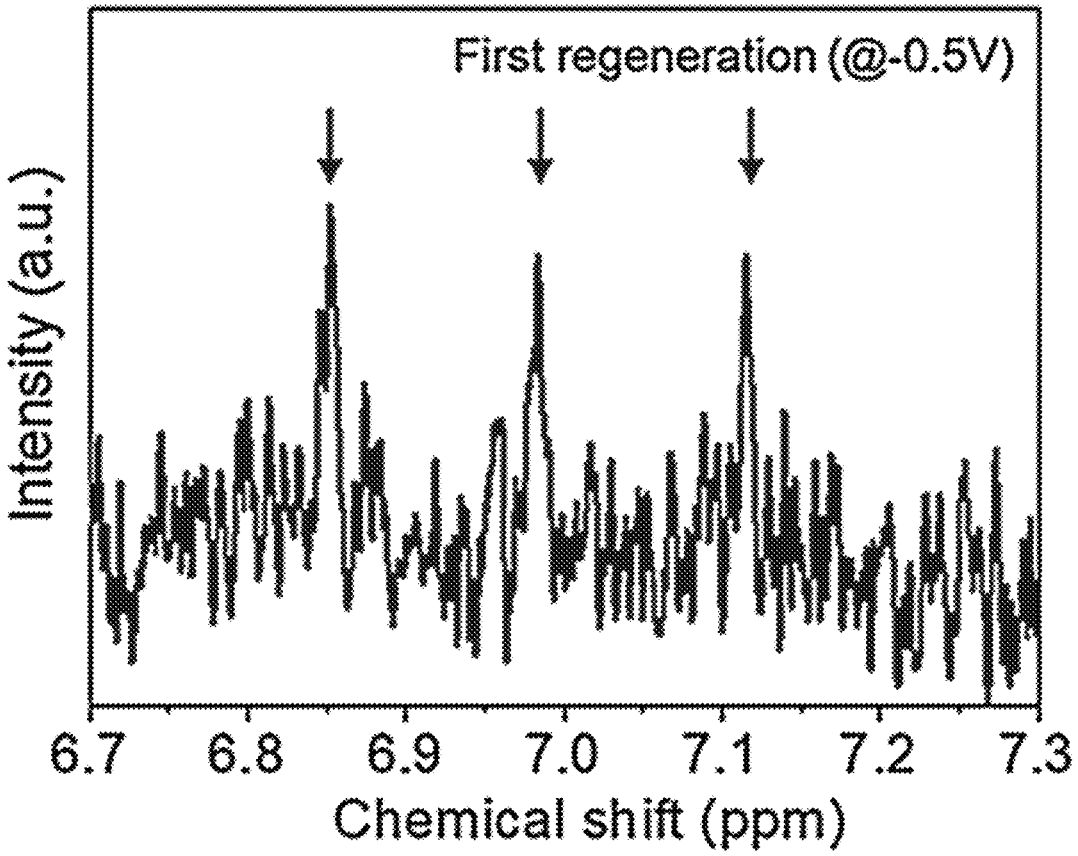
Figure 19A:
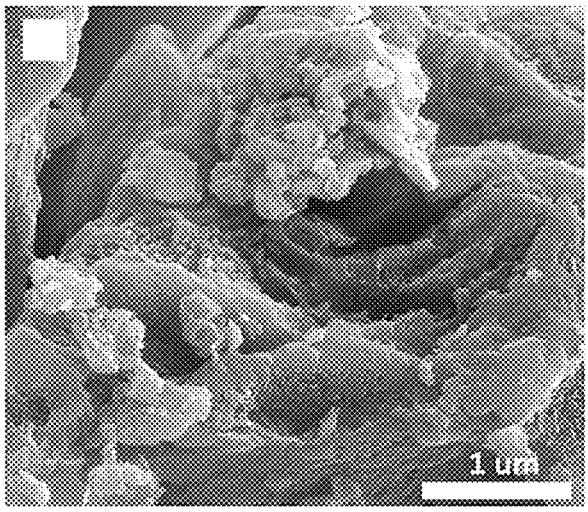
FIGS. 19A-19C show the SEM images of $Cu_9S_5$/NC, before (19A) and after (19B, 19C) NRR at 0.5 $V_{RHE}$. Prior to the NRR test, the prepared $Cu_9S_5$/NC has a complicated structure in which $Cu_9S_5$ and NC are mixed uniformly. After the NRR, the structure collapses, resulting in aggregation of $Cu_2O$ (red circles) and scattering of NC (yellow circles).
Figure 19B:
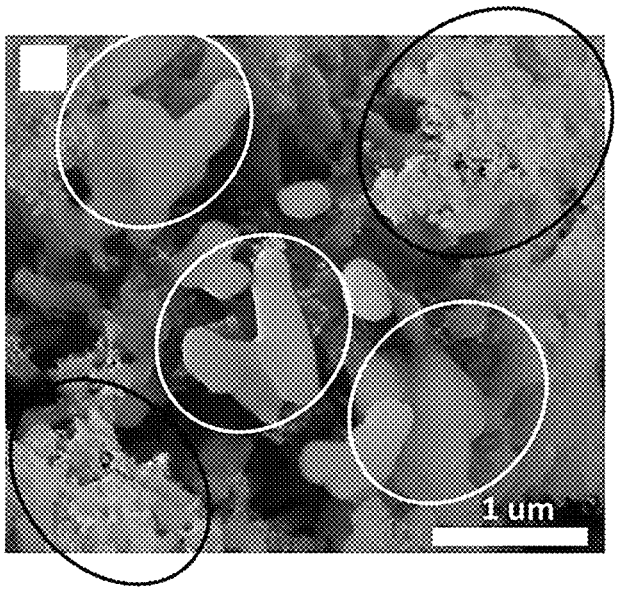
Figure 19C:
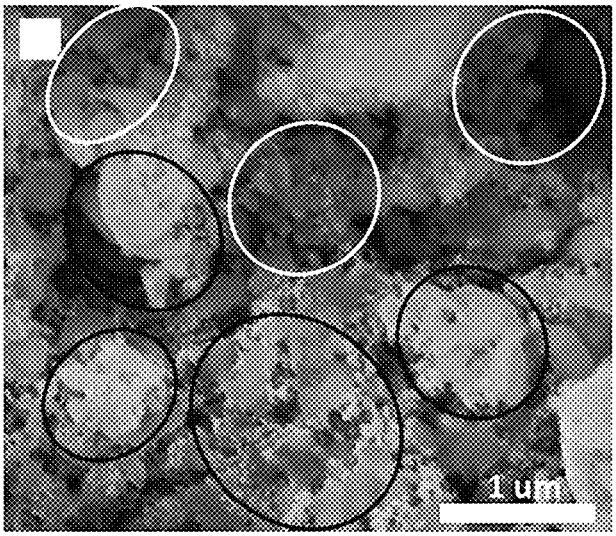
Figure 20:
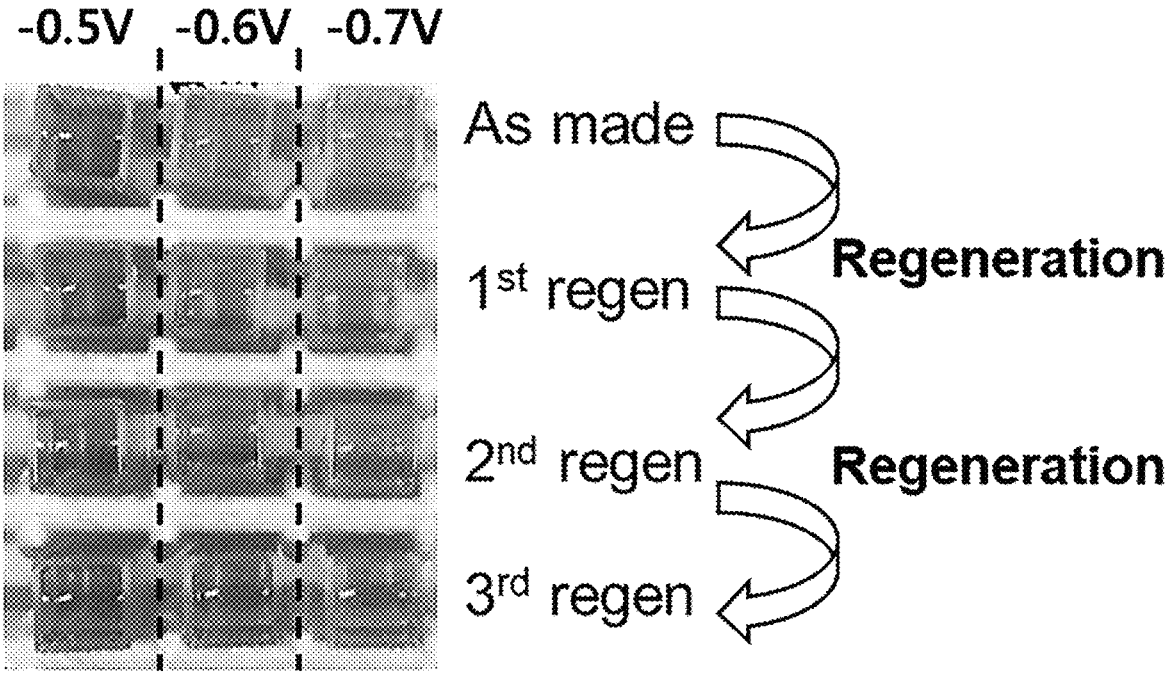
FIG. 20 shows the production cycles of an electrochemical regeneration process using the indophenol indicator as well as images depending on potentials.

However, the $Cu_9S_5$/NC composite structure shown in FIG. 1C was disrupted and, $Cu_2O$ and NC were separated during the repeated NRR/regeneration process as observed by SEM (FIGS. 19A-19C). In addition, the NRR activity was not completely recovered to the NRR activity of the original composite structure. $NH_3$ production by the regenerated electrode was confirmed by $^1H$ NMR and the colorimetric method (FIG. 4E). Both NMR and indophenol blue analyses showed that the NRR performance of the catalyst was recovered by the electrochemical regeneration (FIG. 20). The regeneration of the $Cu_9S_5$ structure from $Cu_2O$ can proceed by the following oxidation process.

$$9Cu_2O+10Na_2S+11H_2O \rightarrow 10Cu_{1.8}S+20NaOH+2H^++2e^-$$

Figure 4F:
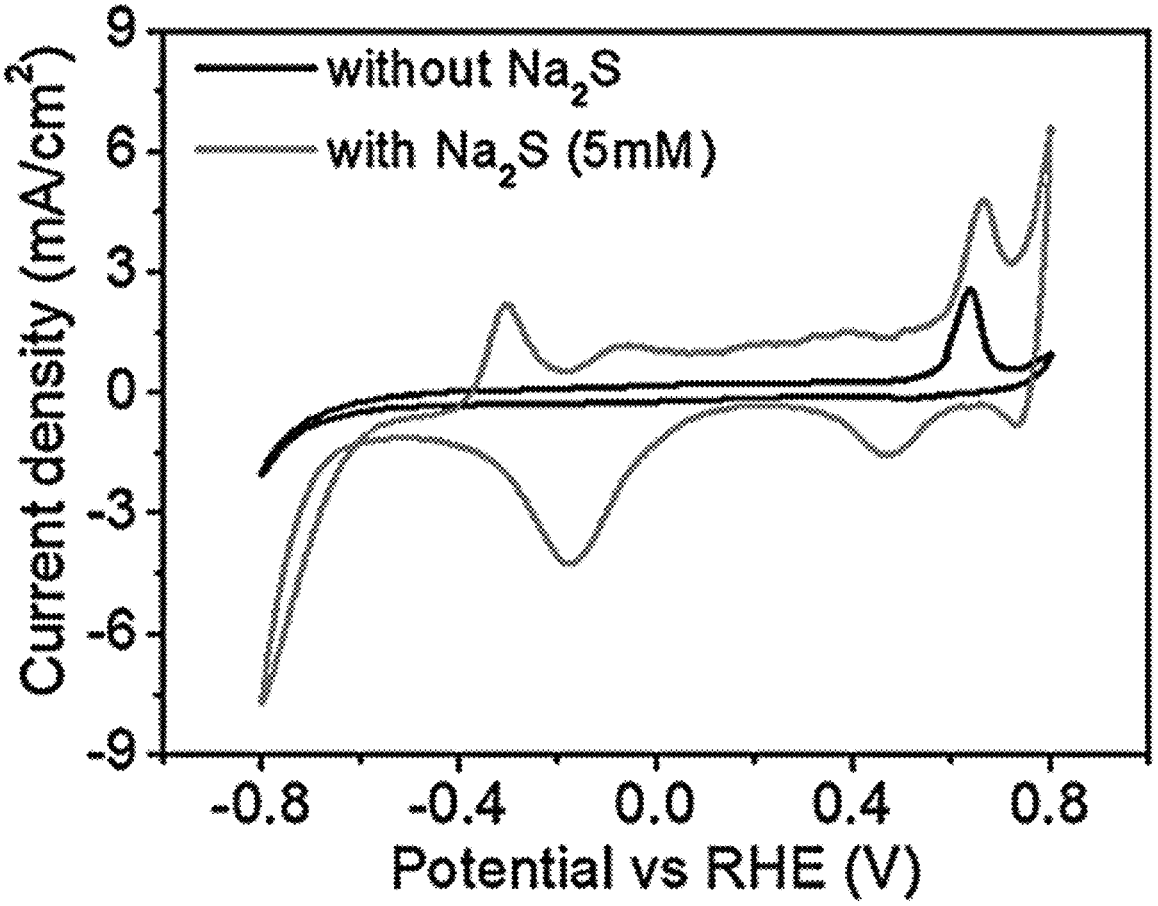
Figure 21:
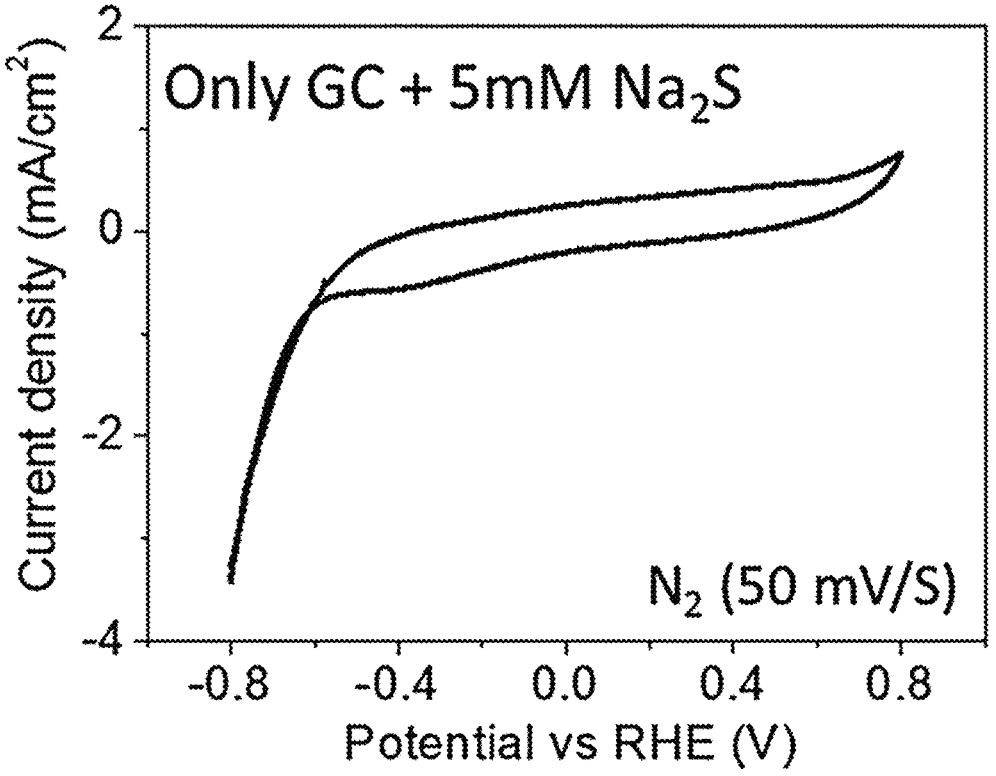
FIG. 21 shows the CV curves of a GC electrode and 5 mM $Na_2S$ in a 0.5 M $Na_2SO_4$ electrolyte.

It is reported that a Cu substrate is oxidized in an electrolyte solution in the presence of a sulfide at more positive potentials than approximately −0.8 $V_{RHE}$ to form $Cu_xS$ ($Cu_2S$ and $Cu_9S_5$). In a previous study, a small bumpy current was recorded at about −0.8 $V_{RHE}$ in CV for forming $Cu_xS$ from a Cu substrate. In addition, a large oxidation current was not detected at a potential around −0.8 $V_{RHE}$ from CV in 5 mM $Na_2S$ using a degraded $Cu_9S_5$ electrode (FIG. 4F). In FIG. 4F, the peak oxidation current observed at −0.3 $V_{RHE}$ originates from the $S_n^{2-}/S^{2-}$ redox reaction on the $Cu_9S_5$ surface. However, no similar oxidation current was observed when a carbon electrode was used in an electrolyte solution or in the absence of a sulfide (FIG. 4F and FIG. 21).

The increased NRR activity of the regenerated $Cu_9S_5$/NC electrode and its crystal structure strongly suggest that the Cu—S bond is regenerated by the electrochemical treatment. The result also suggests that the metal-sulfur bond is very important in the electrochemical NRR process. The Cu—S bond was broken in the NRR process only and was not affected in an aqueous solution in the absence of $N_2$. In the FeMo cofactor of nitrogenase, the Fe center provides an adsorption site for $N_2$ adsorption. The Fe—S bond is broken during the $N_2$ adsorption process, and the atomic hydrogen transferred to the cofactor approaches Fe—$N_2$ and forms a sulfhydryl group. Then, the sulfhydryl group is involved in hydrogenation processes including reductive removal of $H_2$ molecules. A similar adsorption mechanism was proposed in the electrochemical $N_2$ reduction reaction. The $N_2H_x$ intermediate on the electrocatalyst surface was observed through in-situ IR measurement, which supports the related adsorption mechanism under ambient condition. The NRR activity of the metal sulfide catalyst was also reported. However, the role of sulfur in the electrochemical NRR process has not been elucidated yet. The NRR activity observed on the $Cu_9S_5$/NC surface disappears when the metal-sulfur bond is broken. Importantly, the catalyst activity is recovered through sequential $NH_3$ production and catalyst regeneration cycles. These results mean that the metal-sulfur bond is important in the electrochemical production of $NH_3$ and is actively involved in the electrochemical $N_2$ reduction process.

In summary, the use of the $Cu_9S_5$/NC catalyst as a NRR catalyst resulted in significant $NH_3$ production, activity and selectivity (11.0 μg/h cm$^2$, 645 nmol/h cm$^2$ and 35%, respectively). Importantly, the $Cu_9S_5$ catalyst was degraded to $Cu_2O$ during the NRR process and the catalyst activity was decreased. Subsequently, the $Cu_9S_5$ surface was reconstructed from the degraded electrode through an electrochemical sulfurization process. The importance of the metal-sulfur bond in NRR was demonstrated by the recovered $NH_3$ production yield of the recovered $Cu_9S_5$/NC surface. The degradation and regeneration processes of the metal chalcogenide catalyst for electrochemical $NH_3$ production are similar to the enzymatic $N_2$ fixation process discovered in the FeMo cofactor of nitrogenase. In addition, this result strongly suggests that, in order to achieve effective electrochemical $NH_3$ production under ambient condition, a powerful catalyst that provides an unstable sulfhydryl functional group favored by the metal center for $N_2$ adsorption is necessary.

To conclude, in the present disclosure, $Cu_9S_5$/NC was prepared by a thermal heating reaction using the solid-state method, and an FE of 35% and a yield of 11.0 μg/hcm$^2$ (or 645 nmol/hcm$^2$) was achieved in a 0.5 M $Na_2SO_4$ electrolyte at −0.5 $V_{RHE}$ for electrochemical $NH_3$ production. However, the crystal structure of $Cu_9S_5$/NC was degraded to $Cu_2O$ during the NRR reaction. The regeneration redox cycle of metal sulfide was first demonstrated in the present disclosure. The $Cu_9S_5$ surface was reconstructed in a 5 mM $Na_2S$ electrolyte via an electrochemical sulfurization process.

The NRR activity of $Cu_9S_5$/NC was recovered in the reconstructed electrode, and $NH_3$ production was activated through repeated NRR and regeneration processes. The important of the metal-sulfur bond in NRR can be explained with the $NH_3$ yield on the recovered $Cu_9S_5$/NC surface. The degradation and regeneration processes of the metal chalcogenide catalyst for electrochemical $NH_3$ production show a mechanism similar to the enzymatic $N_2$ fixation process discovered for the FeMo cofactor of nitrogenase. The result suggests that, in order to achieve effective electrochemical $NH_3$ production under ambient condition, a powerful catalyst that provides an unstable sulfhydryl functional group favored by the metal center for $N_2$ adsorption is necessary. Accordingly, the present disclosure provides a new electrochemical regeneration method for a low-durability catalyst used in continuous NRR.

The invention claimed is:

1. A method for regenerating a catalyst for electrochemical synthesis of ammonia, the method comprising:

producing ammonia by electrochemical nitrogen reduction reaction (eNRR) in the presence of a catalyst, wherein the catalyst is a composite catalyst comprising a copper-sulfur compound and nitrogen-doped carbon; and regenerating the catalyst by electrochemical reaction in an aqueous solution comprising $Na_2S$ to provide a regenerated catalyst, wherein the regenerating the catalyst is performed at a potential of 0.05-0.5 $V_{RHE}$ for 30 minutes to 5 hours;

wherein the producing of ammonia results in cleavage of a Cu—S bond of the copper-sulfur compound, and the cleaved Cu—S bond is restored by the regenerating the catalyst.

2. The method according to claim 1, further comprising producing ammonia using the regenerated catalyst.

3. The method according to claim 1, wherein the regenerated catalyst including the copper-sulfur compound is represented by the chemical formula $Cu_xS_y$, wherein x is 1.7-1.8 and y is 1.

4. The method according to claim 1, wherein the composite catalyst has a mesoporosity that is greater than $Cu_9S_5$ over a pore size range of 2 nm to 8 nm as determined by Barrett-Joyner-Halenda plots.

5. The method for electrochemical synthesis of ammonia according to claim 1 that is greater than $Cu_9S_5$ over a pore size range of 2 nm to 8 nm as determined by Barrett-Joyner-Halenda plots.

6. The method according to claim 1, wherein the composite catalyst has a specific surface area (SSA) of 5-20 $m^2g^{-1}$.

* * * * *